US007637490B2

(12) United States Patent
Kapturowski et al.

(10) Patent No.: US 7,637,490 B2
(45) Date of Patent: Dec. 29, 2009

(54) INSERTING SYSTEMS AND METHODS

(75) Inventors: Edward J. Kapturowski, Apex, NC (US); Robert T. Snyder, Raleigh, NC (US); Chris Peterson, Fuquay Varina, NC (US); Richard D. Johnson, Fuquay-Varina, NC (US); Joseph I. Zuech, Hillsborough, NC (US)

(73) Assignee: Bowe Bell + Howell Company, Durham, NC (US)

( * ) Notice: Subject to any disclaimer, the term of this patent is extended or adjusted under 35 U.S.C. 154(b) by 406 days.

(21) Appl. No.: 11/546,535

(22) Filed: Oct. 12, 2006

(65) Prior Publication Data

US 2007/0164496 A1 Jul. 19, 2007

Related U.S. Application Data

(63) Continuation-in-part of application No. 11/240,604, filed on Oct. 3, 2005, now Pat. No. 7,396,006.

(51) Int. Cl.
*B65H 39/00* (2006.01)

(52) U.S. Cl. ..... 270/58.06; 270/52.14; 270/52.19; 270/52.22; 270/58.07; 270/58.23; 270/58.26

(58) Field of Classification Search ..... 270/52.01, 270/52.19, 52.22, 52.14, 58.06, 58.07, 58.23, 270/58.26; 53/284.3, 569
See application file for complete search history.

(56) References Cited

U.S. PATENT DOCUMENTS 3,207,017 A 9/1965 McCain et al.
3,275,118 A 9/1966 McCain et al.
3,545,371 A 12/1970 Reist (Continued)

FOREIGN PATENT DOCUMENTS

DE 3409168 9/1985

(Continued)

OTHER PUBLICATIONS

Extended European Search Report for EP07017894 dated Feb. 28, 2008.

(Continued)

*Primary Examiner*—Gene Crawford
*Assistant Examiner*—Leslie A Nicholson, III
(74) *Attorney, Agent, or Firm*—Jenkins, Wilson, Taylor & Hunt, P.A.

(57) ABSTRACT

Inserting systems and methods are provided for use in sheet processing. The inserting systems and methods provide improved handling of sheet articles during processing. Sheet articles can be advantageously and efficiently advanced in separate stacks and later combined for insertion into an envelope. For insertion into an envelope, the mouth of the envelope can be selectively variably opened depending upon the amount of insertion material to go into the envelope where the amount an envelope is to be opened can be based upon processing or job information. Sheet articles can be registered and aligned to facilitate processing efficiencies. Sheet articles with creases, such as envelopes with mouth flaps, can be processed through a roller system to bend the crease so that the flap of the envelope assumes a desired position for subsequent processing. Additionally, sheet articles can be processed through a staging station with increased capacity for sheet processing.

36 Claims, 53 Drawing Sheets

U.S. PATENT DOCUMENTS

| | | | |
|---|---|---|---|
| 3,717,074 | A | 2/1973 | Rasmussen |
| 4,071,997 | A | 2/1978 | Gunther, Jr. et al. |
| 4,078,790 | A | 3/1978 | Stocker |
| 4,217,085 | A | 8/1980 | Ljungberg et al. |
| 4,299,073 | A | 11/1981 | Golicz et al. |
| 4,524,691 | A | 6/1985 | Miller |
| 4,541,764 | A | 9/1985 | Govan et al. |
| 4,604,849 | A | 8/1986 | Zemke et al. |
| 4,694,631 | A | 9/1987 | Gunther, Jr. |
| 4,694,632 | A | 9/1987 | Gunther, Jr. |
| 4,753,429 | A | 6/1988 | Irvine et al. |
| 4,775,143 | A | 10/1988 | Arnoldi et al. |
| 4,787,192 | A | 11/1988 | Gunther, Jr. |
| 4,958,063 | A | 9/1990 | Hausmann |
| 5,100,125 | A | 3/1992 | Uplinger et al. |
| 5,125,214 | A | 6/1992 | Orsinger et al. |
| 5,154,410 | A | 10/1992 | Baader et al. |
| 5,230,504 | A | 7/1993 | Schmaling |
| 5,255,498 | A | 10/1993 | Hotchkiss et al. |
| 5,414,977 | A | 5/1995 | Cohen |
| 5,415,068 | A | 5/1995 | Marzullo |
| 5,417,414 | A | 5/1995 | Belec et al. |
| 5,449,159 | A | 9/1995 | Belec et al. |
| 5,524,417 | A | 6/1996 | Iddon |
| 5,581,972 | A | 12/1996 | Antonelli |
| 5,737,899 | A | 4/1998 | Supron et al. |
| 5,802,808 | A | 9/1998 | Lyga |
| 5,848,518 | A | 12/1998 | Bufalini et al. |
| 5,860,643 | A | 1/1999 | Moser et al. |
| 6,041,569 | A | 3/2000 | Freeman et al. |
| 6,182,962 | B1 | 2/2001 | Leuthold |
| 6,341,773 | B1 | 1/2002 | Aprato et al. |
| 6,371,902 | B1 | 4/2002 | Bluemle |
| 6,398,204 | B1 | 6/2002 | Keane et al. |
| 6,446,955 | B1 | 9/2002 | Janatka et al. |
| 6,615,105 | B2 | 9/2003 | Masotta |
| 6,915,184 | B2 | 7/2005 | Yates et al. |
| 6,957,521 | B2 | 10/2005 | Botschek et al. |
| 7,021,184 | B2 | 4/2006 | Sussmeier et al. |
| 7,220,093 | B2 | 5/2007 | Overman et al. |
| 7,396,006 | B2 | 7/2008 | Kapturowski et al. |
| 2003/0014376 | A1 | 1/2003 | DeWitt et al. |
| 2004/0035527 | A1 | 2/2004 | Cook |
| 2004/0255561 | A1 | 12/2004 | Heilman |
| 2005/0189409 | A1 | 9/2005 | Conrad et al. |
| 2007/0075475 | A1 | 4/2007 | Kapturowski et al. |
| 2007/0145659 | A1 | 6/2007 | Kapturowski et al. |
| 2008/0086983 | A1 | 4/2008 | Kapturowski et al. |
| 2008/0088076 | A1 | 4/2008 | Shinn et al. |
| 2008/0088083 | A1 | 4/2008 | Kapturowski et al. |
| 2008/0090713 | A1 | 4/2008 | Kapturowski et al. |

FOREIGN PATENT DOCUMENTS

| | | | |
|---|---|---|---|
| DE | 3811221 | A1 | 10/1989 |
| DE | 3938530 | | 8/1990 |
| DE | 19543634 | | 5/1997 |
| DE | 10208583 | A1 | 10/2002 |
| DE | 203 20 537 | | 10/2004 |
| EP | 0 113 011 | | 7/1984 |
| EP | 0220124 | | 4/1987 |
| EP | 1 770 042 | A2 | 4/2007 |
| EP | 1770042 | | 4/2007 |
| EP | 17700042 | | 4/2007 |
| EP | 1911602 | | 4/2008 |
| EP | 1911703 | | 4/2008 |
| EP | 1911704 | | 4/2008 |
| EP | 1911708 | | 4/2008 |
| EP | 1911710 | | 4/2008 |
| FR | 2 587 015 | A1 | 3/1987 |
| GB | 2347897 | | 9/2000 |
| GB | 2399056 | | 9/2004 |
| JP | 61295934 | | 12/1986 |
| JP | 08207177 | | 8/1996 |
| WO | WO98/46420 | | 10/1998 |
| WO | WO01/56712 | | 8/2001 |

OTHER PUBLICATIONS

Extended European Search Report dated Jan. 31, 2008 for EP 07020043.1-2211.

Partial European Search Report for EP07017898 dated Feb. 13, 2008.

Office Action-non final action dated Jun. 18, 2008 for U.S. Appl. No. 11/546,552.

Office Action Restriction Requirement dated Oct. 30, 2007 for U.S. Appl. No. 11/546,556.

Office Action-non final action dated Jan. 10, 2008 for U.S. Appl. No. 11/546,556.

Notice of Allowance dated Jul. 14, 2008 for U.S. Appl. No. 11/546,556.

Office Action-non final action dated Sep. 25, 2007 for U.S. Appl. No. 11/240,604.

Notice of Allowance dated Dec. 11, 2007 for U.S. Appl. No. 11/240,604.

Patent Withdrawal Notice dated Mar. 28, 2008 for U.S. Appl. No. 11/240,604.

Notice of Allowance dated Apr. 24, 2008 for U.S. Appl. No. 11/240,604.

European Search Report for Corresponding Application EP 06 01 8903 dated Mar. 13, 2007.

Extended European Search Report issued in European Patent Application No. EP 07 01 7896, dated Feb. 22, 2008.

INSERTING SYSTEMS AND METHODS

RELATED APPLICATIONS

This application is a continuation-in-part and claims benefit to U.S. patent application Ser. No. 11/240,604, entitled "Apparatus for Assembly of Document Sets into a Single Collated Packet", filed on Oct. 3, 2005 now U.S. Pat. No. 7,396,006, the disclosure of which is incorporated herein by reference in its entirety. This application also relates to co-pending U.S. patent application Ser. No. 11/546,554. entitled "Apparatuses and Methods For Staging and Processing Documents For Sheet Processing" filed on the same date herewith, the disclosure of which is incorporated by reference herein in its entirety. Further, this application relates to the co-pending U.S. patent application Ser. No. 11/546,556. entitled "Apparatuses and Methods For Variably Opening Envelopes", to co-pending U.S. patent application Ser. No. 11/546,555. entitled "Crease Roller Apparatuses and Methods For Using Same", and to U.S. patent application Ser. No. 11/546,553. entitled "Registration Apparatuses and Methods For Sheet Processing" also filed on the same date herewith, the disclosures of which are also incorporated by reference herein in their entireties.

TECHNICAL FIELD

The subject matter disclosed herein relates generally to processing of sheet articles. More particularly, the subject matter disclosed herein relates to inserting systems and methods for processing of sheet articles for mail processing.

BACKGROUND

A variety of inserting systems and methods are known in mail processing, for inserting material into items such as envelopes, folders and the like. In mail processing, insert material can include, for example, sheet articles such as folded or unfolded sheets.

Increasingly, a widespread need exists in commercial and governmental institutions for sheet processing machines, particularly mail processing machines, capable of operating at higher operation speeds with high reliabilities and short down-times. Operating sheet processing machines at or near their maximum capability is critical for optimizing output and throughput. Delays or inefficiencies in any operation in the processing of sheet articles can undesirably affect further operations downstream. Since each operation is typically synchronized to the others, delays in feeding time, as well as other operations, can be perpetuated throughout an entire sheet processing sequence or line.

Speed and efficiency of a sheet processing machine in high speed operations can be greatly affected by the handling of the sheet articles within the sheet processing machine. For example, demands on accuracy of sheet article positioning and alignment in the course of handling of sheet articles are greatly increased in high speed sheet or mail processing machines. False or inadequate alignment or registrations can result in misfeeds of sheet articles that can cause delays in processing. A further example relates to processing of creased sheet articles. While processing creased sheet articles within a sheet processing machine, the handling of the creased sheet articles is important as a crease can cause a sheet article to assume a non-planar position causing processing difficulties. When filling an envelope within an inserting system, for example, the fold of the flap of the envelope along its hinge line often causes the envelope to assume a non-planar position, which makes handling within the inserting system more difficult. Also, the fold of the flap often causes the flap to block the mouth of the envelope. Thus, it is desirable to have the envelope assume a more planar position during processing within a sheet processing machine. Complicated mechanisms currently used within sheet processing machines to force envelopes to assume a more planar position during processing can slow down processing and also cause delays and inefficiencies.

Another example of where the handling of sheet articles within an inserting system can affect delays or inefficiencies relates to the filling of envelopes. The processes and apparatuses used for opening envelopes can create a bottle neck within an inserting system. Any delays or inefficiencies in such processes or apparatuses can affect production through the entire inserting system. Thus, any improvement in speeds or efficiencies can greatly affect production of the inserting system. For example, early steps for preparing the envelopes for insertion may be beneficial. Also, processing the envelope in a more effective manner can improve throughput of the inserting system. For instance, maximizing the amount that an envelope is held open is desirable to prevent unneeded contraction of the sides of the envelope that can result in misfeeds of insert material, while still holding the envelope opened wide enough to permit the filling of the envelope. Such an improvement can increase efficiencies for insertion of insert material into envelopes.

In light of the above, there remains much room for improvement within the art, particularly for improved handling of sheet articles within sheet processing systems, such as mail processing systems, and particularly with regard to improving throughput and increasing efficiencies within a sheet processing machine.

SUMMARY

In accordance with this disclosure, novel inserting systems and methods are provided for use in sheet processing. The inserting systems and methods provide improved handling of sheet articles during processing. Sheet articles can be advantageously and efficiently advanced in separate stacks and later combined for insertion into an envelope. For insertion into an envelope, the mouth of the envelope can be selectively variably opened depending upon the amount of insertion material to go into the envelope where the amount an envelope is to be opened can be based upon processing or job information. Sheet articles can be registered and aligned to facilitate processing efficiencies. Sheet articles with creases, such as envelopes with mouth flaps, can be processed through a roller system to bend the crease so that the flap of the envelope assumes a desired position for subsequent processing. Additionally, sheet articles can be processed through a staging station with increased capacity for sheet processing.

It is an object of the present disclosure therefore to provide novel inserting systems and methods. This and other objects as may become apparent from the present disclosure are achieved, at least in whole or in part, by the subject matter described herein.

BRIEF DESCRIPTION OF THE DRAWINGS

Preferred embodiments of the subject matter described herein will now be described with reference to the accompanying drawings, of which.

DETAILED DESCRIPTION

Reference will now be made in detail to presently preferred embodiments of the present subject matter, one or more examples of which are shown in the various figures. Each example is provided to explain the subject matter and not as a limitation. In fact, features illustrated or described as part of one embodiment can be used in another embodiment to yield still yet another embodiment. It is intended that the present subject matter covers such modifications and variations.

The term "sheet article" is used herein to designate any sheet article, and can include, for example and without limitation, envelopes, sheet inserts folded or unfolded for insertion into an envelope or folder, and any other sheet materials.

The term "mail article" is used herein to designate any article for possible insert into a mailing package, and can include, for example and without limitation, computer disks, compact disks, promotional items, or the like, as wells any sheet articles.

The term "document set" is used herein to designate one or more sheet articles and/or mail articles grouped together for processing.

As defined herein, the term "insert material" can be any material to be inserted into an envelope, and can include, for example and without limitation, one or more document sets, sheet articles, mail articles or combinations thereof.

Figure 1:
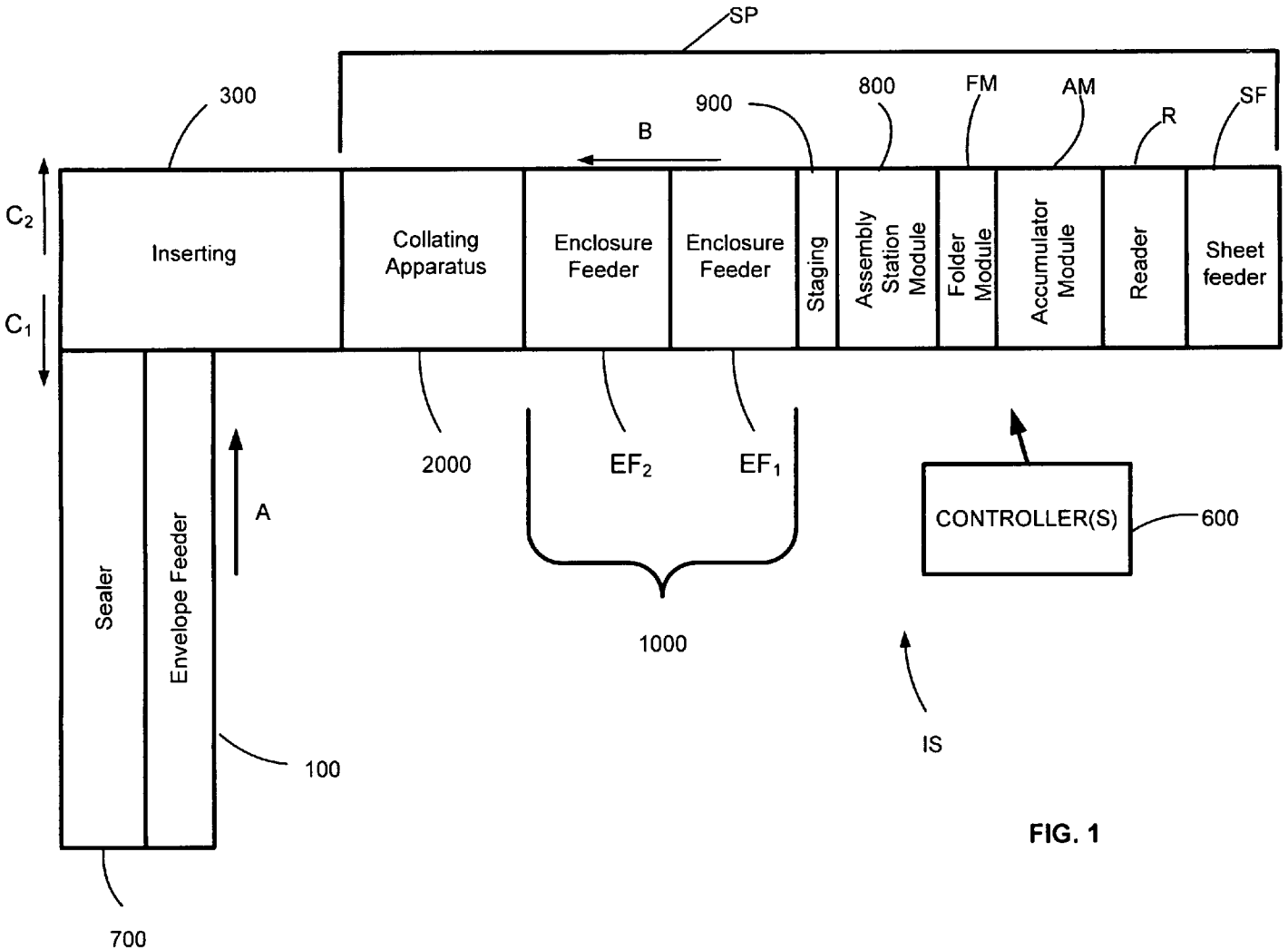
FIG. 1 illustrates a schematic view of an embodiment of an inserting system according to the present subject matter.

The present subject matter relates to sheet processing, such as, for example, mail inserting systems, mail sorting systems, and any other sheet processing systems. For example, FIG. 1 illustrates a plan schematic view of an inserting system, generally designated IS. The inserting system IS can comprise different modules that can be assembled in different arrangements for inserting material into envelopes. The different modules and inserting system IS can be controlled by a controller 600. The controller 600 can be computer hardware or software. For example, the controller 600 can include one or more computers, mini-computers, programmable logic controllers or the like.

Inserting system IS can include, for example, an envelope feeder module, generally designated as 100, which feeds envelopes in a direction A into an inserting station module, generally designated as 300. Insert material for insertion into an envelope can be processed by a sheet processor SP along a conveying path in a direction B as described further herein. An assembly station module 800 can be used to collect one or more sheet articles and/or one or more mail articles from upstream into a first document set that can be sent to a staging station 900 before being conveyed in direction B toward inserting station module 300. In front of or behind each first document set on a conveying path of the inserting system IS, one or more sheet articles and/or mail articles can be fed on the conveying path to form second document sets as the first document sets move in direction B so that each first document set and corresponding second document sets can be combined together into insert material for insertion into an envelope.

The second document sets are fed into the conveying path to be combined with the first document sets by one or more modules 1000 of enclosure feeders $EF_1$, $EF_2$. Each enclosure feeder module $EF_1$, $EF_2$ can include one or more station feeders for providing second document sets to be included in insert material to fill the envelope. Enclosure feeders $EF_1$, $EF_2$ can feed second document sets in front of the first document set or behind the first document set. Further, enclosure feeders $EF_1$, $EF_2$ can feed sheet articles and/or mail articles on top of the first document set.

In the examples shown, a collating apparatus module 2000, as shown and described in U.S. patent application Ser. No. 11/240,604, can be provided to collate the first and second document sets together before being feed to inserting station module 300 where the material can then be placed into an envelope. Each filled envelope can then be directed in direction $C_1$ into a sealer module 700 after insertion has occurred. The envelopes can be sealed in sealer module 700 before they are sent out for metering and mailing. Further, the inserting station module can include an apparatus for diverting defects in a direction $C_2$ out of inserting system IS.

Other modules can be included in inserting system IS. For example, a sheet feeder SF for feeding in sheet articles to be collected in assembly station 800 is normally positioned upstream of the assembly station 800. Assembly station 800 can be followed by staging station 900. Further, other modules can be placed inside inserting system IS such as a folder module FM, accumulator module AM and reader module R as are commonly used within the art. These modules can be placed anywhere within inserting system IS where they may be needed for a desired use.

Reader module R can be used to read and collect information from sheets passing under it, for example, from bar codes. Reader module R can be in direct communication with controller 600. Reader module R can read information from sheet articles and/or mail articles to be used by controller 600 to control inserting system IS. The information read by reader module R can help determine how a grouping of sheet articles and/or mail articles in a document set will be processed within inserting system IS. Further, the information can be used to determine what other document sets may be needed in the insert material for any particular envelope. Accordingly, the information can also be used to determine the amount of insert material to be received in each envelope.

Figure 2:
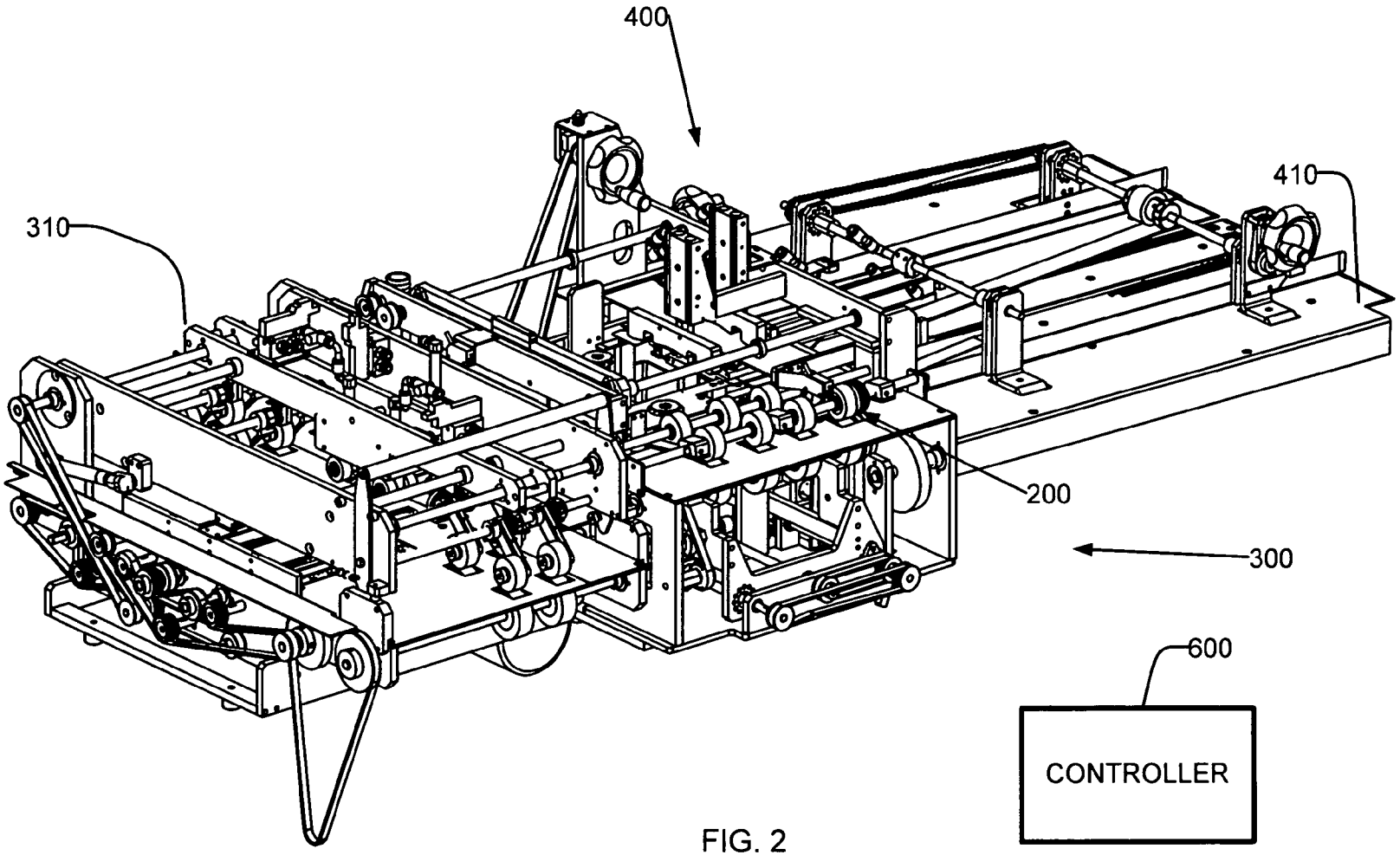
FIG. 2 illustrates a perspective view of an embodiment of an inserting station according to the present subject matter.

Inserting station module 300 is shown in more detail in FIG. 2. Inserting station 300 can include a variable envelope opener apparatus, generally designated as 400, for opening the envelope for receipt of the insert material therein. Variable envelope opener apparatus 400 can operate to permit an envelope to be opened in different widths depending on the characteristics of the insert material to be inserted into the envelope. As envelopes are fed into variable envelope opener apparatus 400, the envelopes can pass through a crease roller apparatus, generally designated as 200, to help ensure the flap of each envelope entering the variable envelope opener apparatus 400 does not interfere with the insertion of the insert material into that envelope. When an envelope is in the variable envelope opener apparatus 400, insert material can travel on the conveying path including atop deck 410, which helps to direct the insert material into an envelope within the variable envelope opener apparatus 400. Once the insert material has been inserted into the envelope, the envelope is conveyed down inserting station 300 to a right-angle-turn apparatus, generally designated as 310, where the filled envelope can then be conveyed into sealer module 700 as described above or can be diverted out of the inserting system IS in direction $C_2$ as shown in FIG. 1 if a defect or problem is detected with the envelope.

Figure 3:
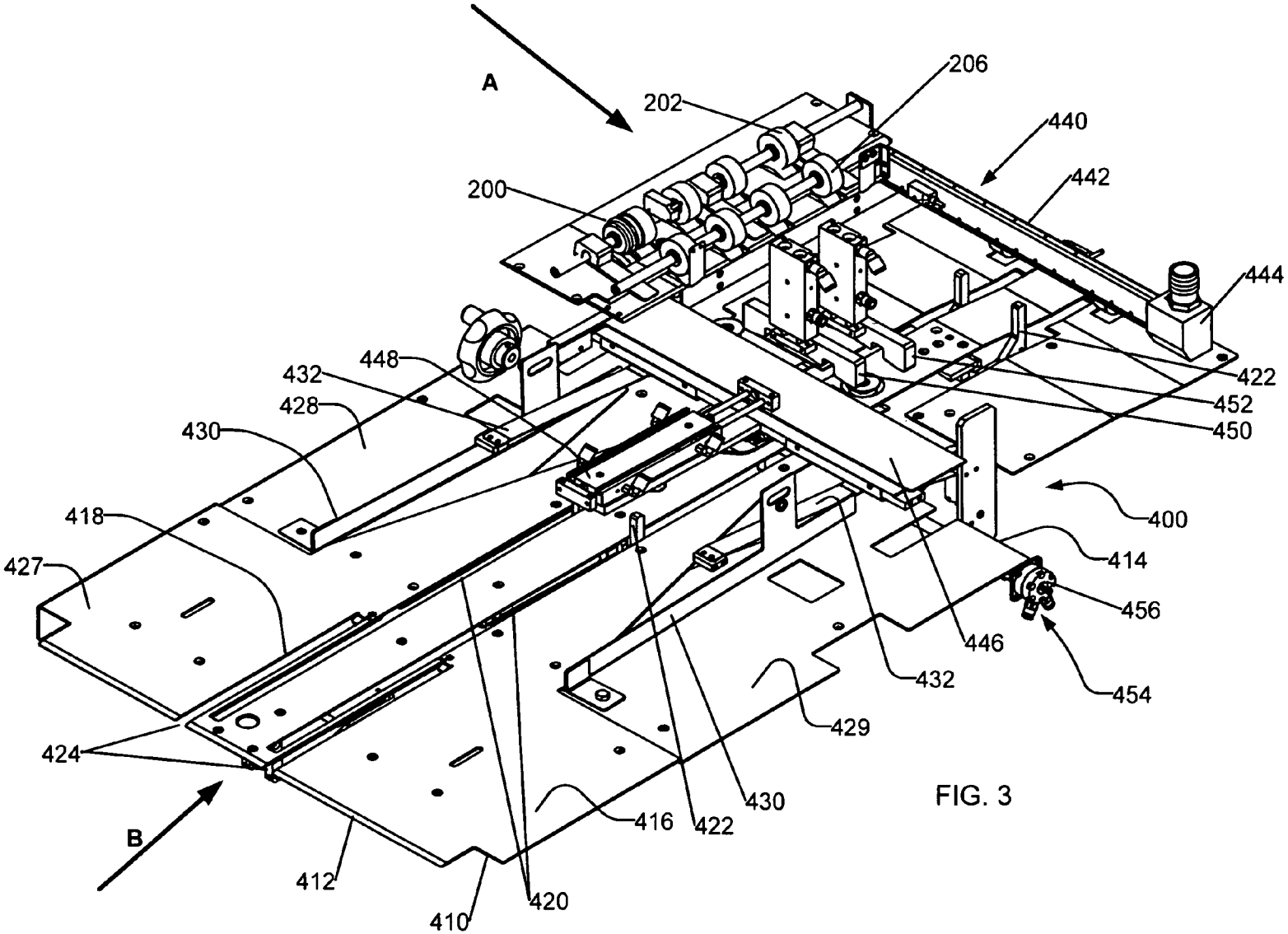
FIG. 3 illustrates a perspective view of embodiments of a variable enveloper apparatus, a registration apparatus, and a crease roller apparatus according to the present subject matter.

FIG. 3 illustrates a perspective view of variable envelope opener apparatus 400 and crease roller apparatus 200. The variable envelope opener apparatus 400 includes deck 410 having a first end 412 and a second end 414. Deck 410 further includes a top side 416 that is configured to provide a conveying path 418 for insert material to be conveyed long toward an envelope in which it shall be inserted. Deck 410 can include one or more elongated slots 420 for pusher members 422.

As shown in the illustrated embodiment, a pair of elongated slots 420 can be aligned down the conveying path 418 or deck 410. In such an embodiment, a pair of insertion pusher members 422, such as pusher pins or picks, can be conveyed down the parallel slots 420 such that the insertion pusher members 422 are conveyed parallel to one another to register the insert material and push the insert material into an envelope. Insertion pusher members 422 can then convey the envelope onto the right-angle-turn apparatus 310 to be conveyed to sealing module 700 or be diverted out of the inserting system if there is a defect therein. The deck 410 can also include elongated slots 424 in which collecting pusher members (not shown) from downstream in the inserting system IS can be conveyed. In such an embodiment, collecting pusher members can convey the insert material along conveying path 418 in direction B from upstream until such point that insertion pusher members 422 pick up the insert material to be conveyed toward the envelope. At such point, the collecting pusher members descend below conveying path 418 and deck 410.

The deck 410 can include a first platform 427 which overlays a second platform 428 and a third platform 429 to form the top surface 416 of the deck 410. Top side 416 can have insert guides 430 on either side of the conveying path 418 to help guide the insert material toward the envelope. Insert guides 430 can be adjustable to accommodate different sized insert material thereby helping to funnel the insert material toward the envelope. Flexible tabs 432 can be positioned above top side 416 of deck 410 such that the insert material can pass between the tabs 432 and top side 416 for the deck 410. Tabs 432 can be attached to the insert guide such that tabs 432 moves with insert guides 430. Tabs 432 can extend under the flap of the envelope but not into the mouth of the envelope in which the insert material is to be received.

Envelopes fed in direction A can be fed under crease roller apparatus 200 by sets of feed rollers 202, 206. The crease roller apparatus can score envelopes entering the variable envelope opener apparatus 400 along the fold of flaps of the envelope to bend the flaps of the envelopes against the fold. This scoring helps to keep the envelopes open for insertion of material as described in more detail below.

The sets of feed rollers 202, 206 feed the envelopes into a registration apparatus, generally designated as 440, that includes a housing 442 and a vacuum connection 444. Registration apparatus 440 registers the envelopes fed therein by the feed rollers to align the envelopes. The registration apparatus 440 and a flat plate 446 hold the envelopes fed into the registration apparatus 444 in a staging position. Flat plate 446 can be moved back and forth by an actuator 448 between an extended position and a retracted position. When flat plate 446 is extended, flat plate 446 is in a holding location. When flat plate 446 is retracted, flat plate 446 is in an entry location. A first drop bar 450 is positioned above flat plate 446 and a second drop bar 452 is placed above the staging position between flat plate 446 and registration apparatus 440. As flat plate 446 is moved from the holding location to the entry location, first drop bar 450 and second drop bar 452 push each envelope into an insertion position where a holding system holds that envelope. A feeding guide, generally designated as 454, which can include a rotary actuator 456 can rotate fingers into the mouth of each envelope in the insertion position to hold it open while insertion pusher members 422 push the insert material into the envelope and then carry the envelope to right-angle-turn apparatus 310 shown in FIG. 2. Depending on the physical characteristics of material to be inserted into the envelopes, envelopes can be held open in various degrees by shifting deck 410 and feeding guide 454 between different locations. Such shifting of deck 410 and feeding guide 454 and the variable envelope opener apparatus 400 will be described in more detail below.

Figure 4A:
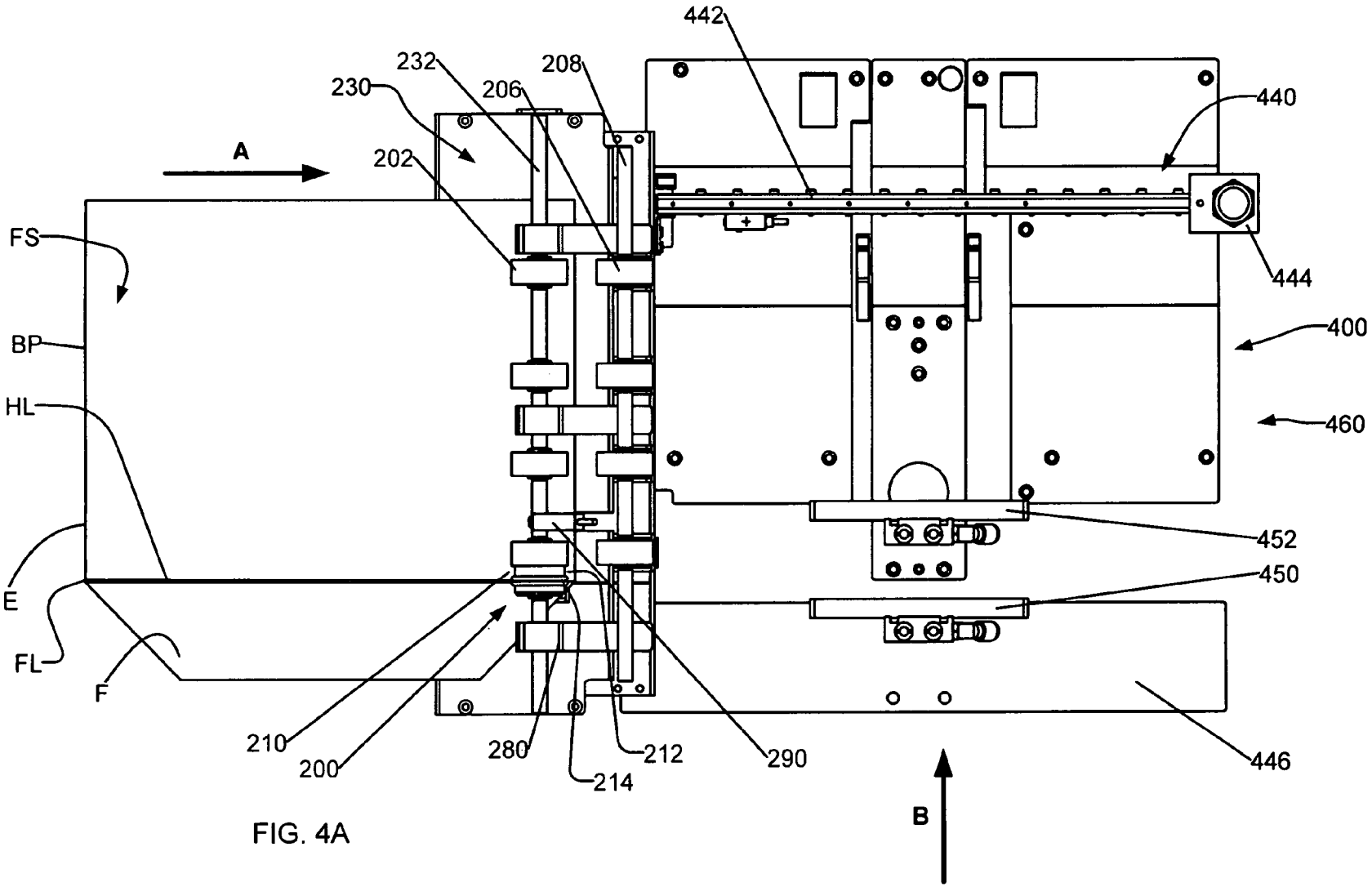
FIG. 4A illustrates a top plan view of an envelope entering the crease roller apparatus according to FIG. 3.
Figure 4B:
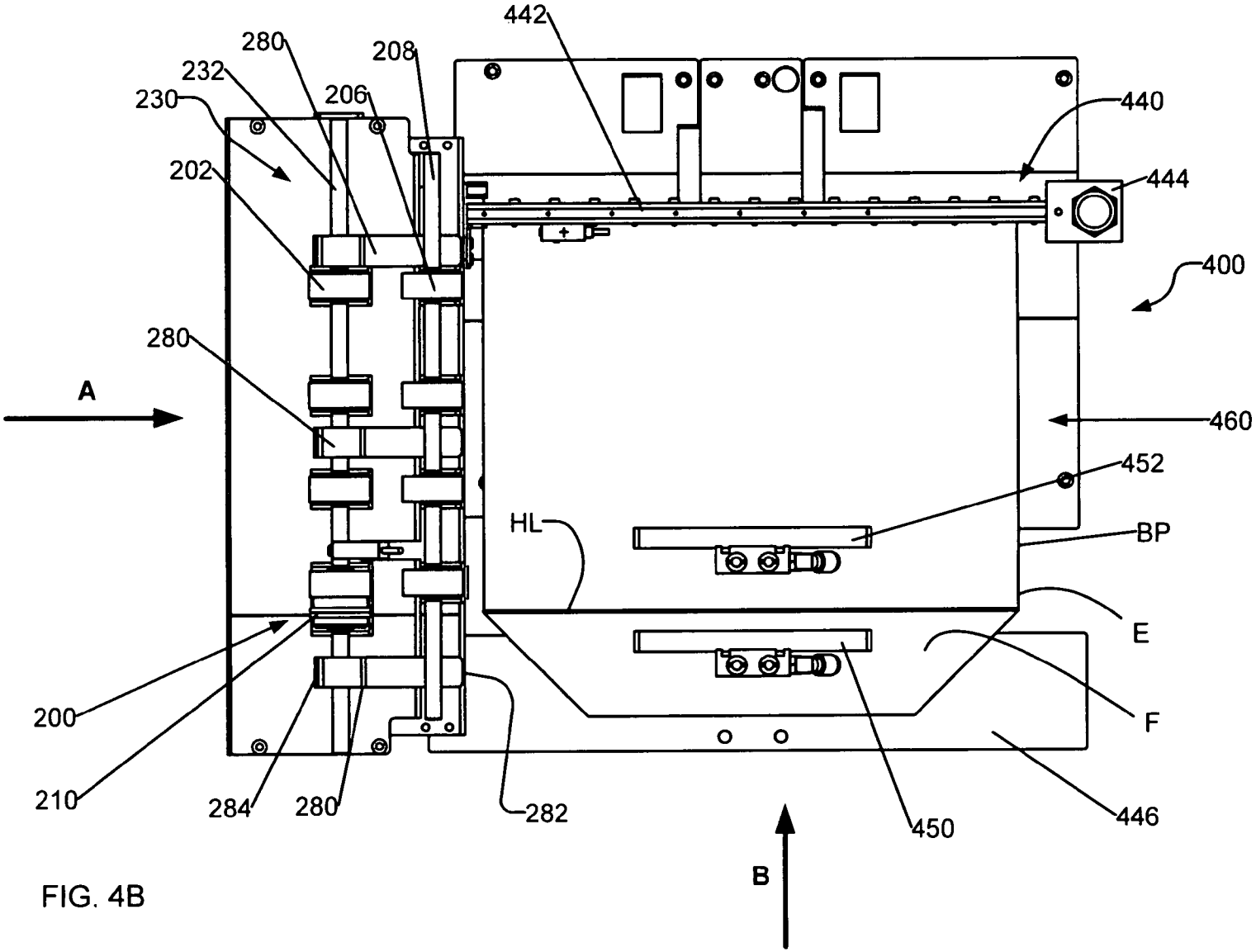
FIG. 4B illustrates a top plan view of the envelope residing in the registration apparatus according to FIG. 3.
Figure 5:
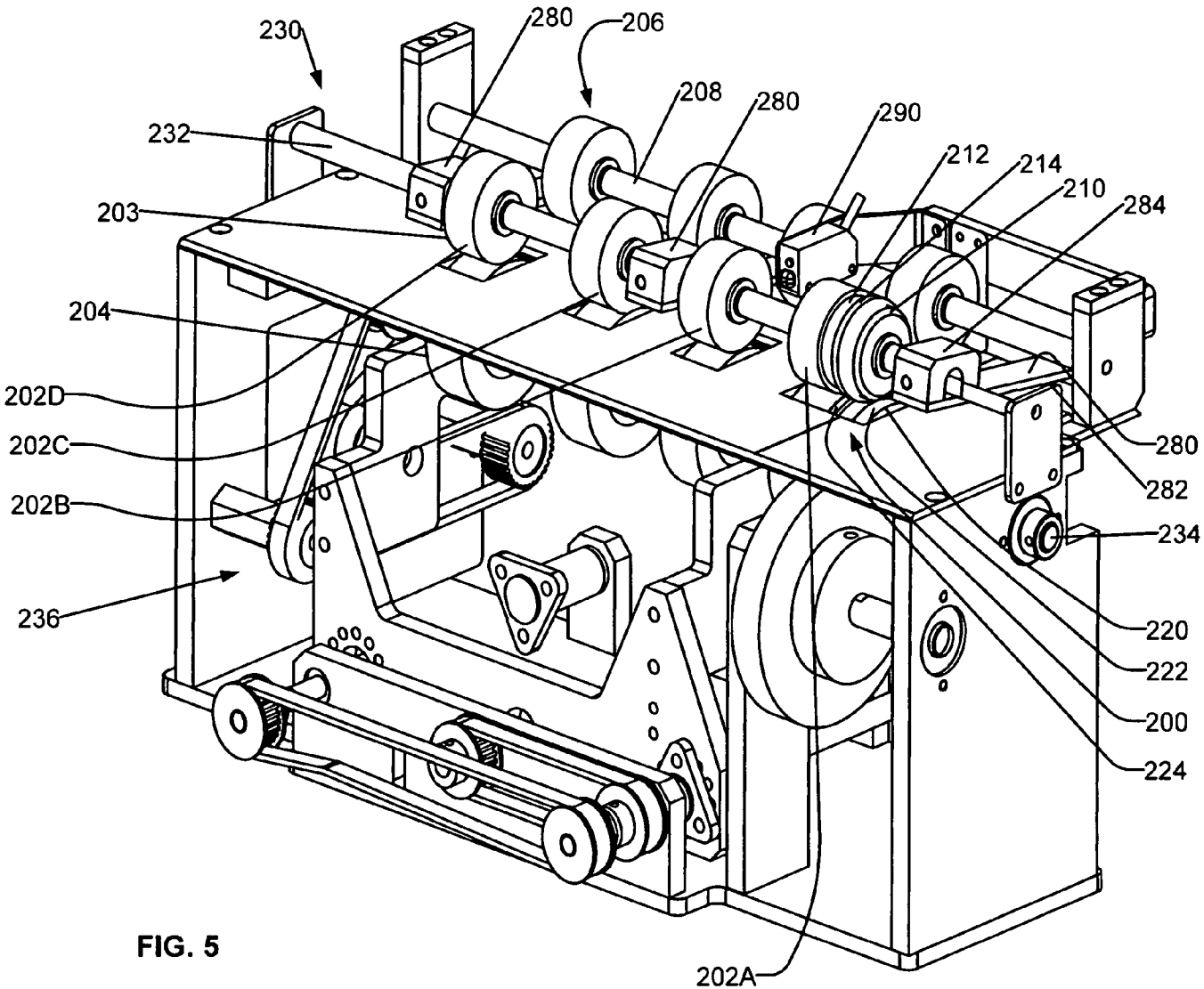
FIG. 5 illustrates a perspective view of the embodiment of the crease roller apparatus according to FIG. 3.

FIGS. 4A and 4B illustrate the feeding of an envelope E into a staging position, generally designated as 460, within variable envelope apparatus 400. Envelope E has a body portion BP and a flap F. A fold FL is created between body portion BP and flap F along a crease or hinge line HL. Body portion BP can have a face side FS on which an address window usually resides or an address is usually printed. Body portion BP also has a backside. The backside of the body portion BP is where flap F can be secured to body portion BP to close envelope E.

Envelope E can be fed from the envelope feeder apparatus 100 (see FIG. 1) such that envelope E has face side FS of body portion BP of envelope E facing upward. Flap F of envelope E extends outward from hinge line HL away from body portion BP of envelope E. The first set of feed rollers 202 transports envelope E and, along with the second set of feed rollers 206, feed envelope E into registration apparatus 440 such that flap F resides on flap plate 446. A negative pressure can be created through housing 442 of registration apparatus 440 by vacuum connection 444 to register envelope E within registration apparatus 440. As shown in FIG. 4B, envelope E is, at this point, aligned under first drop bar 450 and second drop bar 452. First drop bar 450 and second drop bar 452 can be used to help push envelope E from staging position 460 into an insertion position. The envelope is extracted from the registration device before insertion of material into the envelope by the downward action of the second drop bar 452. While envelope E is being fed by the sets of feed rollers 202, 206 into registration apparatus 440, crease roller apparatus 200 can score envelope E along the hinge line HL to bend flap F of envelope E in an inverted direction from that of the original fold along hinge line HL.

As seen in FIGS. 4A, 4B, 5, 6A, and 6B, the crease roller apparatus 200 can include a first roller 210 having a circumferential perimeter surface 212 disposed therearound. First roller 210 can include a ridge 214 that extends at least partially around circumferential perimeter surface 212. Crease roller apparatus 200 can also include a second roller 220 that also has a circumferential perimeter surface 222 disposed therearound. Circumferential perimeter surface 222 of second roller 220 can have a channel, or groove, 224 that extends at least partially around it. An alignment mechanism, generally designated as 230, can engage first roller 210 and second roller 220 so that circumferential perimeter surfaces 212, 222 of first roller 210 and second roller 220, respectively, are aligned to permit ridge 214 to reside and run within channel 224.

In the embodiment shown in FIGS. 4A, 4B, 5, 6A, and 6B, the alignment mechanism 230 includes an upper shaft 232 and a lower shaft 234 on which the set of feed rollers 202 reside. Each set of feed rollers can comprise pairs of rollers disposed on the respective shafts 232, 234. For example, the first set of feed rollers 202 can comprise pairs of rollers 202A, 202B, 202C, 202D. Each pair of feed rollers include upper rollers 203 and bottom rollers 204 that are aligned to receive and transport an envelope E therebetween when at least one of shafts 232, 234 is driven by a drive system 236 (e.g., a gear or pulley driven mechanism). The drive system can also be used to drive the second set of feed rollers 206. Within the embodiment shown, crease roller apparatus 202 can also be driven by drive system 236 since shafts 232, 234 make up at least a part of alignment mechanism 230 of crease roller apparatus 200. Alternatively, the second set of feed rollers and/or crease roller apparatus 200 can be driven by separate drive systems.

Different pairs of feed rollers 202A, 202B, 202C, 202D within the set of feed rollers 202 may be used depending on the size of the envelope being processed. However, the alignment of the hinge lines of the envelopes being process with the crease roller apparatus 200 should not change. For example, pairs of feed rollers 202A and 202B can be used to transport small sized envelopes such as normal letter envelopes, while the pairs of rollers 202C and 202D do not come in contact with the envelope. In contrast, when a flats envelope is being transported, all four sets of rollers 202A, 202B, 202C and 202D can be used to propel envelope E into the variable envelope opener apparatus 400. With any size envelope, the hinge line of the envelope is aligned with first roller 210 and second roller 220 of crease roller apparatus 200, so that the envelope is scored on or about the hinge line by ridge 214 of first roller 210 positioned and moving within channel 224 of second roller 220.

Figure 7:
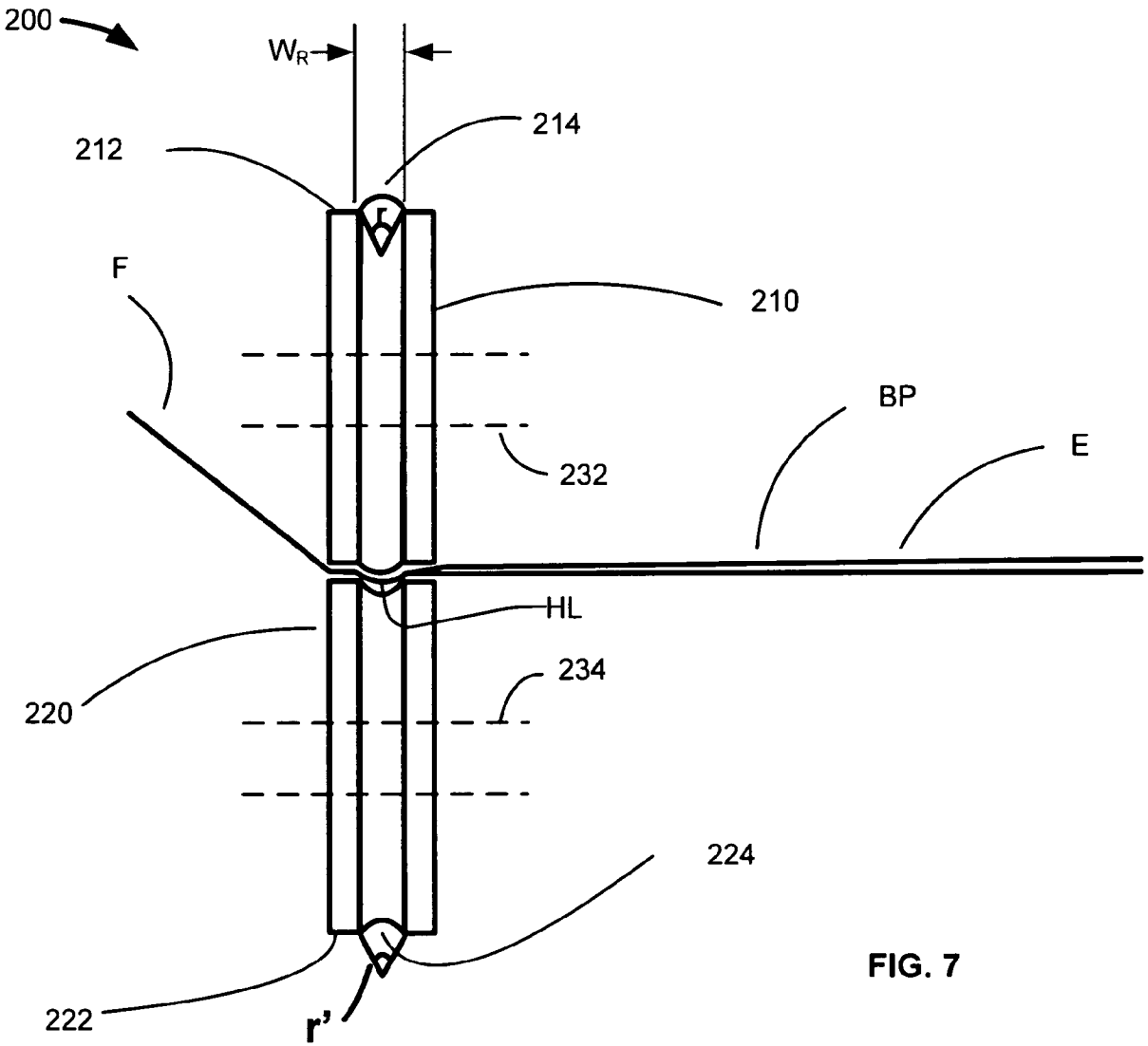
FIG. 7 illustrates a schematic view of an embodiment of a first roller and second roller used in a crease roller apparatus.

As can be seen in FIG. 7, envelope E can be passed between first roller 210 and second roller 220 such that hinge line HL of envelope E is scored by ridge 214 of first roller 210 within channel 224 of second roller 220. This scoring causes flap F of envelope E to turn upward opposite the direction the natural fold of hinge line HL. In this manner, envelope E including flap F will take on a more planar position after passing between crease rollers 210, 220. As shown in FIG. 7, ridge 214 can have a radius of curvature r that is substantially similar to a radius of curvature r' of channel 224.

Further, radius of curvature r of ridge 214 can be smaller than radius of curvature r' of channel 224. For example, the radius of curvature r of the ridge 214 can have a radius of curvature that is slightly less than the radius of curvature of channel 224 so that the side of ridge 214 do not contact the sides of channel 224. Still further, ridge 214 can be of a conical shape or the like such that its apex can make proximate contact with the hinge line HL upon contact with the envelope E. Similarly, the channel 224 can be of a conical shape oriented complementary or inversely to the conical shape of ridge. In other embodiments, channel 224 can be different in size and/or shape than ridge 214, so long as the envelope being scored is scored on or about its hinge line to cause the whole envelope to assume a more planar position. Ridge 214 can also have a width $W_R$ that is large enough to score along the hinge line, even if the envelope is misfed or is skewed.

Ridge 214 can be formed on a circumferential perimeter surface 212 of first roller 210 by molding, casting, or grinding and finishing of the roller as it is created. The material of the roller can be a metal or a hard plastic. Further, ridge 214 can be made of different material than the body of first roller 210. Such material can be more flexible than the material of the body of first roller 210. For example, ridge 214 can be formed by the placement of one or more o-rings on the outer surface of the circumferential perimeter 212 of the first roller 210. If an o-ring is used to form the ridge 214, a groove can be carved into the circumferential perimeter 214 of first roller 210 in which the o-ring can reside. The o-ring can be made of a flexible material that allows it to deform under the pressure created between first roller 210 and second roller 220.

Figure 6A:
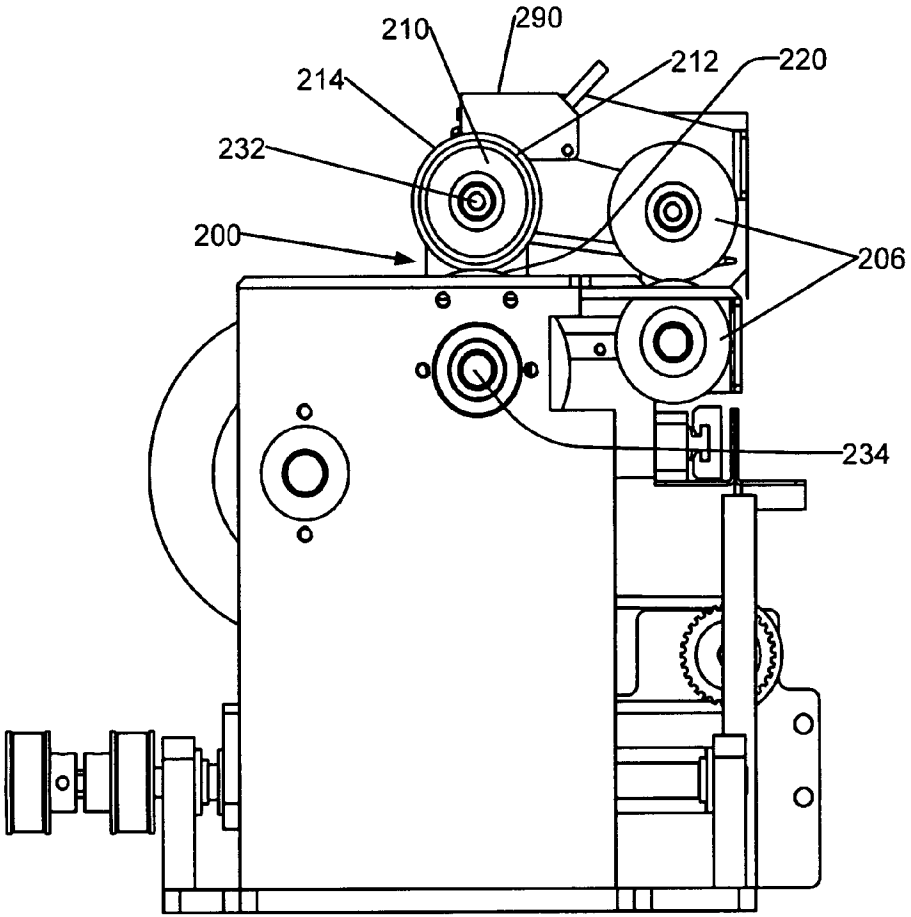
FIG. 6A illustrates a side view of the embodiment of the crease roller apparatus according to FIG. 3.
Figure 6B:
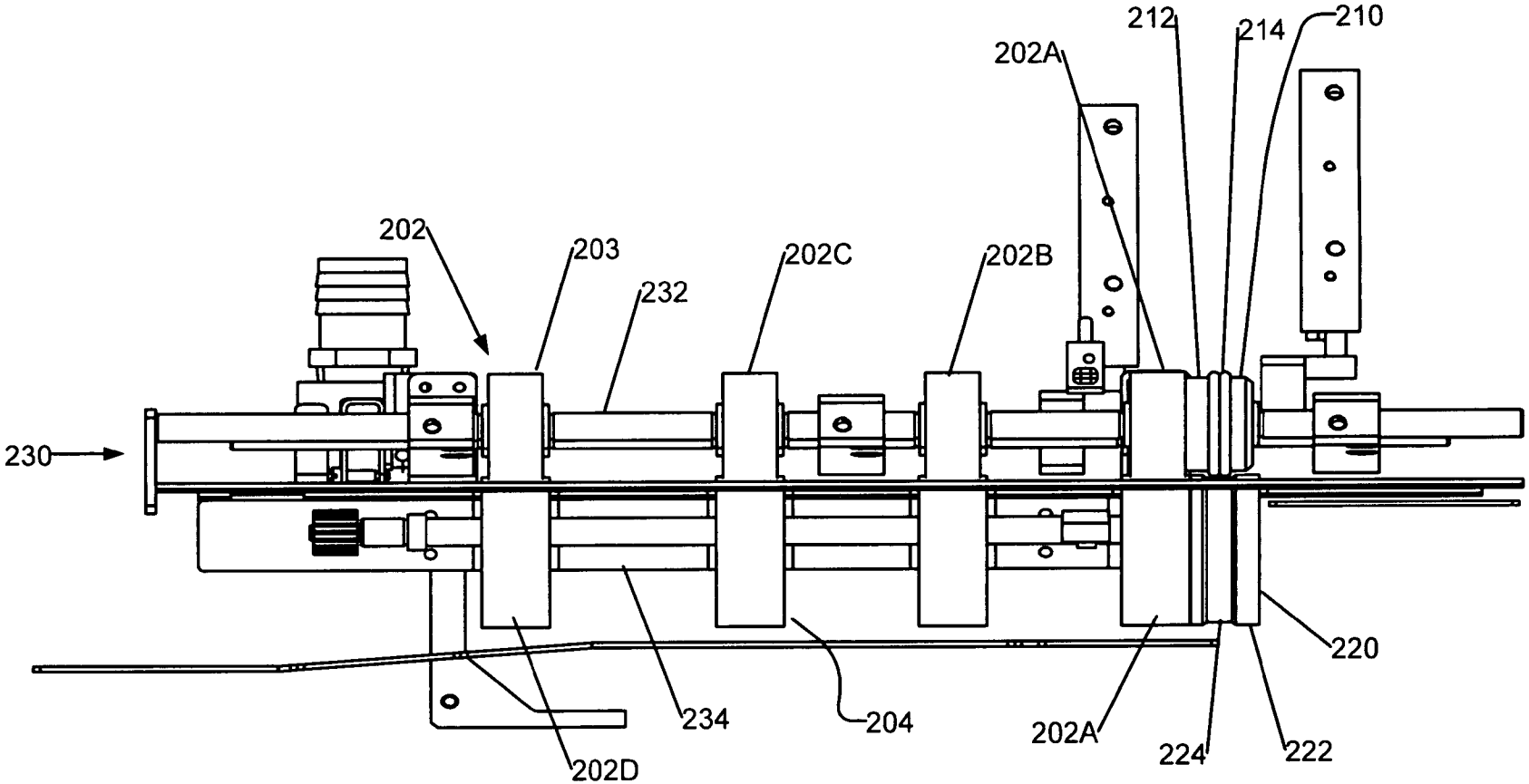
FIG. 6B illustrates a front view of the embodiment of the crease roller apparatus according to FIG. 3.
Figure 8A:
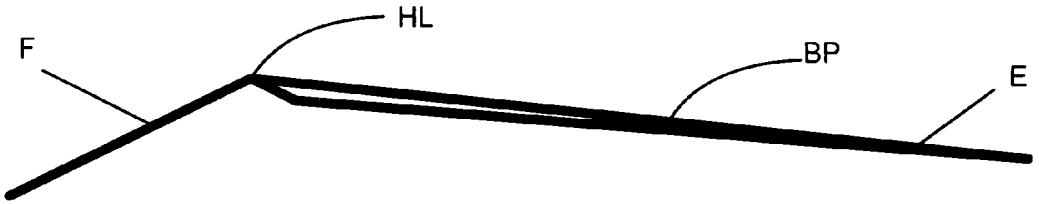
FIGS. 8A, 8B, and 8C illustrate schematic views of an envelope passing through an embodiment of a crease roller apparatus.
Figure 8B:
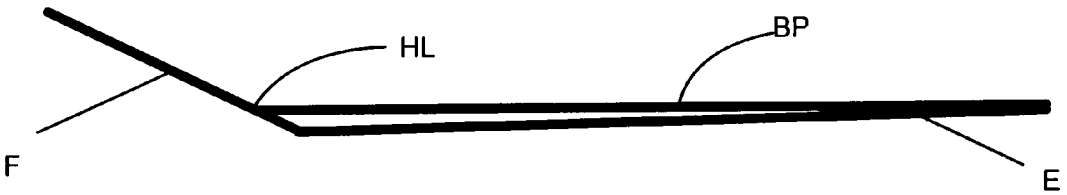
Figure 8C:
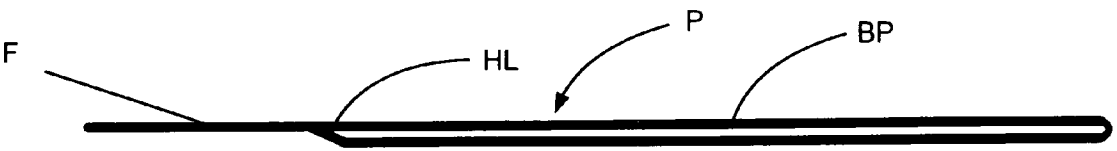

FIGS. 8A, 8B, and 8C provide a schematic view of an envelope E during processing through a crease roller apparatus. FIG. 6A illustrates envelope E before it is scored by the crease roller apparatus along its hinge line HL. Flap F of envelope E has a tendency to extend in the direction in which hinge line HL folds flap F. As envelope E runs through the crease roller apparatus, envelope E is bent about hinge line HL such that flap F is bent in the direction opposite of the natural fold direction that hinge line HL creates for flap F. Once envelope E exits the crease roller apparatus, the folding in the inverted direction of flap F along hinge line HL helps the envelope to assume a more planar position, generally designated as P, with envelope flap F and envelope body portion BP residing in substantially the same plane. In this manner, envelope E can be more easily filled with insert material without flap F extending in its natural folded position and interfering with the insertion of the insert material. This permits easier processing of envelope E within insert station 300.

Figure 9B:
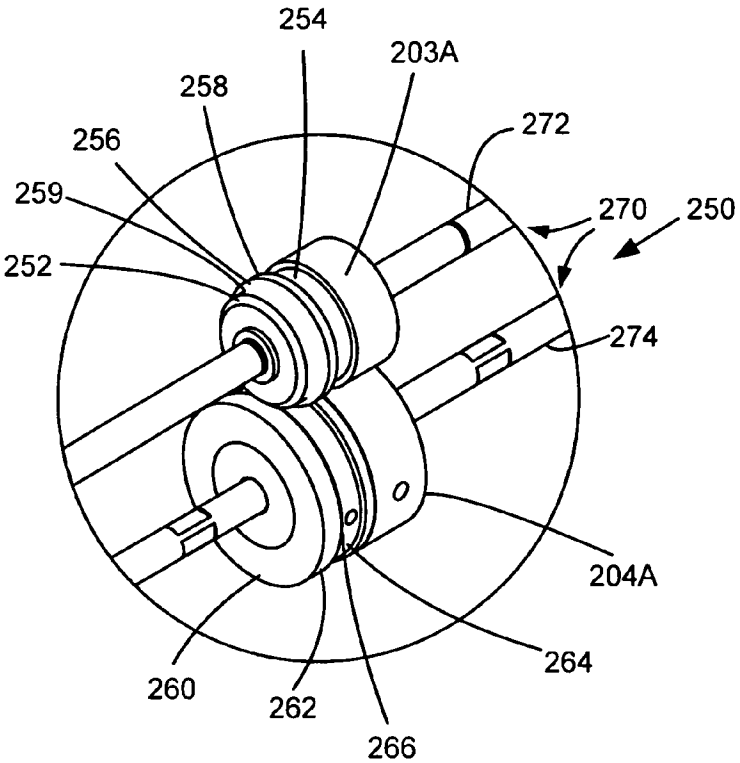
FIG. 9B illustrates a perspective view of the embodiment of a crease roller apparatus of FIG. 9A.
Figure 9A:
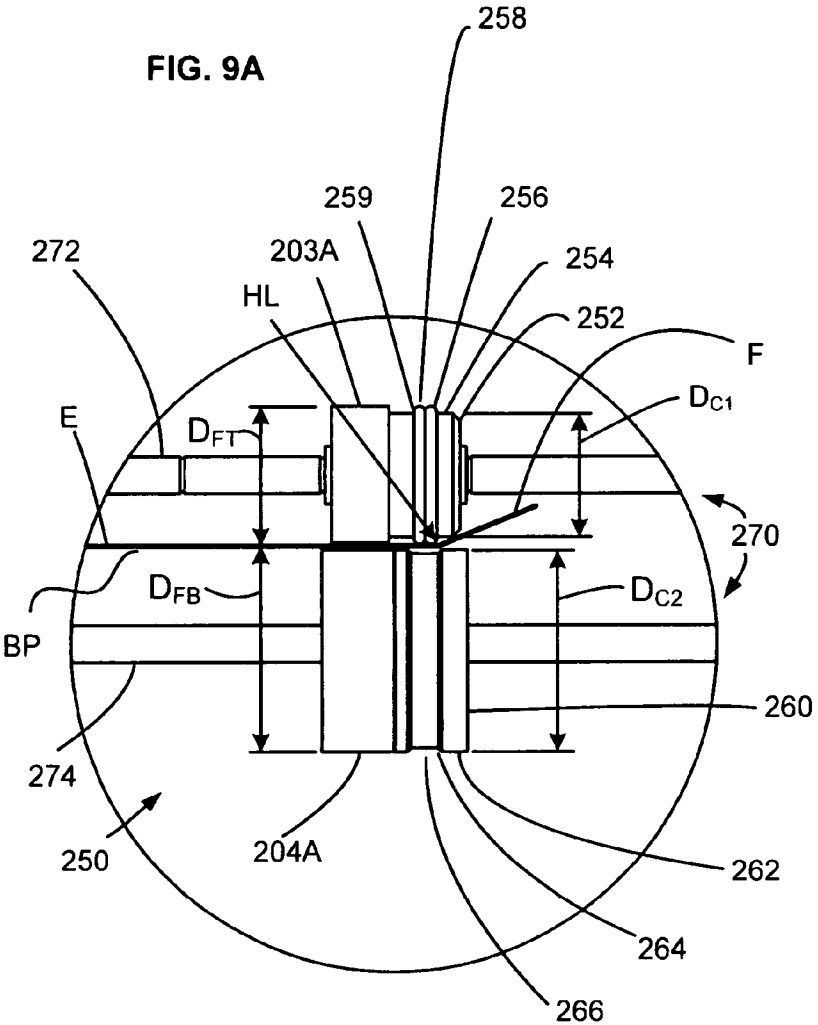
FIG. 9A illustrates a side view of a further embodiment of a crease roller apparatus.

FIGS. 9A and 9B illustrate a further embodiment of a crease roller apparatus, generally designated as 250. The crease roller apparatus 250 includes a first roller 252 having a circumferential perimeter surface 254 in which a groove is defined therein. A first o-ring 256 and a second o-ring 258 can be placed within the groove such that first o-ring 256 and second o-ring 258 form a ridge, generally designated as 259, extending around circumferential perimeter surface 254. The crease roller apparatus 250 can also include a second roller 260 having a circumferential perimeter surface 262 with a channel 264 defined therein. First roller 252 and second roller 260 can be aligned by an alignment mechanism generally designated as 270. Alignment mechanism 270 can include a first shaft 272 on which first roller 252 resides and a second shaft 274 on which second roller 260 resides. First shaft 272 and second shaft 274 can be the shafts on which the feed rollers reside, respectively. In this manner, the same mechanism that drives the feed rollers to transport envelope E into the variable envelope opener apparatus can also drive crease roller apparatus 250. Alternatively, alignment mechanism 270 can comprise a separate set of shafts and a separate drive system for crease rollers 250, 260 than that of the feed rollers. First roller 252 can be placed against a top feed roller 203A, while second roller 260 can be aligned against a bottom feed roller 204A. First roller 252 and second roller 260 are aligned so that ridge 259 formed by first o-ring 256 and second o-ring 258 engages channel 264 such that ridge 259 and channel 264 bend envelope E as it passes between them along hinge line HL of envelope E.

As shown in FIG. 9A, first roller 252 can have a diameter $D_{C1}$, and second roller 260 can have a diameter $D_{C2}$. Diameter $D_{C1}$ of first roller 252 can be less than a diameter $D_{FT}$ of top feed roller 203A. At the same time, ridge 259 extends past both diameter $D_{FT}$ of top feed roller 203A and diameter $D_{C1}$ of first roller 252 such that first o-ring 256 and second o-ring 258 extend to a base 266 of channel 264 of second roller 260 to permit first o-ring 256 and second o-ring 258 and channel 264 to engage an envelope E that passes therebetween. Second roller 260 can have a diameter $D_{C2}$ that is about equal to diameter $D_{FB}$ of bottom feed roller 204A. By having first roller 252 with a diameter less than feed roller 203A, while ridge of the first roller 252 extends past the diameter $D_{FT}$ of the feed roller 203A such that first o-ring 256 and the second o-ring ridge 258 extends to base 266 of channel 264, the only substantial contact to envelope E made by crease roller apparatus 250 can be by o-rings 256 and 258 running within channel 264. In this manner, crease roller apparatus 250 only pressingly engages envelope E on or about hinge line HL. First and second o-rings 256, 258 are wide enough and can be slightly deformed when contacting base 266 of channel 264 so that the hinge line of envelope E passing therebetween is scored, even if envelope E is skewed during feeding.

As shown in FIGS. 9A and 9B, first roller 252 can reside on first shaft 272 against top feed roller 203A, while second roller 260 can reside on second shaft 274 against bottom feeder roller 204A. In this manner, when the envelope is being scored by ridge 259 within channel groove 264, body portion BP of the envelope E can be held down by feed rollers 203A, 204A, while flap F is bent in an inverted direction to that of original fold of hinge line HL on or about hinge line HL. As mentioned above, the crease roller apparatus 250 can be power driven. For example, either or both shafts 272, 274 on which first roller 252 and second roller 260 reside can be driven by a belt and pulley system rotated by a motor.

Further, as seen in FIGS. 4A and 4B, 5, 6A and 10 first shafts 232 can include one or more envelope guides 280 that also can help prevent the curling of the envelope as it is being scored by crease roller apparatuses 200. Each envelope guide 280 can include a stem 282 and a clamp lock 284. Each clamp lock 284 secures a stem 282 of an envelope guide 280 to first shaft 232. Each clamp lock 284 allows its envelope guide 280 to be secured in a stationary position even while first shaft 232 is permitted to rotate. Each clamp lock 284 permits an envelope guide 280 to change its stationary position depending on the angle at which it is desired for stem 282 to extend. Preferably, each clamp lock 284 hold a stem 282 in a downward position from the first shaft 232 so that the stem 282 extends under a shaft 208 of the second set of feed rollers 206 that feeds the envelope into registration apparatus 240 of variable envelope opener apparatus 400. In this manner, stems 282 of the envelope guides 280 direct the envelope so that the envelope leaving the first set of feed rollers 202 and crease roller apparatus 200 will be easily grabbed by the second set of feed rollers 206 during and after the scoring of the hinge line of the envelope. While passing through crease roller apparatus 200, the envelope tends to bow upward, especially at the flap (see FIG. 8B). The envelope guides 280 redirect the bowed envelope towards the nips between the top and bottom rollers of the second set of rollers 206. Thereby, the envelope is fed through the sets of feed rollers 202, 206 and scored by crease roller apparatus 200 and then feed into registration apparatus 440.

A sensor 290 can be included proximal to feed rollers 202, 206 and crease roller apparatus 200. Sensor 290 can be used to sense the presence of an envelope being transported into variable envelope apparatus 400. The information collected by such a sensor can be sent to controller 600 to aid in the controlling of inserting system IS. Sensor 290 can be a contact sensor, an electromagnetic sensor, an optical sensor, or the like.

Figure 10:
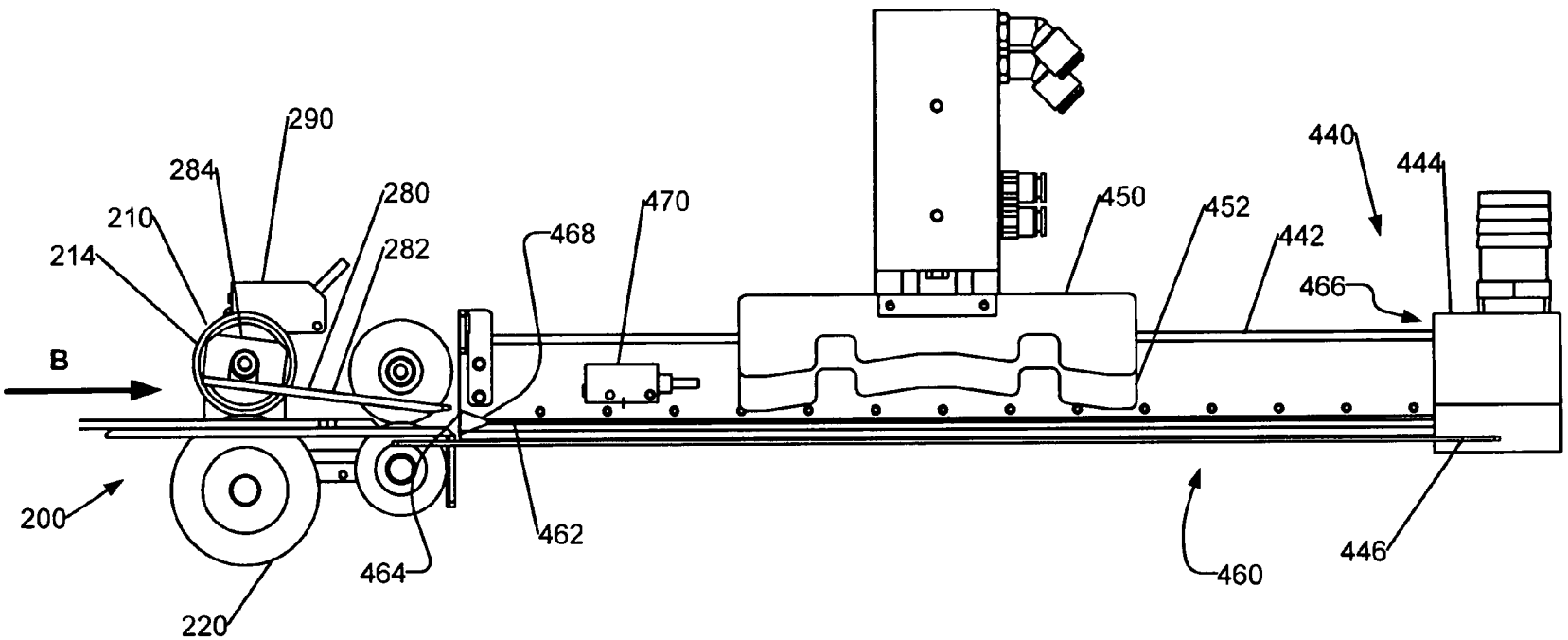
FIG. 10 illustrates a perspective view of the embodiments of crease roller apparatus and registration apparatus of FIG. 3.

After the envelope has been scored by crease roll apparatus 200, the envelope can be fed into registration apparatus 440 for registering within variable envelope opener apparatus 400. As can be seen in FIG. 4A, 4B, and 10, crease roll apparatus 200 and the sets of feed rollers 202, 206 are aligned to feed the envelope along direction A so that the rear end of the envelope resides in registration apparatus 440 and the flap end of the envelope resides on flap plate 446, thereby holding the envelope in a staging position 460. As mentioned above, registration apparatus 440 can include housing 442 and vacuum connection 444. Housing 442 defines a slit 462 along at least a portion of the length of housing 442 for receiving a portion of an envelope being fed into housing 442. Slit 462 can be in a straight line within housing 442. Further, slit 462 can have a convex or a concave shape. Housing 442 can have a first end 464 and a second end, generally designated as 466. Vacuum connection 444 can be attached to housing 442 at second end 466 of housing 442. Those skilled in the art may attach the vacuum source at other locations along the housing 442, instead of using an end cap as shown, without affecting the performance of the registration apparatus.

First end 464 of housing 442 can define an entrance 468 for slit 462 for receiving an envelope fed by the set of feed rollers 206. Vacuum connection 444 can provide a negative pressure from a vacuum source within housing 442 that aligns the envelope within the slit 462. A sensor 470 can detect the presence of an envelope within staging position 460 when the envelope resides in registration apparatus 440 and on top of flap plate 446. Staging position 460 corresponds to the position of the envelope whereby it is suitably oriented within variable envelope opener apparatus 400 in preparation for the insertion of materials and/or other sheet articles therein. Once the envelope is received within staging position 460, first drop bar 450 and second drop bar 452 can be readied to push the envelope out of staging position 460 and into the insertion position within variable envelope opener apparatus 400. The vacuum source can be left on during the extraction of the envelope from the registration device. Alternatively, the vacuum source can be turned off when the drop bar 452 is actuated to extract the envelope and put it into the insertion position.

Figures 11A, 11B, 11C:
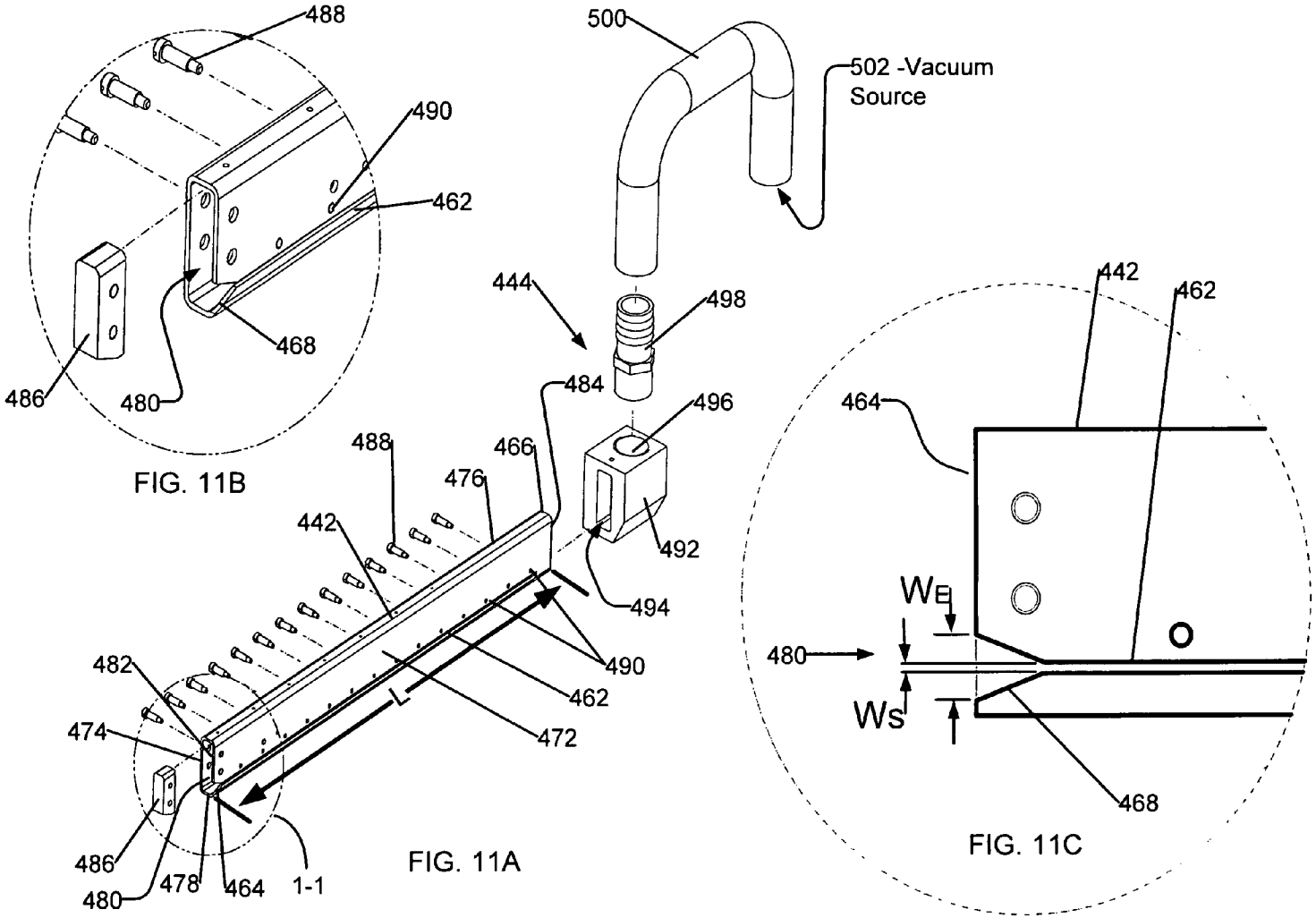
FIG. 11A illustrates an exploded view of an embodiment of the registration apparatus according to FIG. 3.
FIG. 11B illustrates a magnified view of the section 1-1 of FIG. 11A showing a first end of the registration apparatus.
FIG. 11C illustrates a side view of the first end of the registration apparatus shown in FIG. 11A.

As can be seen in the exploded view of FIG. 11A, housing 442 can be a tubing having a front wall 472, a back wall 474, a top wall 476 and a bottom wall 478. The front, back, top and bottom walls 472, 474, 476, 478 can define a chamber, generally designated as 480, that can run length L of housing 442. Housing 442 also can define an opening 482 on first end 464 and an opening 484 on second end 466, both of which are in communication with chamber 480. Slit 462 can reside in front wall 472 to provide access to chamber 480.

Figure 11D:
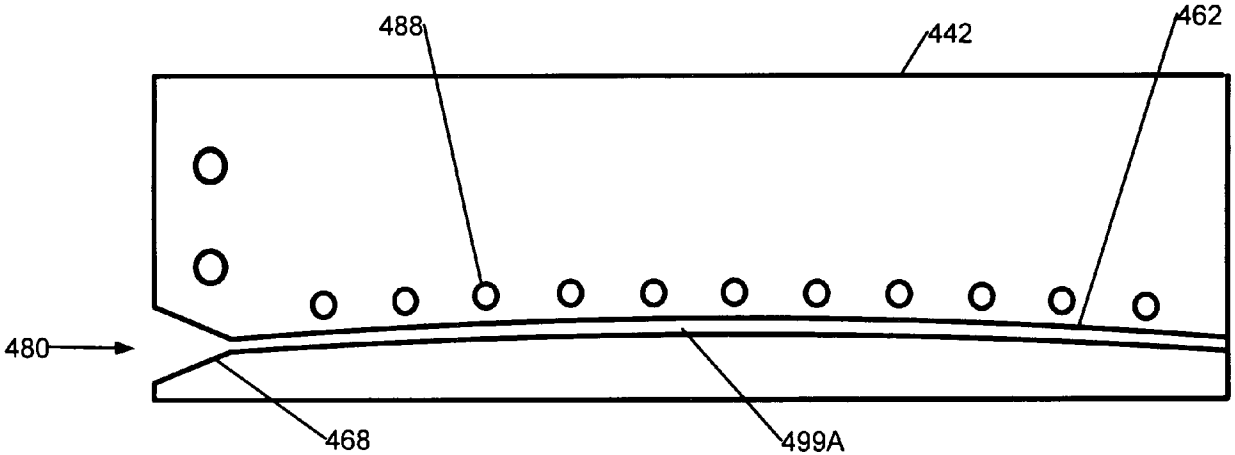
FIG. 11D illustrates a side view of another embodiment of a registration apparatus according to the present subject matter.
Figure 11E:
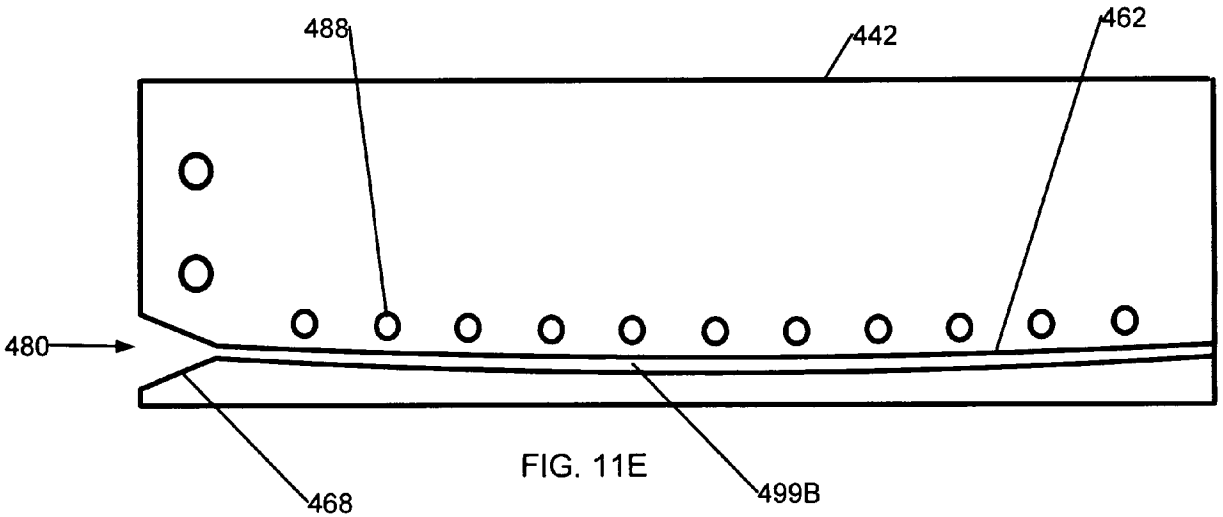
FIG. 11E illustrates a side view of a further embodiment of a registration apparatus according to the present subject matter.

Chamber 480 can extend the full length L of housing 442 or it can extend for a partial distance within length L. Similarly, the slit 462 can extend the full length L of housing 442 or it can extend only a partial distance along the length L. Slit 462 can also extend only along a portion of the length of chamber 480. As previously mentioned, housing 442 can define a convex slit 499A or a concave slit 499B as shown in FIGS. 11D and 11E respectively. By using these alternative shaped slits 499A and 499B, the beam strength of the envelope in the staging area 460 can be increased, if required.

As in the embodiment shown in FIGS. 11A and 11B, a sealing block 486 can be secured within opening 482 of first end 464 of housing 444. Sealing block 486 can help direct the pull of the negative pressure created through vacuum connection 444 and also help direct the envelope into slit 462 and chamber 480.

One or more holding pins 488 can be inserted above slit 462 through at least one of front wall 472 or back wall 474. Holding pins 488 can help to prevent the envelope from sliding up chamber 480 when a vacuum is applied within housing 442. Holding pins 488 can be screws, shoulder bolts, pins, or the like. Holding pins 488 can be inserted through apertures 490 defined either in front wall 472, back wall 474, or both. A plurality of holding pins 480 can ensure that the envelope within registration apparatus 440 is properly registered before the envelope is removed from the staging position into the insertion position for insertion of the insert material into the envelope.

As can be seen in FIG. 11C, housing 442 can define entrance 468 such that entrance 468 is wider than slit 462. The entrance can be chamfered so as to converge from its wider width $W_E$ to slot width $W_S$. Width $W_E$ at the beginning of entrance 468 provides a greater opportunity for envelopes being fed into registration apparatus 440 to correctly enter slit 462 thereby reducing the possibility of jams within the inserting station 300. By having entrance 468 converge toward slit 462, an errant envelope is more likely to be caught and directed into slit 462. Further, as shown in FIG. 11B, sealing block 486 can have a bottom wall which is cut at an angle to match the chamfer of entrance 468 leading into slit 462.

Vacuum connection 444 of registration apparatus 440 can take on many different forms. The only requirement of vacuum connection 444 is that it provides enough negative pressure within housing 442 to properly align, or register, the envelopes that enter housing 442. An example of an embodiment of the vacuum connection is shown in the figures. Vacuum connection 444 of registration apparatus 440 can include a housing fitting 492 having a housing opening 494 disposed therein to engage housing 442 about second end 466. Housing opening 494 within housing fitting 492 can securely fit around second end 466 of housing 442 such that, when a negative pressure is pulled through housing fitting 492, it is also pulled through chamber 480 of housing 442. Housing fitting 492 can further include a connector opening 496 which is in communication with housing opening 494.

Vacuum connection 444 can further include a connector fitting 498, which can be received in connector opening 496 of housing fitting 492. Vacuum connection 444 can further include a vacuum tube 500, which can be secured to a vacuum source 502 that provides the negative pressure to housing 442. Vacuum tube 500 can be securely fitted to connector fitting 498 and also to vacuum source 502. Vacuum source 502 can be any structure that can create a negative pressure within a range that will properly align the envelope within registration apparatus 440. For example, vacuum source 502 can be a Gast blower, Model R 3105-1, manufactured by Gast Manufacturing, Inc., of Bent Harbor, Mich. Such a blower can create a negative pressure of up to about 0.5 pounds per square inch for use within registration apparatus 440. However, a lesser or greater negative pressure may be used to register envelopes or other sheet articles.

Figure 12B:
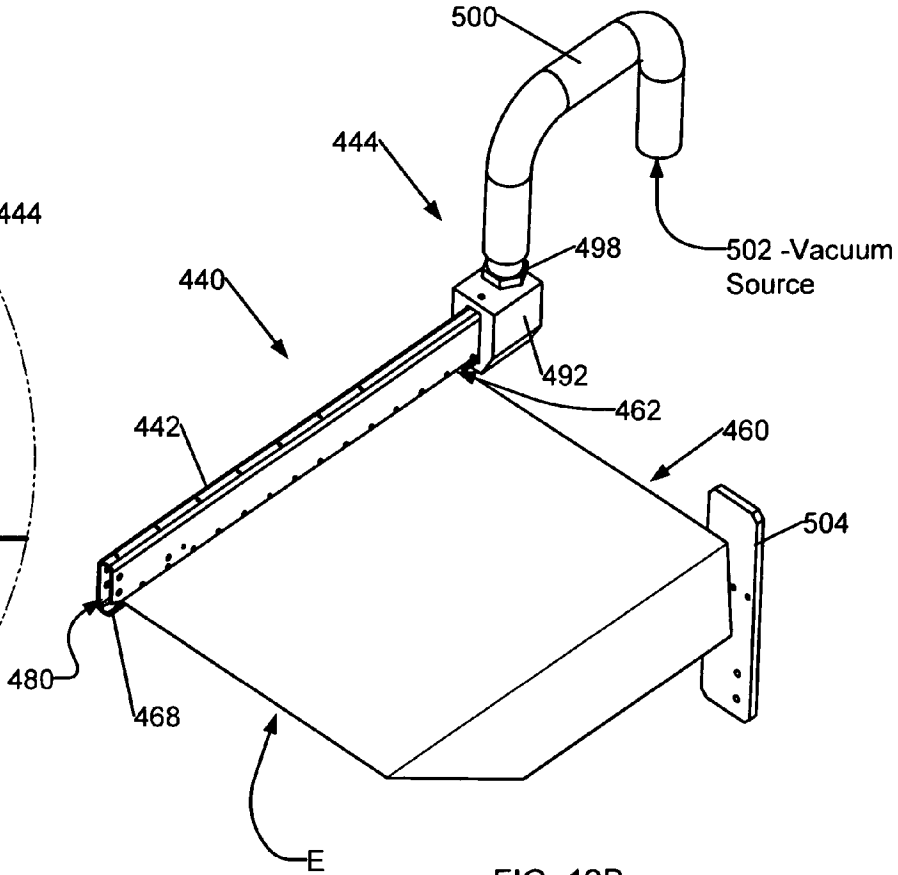
FIG. 12B illustrates a perspective view of the registration apparatus of FIG. 3.
Figure 12A:
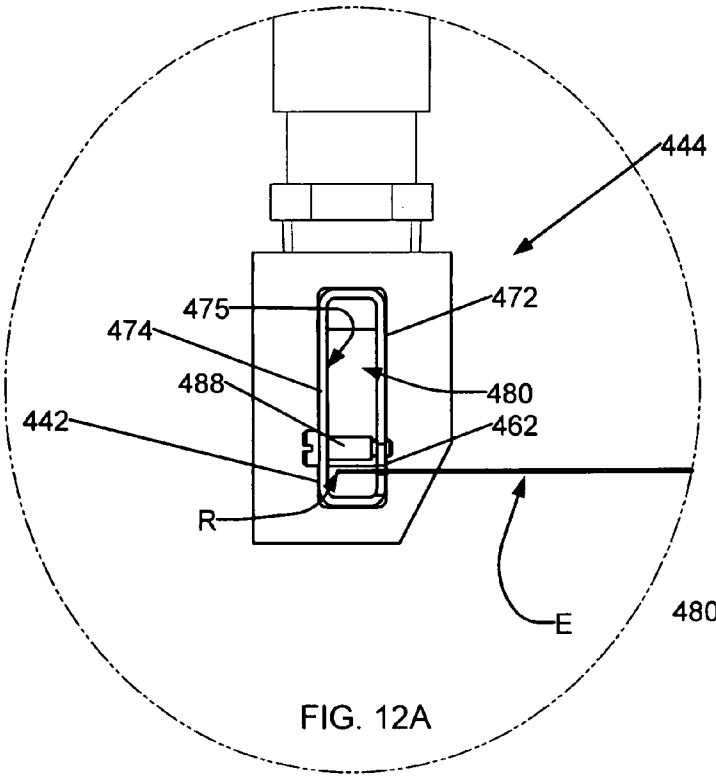
FIG. 12A illustrates a cross-sectional side view of the registration apparatus of FIG. 3.

FIGS. 12A and 12B show an envelope E with its rear end R disposed within housing 442 of registration apparatus 440. Registration apparatus 440 can further include a stopper 504 that stops the progress of envelope E as it enters slit 462 of housing 442. As envelope E enters slot 462, vacuum connection 444 can apply negative pressure within housing 442 to align envelope E within staging position 460 before it is to be moved into an insertion position for receipt of insert material. Vacuum source 502 can supply a constant negative pressure within housing 442. As pointed out above, the pressure should be great enough to properly align envelope E within registration apparatus 440 but not so great as to interfere with the removal of envelope E from staging position 460 into an insertion position. Rear end R of envelope E enters entrance 468 of housing 442 and into slit 462. Entrance 468 and slit 462 guide rear end R of envelope E under holding pins 488 that pass through back wall 474 and front wall 472 above slit 462 into hollow chamber 480. The negative pressure provided by vacuum source 502 through vacuum tube 500, connector fitting 498 and housing fitting 492 can pull rear end R of envelope E against an interior 475 of the back wall 474 to align envelope E so that the mouth of envelope E is in a position to be opened for receipt of the insert material when envelope E is moved to the insertion position. Stopper 504 can also facilitate proper alignment of envelope E in staging position 460 before being moved to the insertion position for receipt of insert material.

Vacuum connection 444 can include just a vacuum tube connected to the housing 442 and a vacuum source 502 or it can take on other forms. Further, the opening within the housing around which the vacuum connection is secured can be at other locations provided that the opening can provide the negative pressure into the chamber of the housing for registration of the envelope. The chamber can also be any desired shape that facilitates registration of envelope within the housing. For example, the chamber can be just a rear portion of slit 462.

Figure 12C:
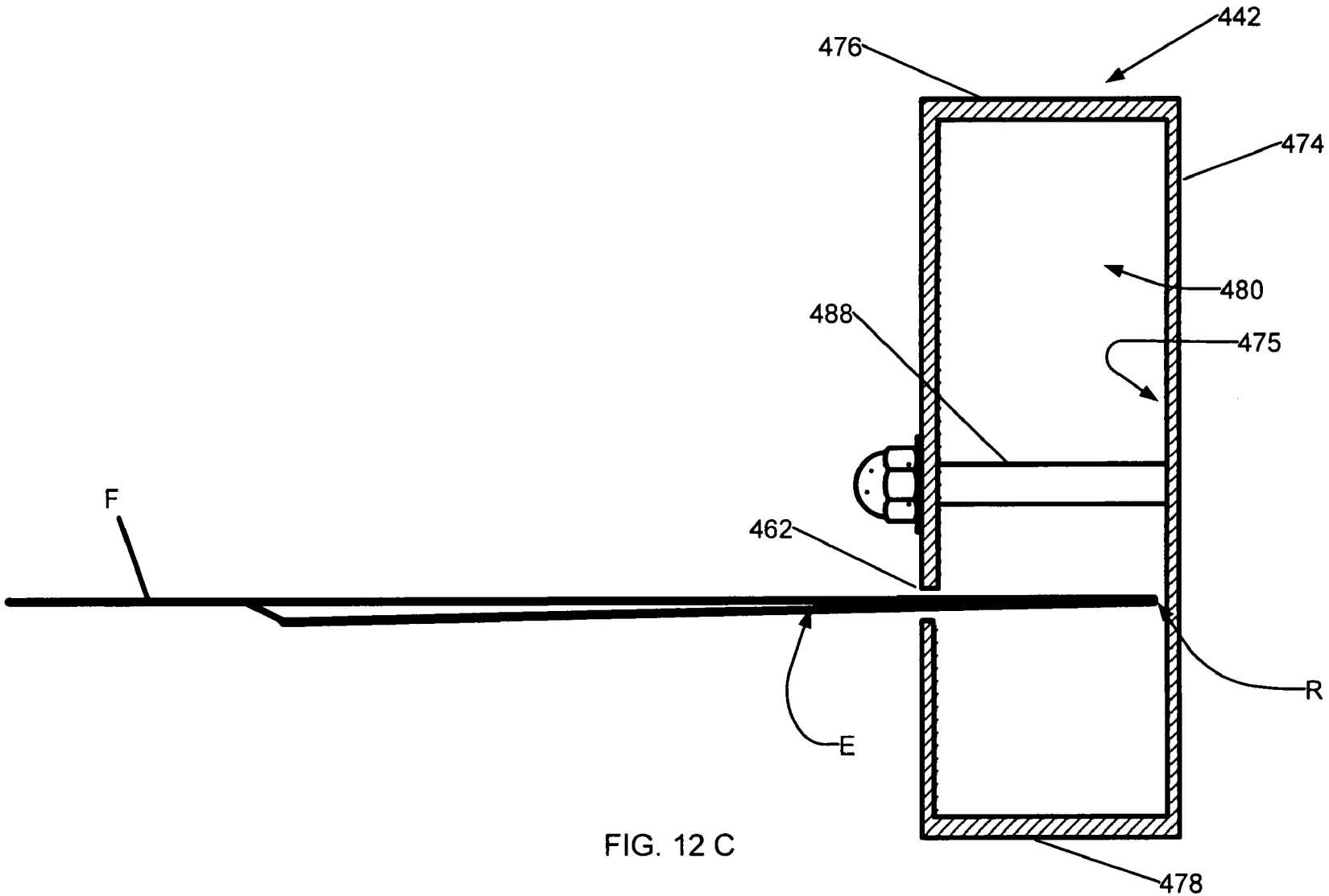
FIG. 12C illustrates a schematic cross-sectional view of an embodiment of a housing of a registration apparatus according to the present subject matter.

FIG. 12C shows an enlarged view of a hollow chamber 480 within a housing 442. An envelope E resides in slit 462 with a rear end R of envelope (opposite flap F of envelope E) registered against the interior 475 of back wall 474 of housing 442. The spacing between the holding pins 488 and the envelope may be adjustable to prevent the rear end from curling upward inside the chamber.

Figure 13:
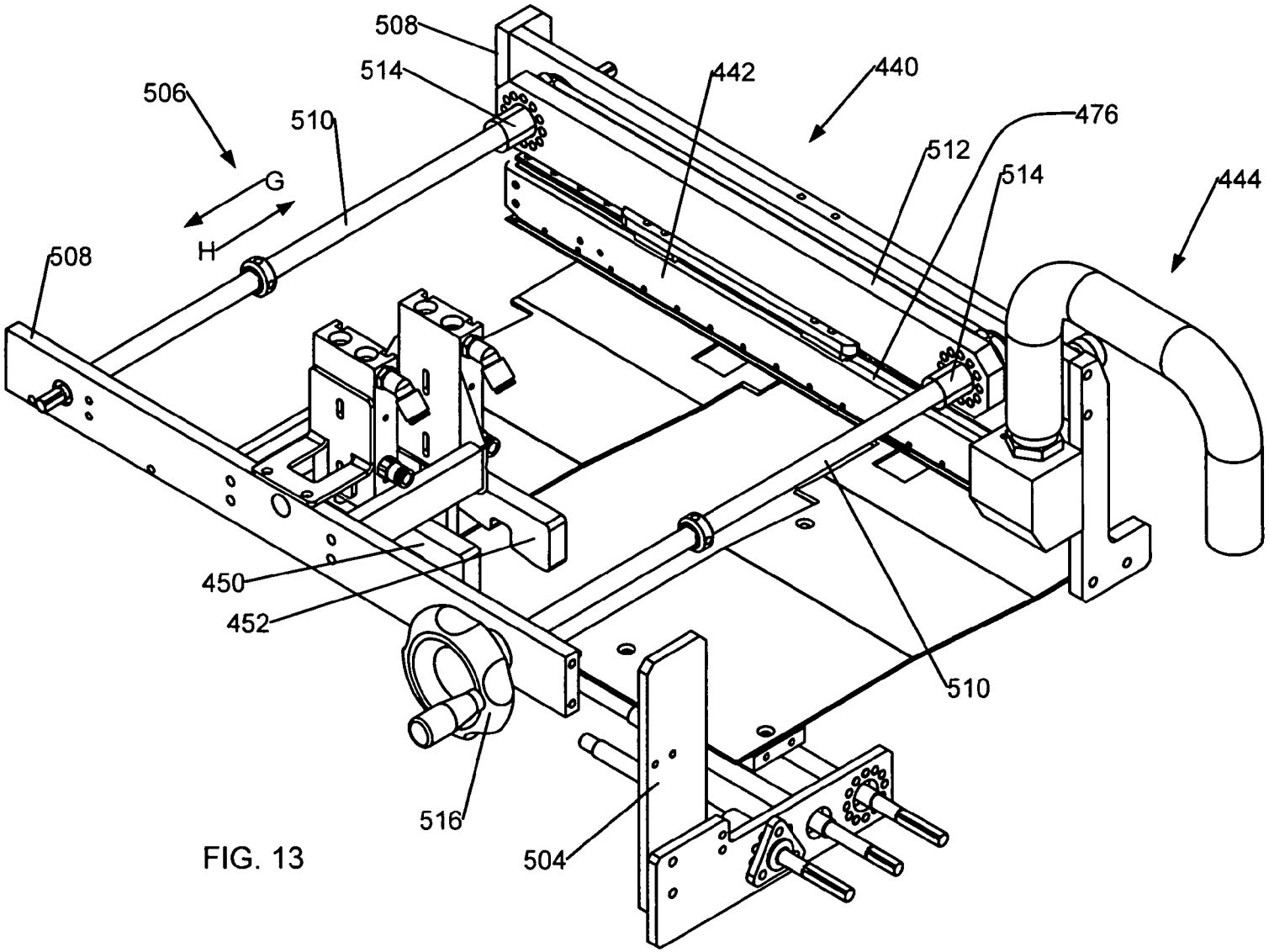
FIG. 13 illustrates a further perspective view of the registration apparatus of FIG. 3.
Figure 14:
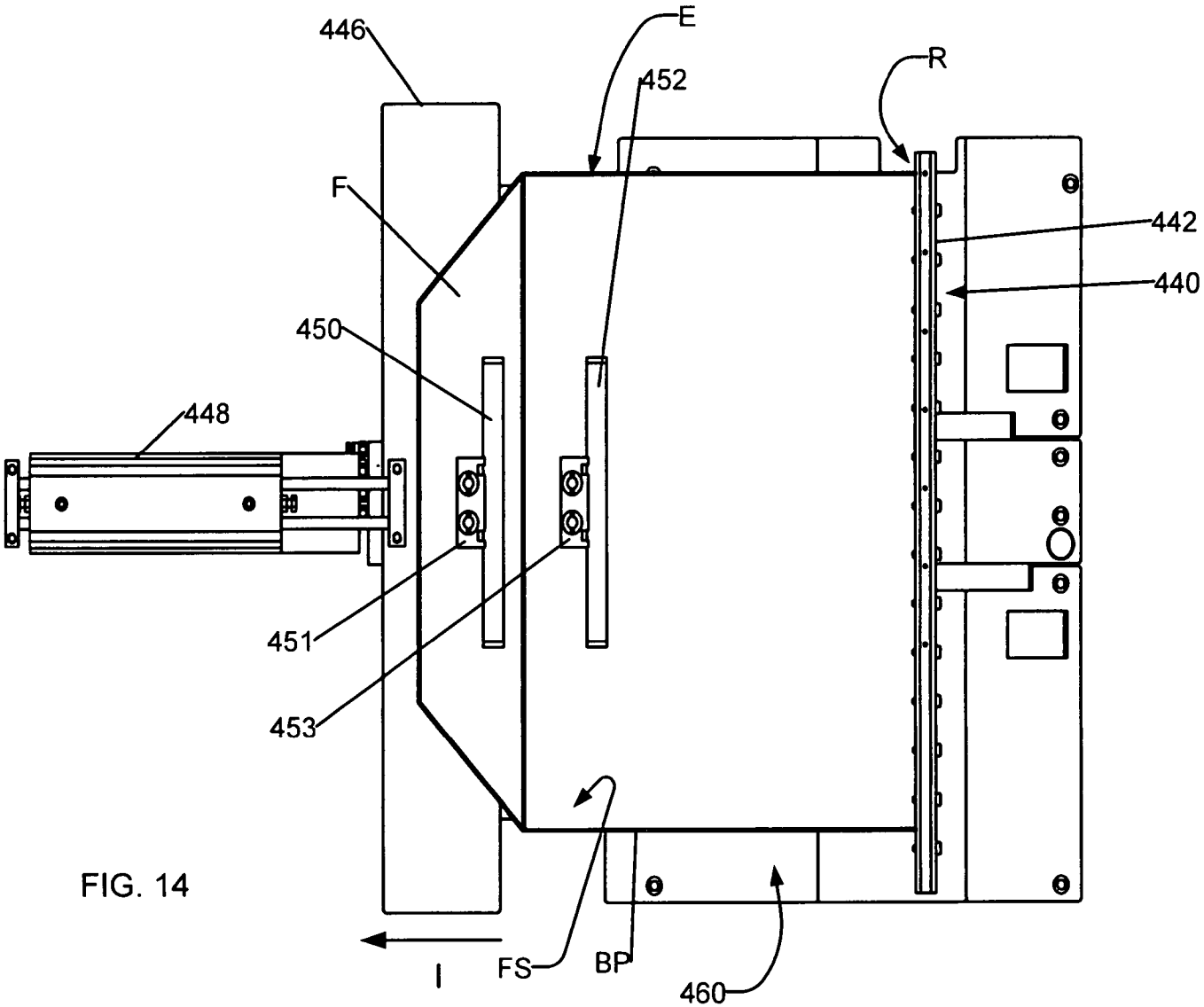
FIG. 14 illustrates a top plan view of the embodiment of the variable envelope opener of FIG. 3.

FIG. 13 shows registration apparatus 440 as it forms a portion of variable envelope opener apparatus 400 (see FIG. 3). Registration apparatus 440 can further include a depth adjuster 506. Depth adjuster 506 can move registration apparatus 440 relative to other portions of variable envelope opener 400 to permit different-sized envelopes to be processed within inserting station 300 (see FIG. 2). Depth adjuster 506 can include a frame 508 through which a pair of lead screws 510 can reside. A holding bar 512 can be secured to top wall 476 of housing 442. Holding bar 512 can further reside on lead screws 510, which can be aligned parallel to one another. Holding bar 512 can include a pair of actuating mechanisms 514 with each actuating mechanism 514 engaging one of the lead screws 510 to permit movement of holding bar 512 along lead screws 510. An adjustment wheel 516 can be secured to depth adjuster 506 such that, when adjuster wheel 516 is turned, holding bar 512 through the actuating mechanisms 514 will move in a direction G along screws 510 when adjuster wheel 516 is turned one way and will move in a direction H when adjustment wheel 516 is turned in the other direction. As holding bar 512 moves along lead screws 510, registration apparatus 440 including housing 442 and at least a portion of vacuum connection 444 move along with holding bar 512, while keeping a proper orientation with respect to the flap plate (not shown) and first drop bar 450 and second drop bar 452. In this manner, different-sized envelopes can be processed by moving registration apparatus 440 back and forth within variable envelope opener apparatus 400.

For example, as shown in FIG. 13, registration apparatus 440 can be moved to a back position for acceptance of a flats envelope. If a smaller envelope is used, the adjustment wheel 516 can be turned so as to bring the registration apparatus 440 closer to the flat plate (not shown) and first and second drop bars 450, 452. Similarly, the stopper 504 can be fixed within variable envelope opener apparatus 400 at a position where any envelope processed no matter what the size will come in contact with stopper 504.

Once an envelope E is registered within housing 442 of registration apparatus 440, envelope E can reside in staging position 460 as shown in FIG. 10. Envelope E can enter staging position 460 with the face side FS of the body portion BP facing upward away from the inserting station 300. As discussed above, envelope E is held in staging position 460 by registration housing 442 and flap plate 446. Registration housing 442, which has registered the envelope, holds rear end R of envelope E, while flap F of envelope E resides on flap plate 446. When it is time for the envelope to enter the insertion position, flap plate 446 can be moved in a direction I by actuator 448. First drop bar 450 and second drop bar 452 can be then activated by actuators 451 and 453, respectively, to push envelope E out of staging position 460 into the insertion position.

Figure 15A:
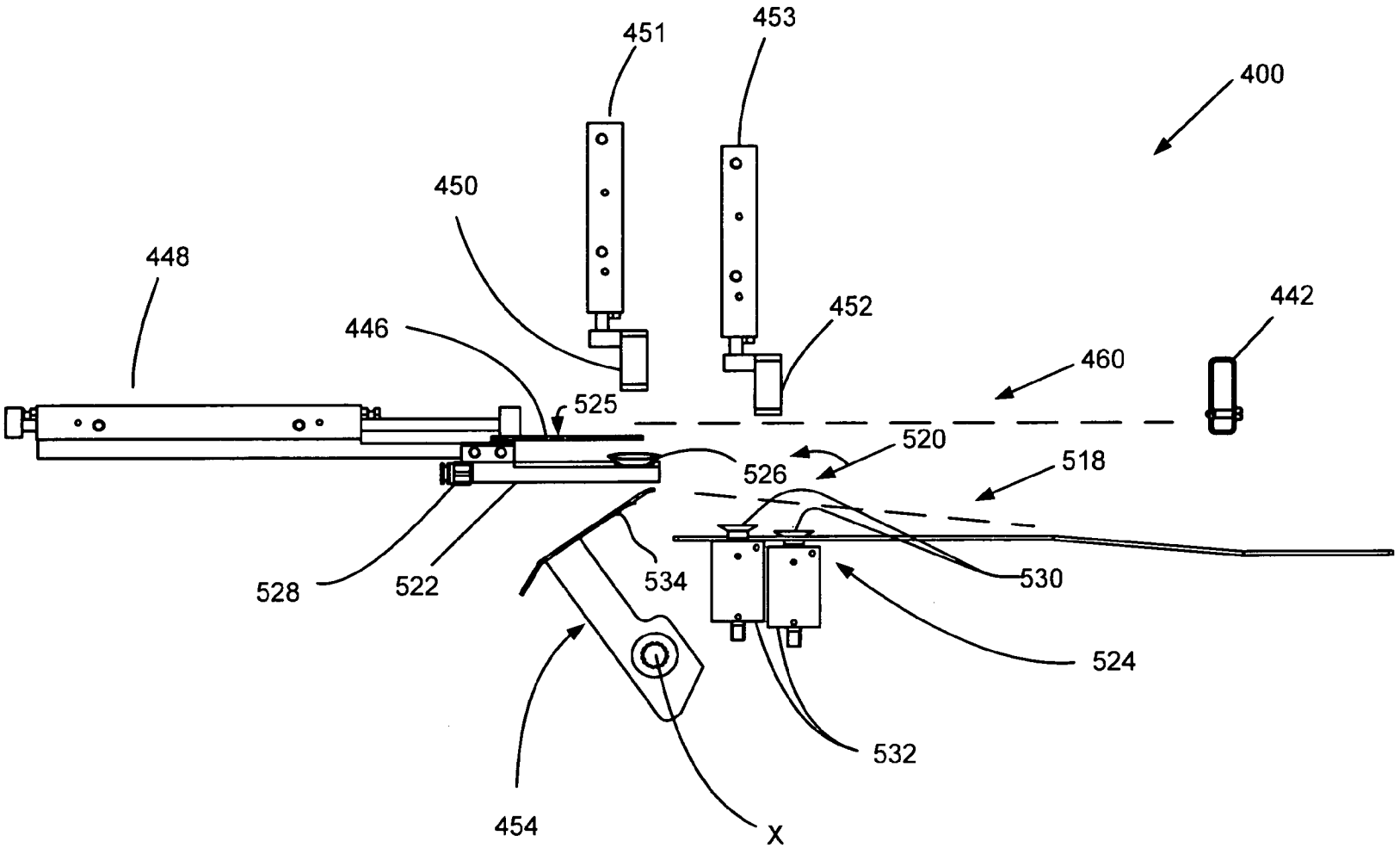
FIGS. 15A and 15B illustrate schematic side views of a portion of the variable envelope opener apparatus according to FIG. 3.
Figure 15B:
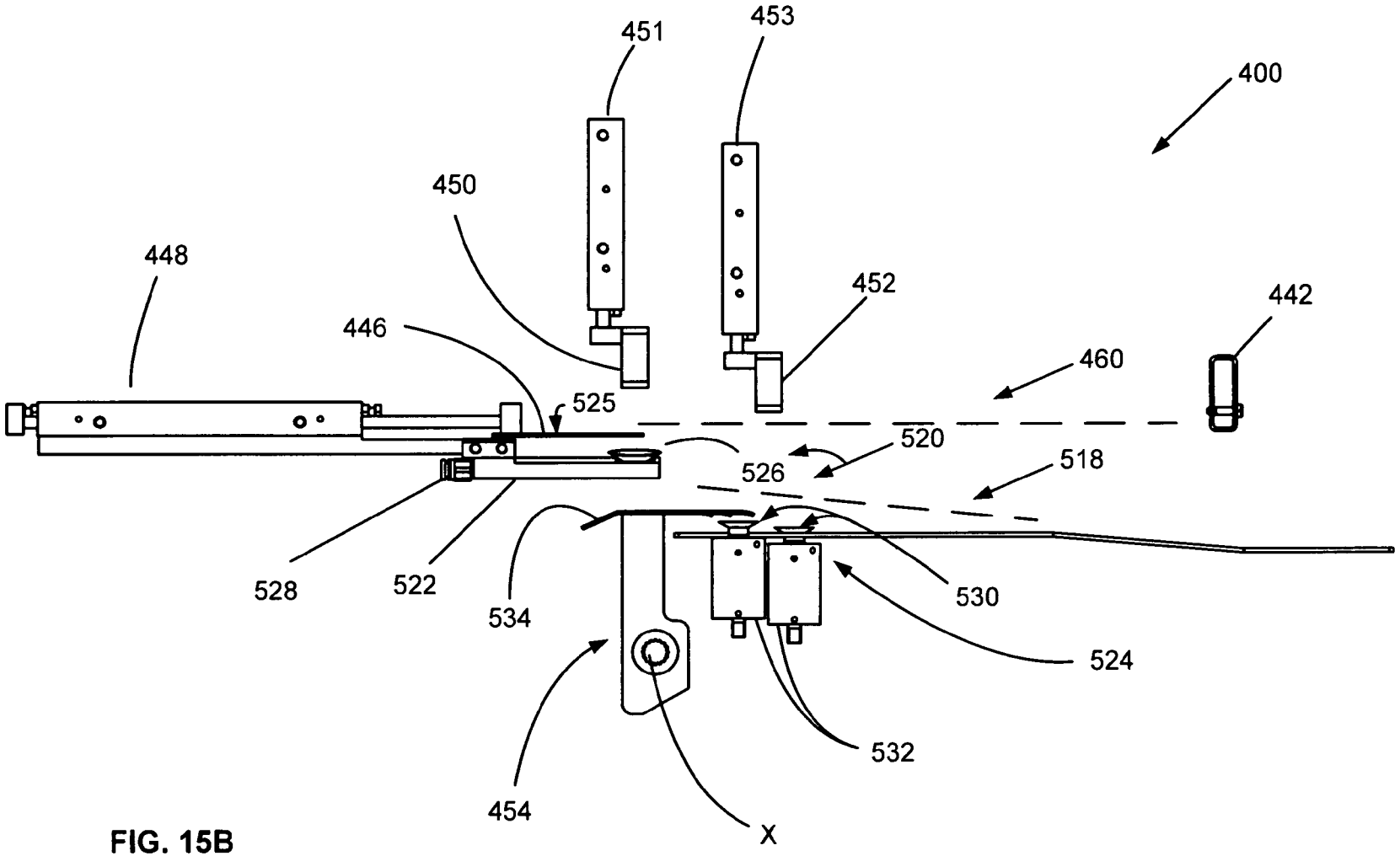

FIGS. 15A and 15B illustrate schematics of a partial cross-sectional view of a portion of variable envelope opener apparatus 400. Staging position 460 as stated above can be created by holding envelopes between housing 442 of registration apparatus 440 (see FIGS. 4A and 4B) and flap plate 446. Envelopes can then be pushed by first and second drop bars 450, 452 into an insertion position, generally designated as 518, were a holding system generally designated as 520, facilitate the securing of the envelopes in insertion position 518 for receipt of insert material. Holding system 520 can include a first holding device 522 for holding the flaps of the envelopes. Further, a second holding device 524 can be used in the holding system 520 to temporarily hold the body portion on the backside of the envelopes to facilitate insertion of feeding guide 454 into the mouth of the envelope as will be explained in more detail below.

As shown in FIG. 15A, flap plate 446 can be held in a holding location 525 where flap plate 446 resides directly above first holding device 522 of holding system 520. When flap plate 446 is in holding location 525, staging position 460 is created for an envelope registered within housing 442 of registration apparatus 440 (see FIG. 4A). Beneath staging position 460, insertion position 518 is located for holding an envelope open for receiving insert material therein within the inserting station. Once the envelopes enter insertion position 518, first holding device 520 can be used to hold the flap of the envelope during the insertion process of the insert materials into the envelope. First holding device 522 can include one or more suction cups 526 in communication with a vacuum connection 528 to provide a negative pressure, or suction, through suction cups 526. Vacuum connection 528 can selectively provide the negative pressure to suction cups 526 to hold the flap of an envelope being processed each time when flap plate 446 is moved from holding location 525 to an entry location (not shown) and first drop bar 450 contacts the flap of the envelope to push it in contact with suction cups 526 through the action of the actuator 451 of first drop bar 450. First holding device 520 can hold the envelope until the material is inserted into the envelope and the envelope is to be taken downstream for further processing.

Second holding device 524 can include one or more suction cups 530 used to hold down the body portion of the envelope on the back side such that first holding device 522 and second holding device 524 hold the mouth of the envelope open in a wide stance. The one or more suction cups 530 can be secured to one or more vacuum connections 532 to selectively provide vacuum suction to the body portion of the envelope for a set period. Feeding guide 454, partially shown in FIGS. 5A and 5B, can include fingers 534 which can be inserted into the mouth of an envelope held open by first holding device 522 and second holding device 524. As discussed in more detail below, feeding guide 454 can be moved from a retracted position to an engaged position. This movement of feeding guide 454 can be rotational or linear movement. As shown in FIGS. 5A and 5B, feeding guide 454 can rotate about axis X to move between the engaged position and the retracted position. As shown in FIG. 5A, feeding guide 454 is positioned in a retracted position. As shown in FIG. 5B, feeding guide 454 with its fingers 534 is positioned in the engaged position. At such point and time when feeding guide 454 assumes the engaged position and the fingers 534 are within an envelope mouth, suction cups 530 can release the body portion of the envelope such that the first holding device 520 and the feeding guide 454 hold the envelope open for insertion of insert material.

Figure 16:
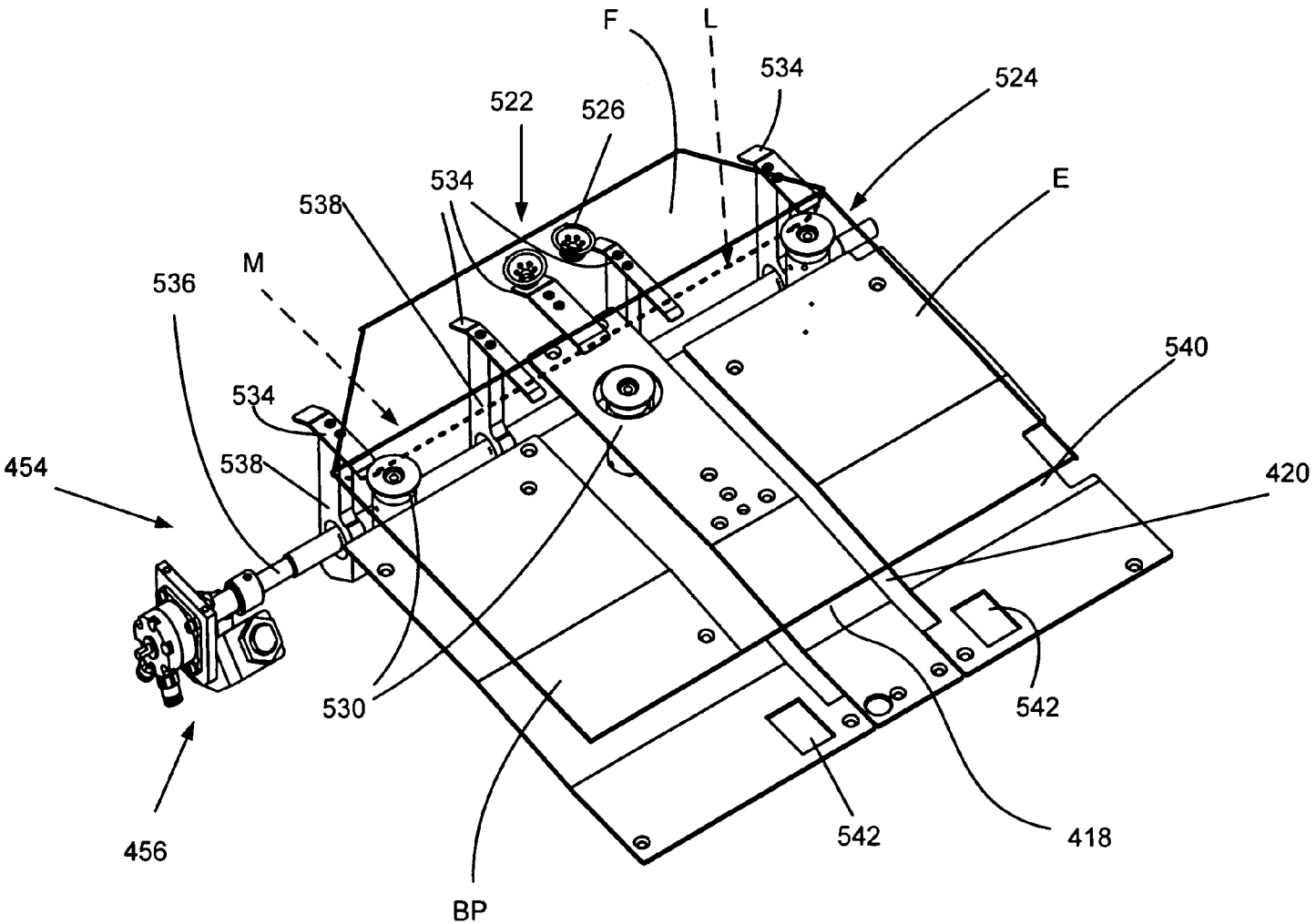
FIG. 16 illustrates a perspective view of a portion of the variable envelope opener apparatus according to FIG. 3.
Figure 17:
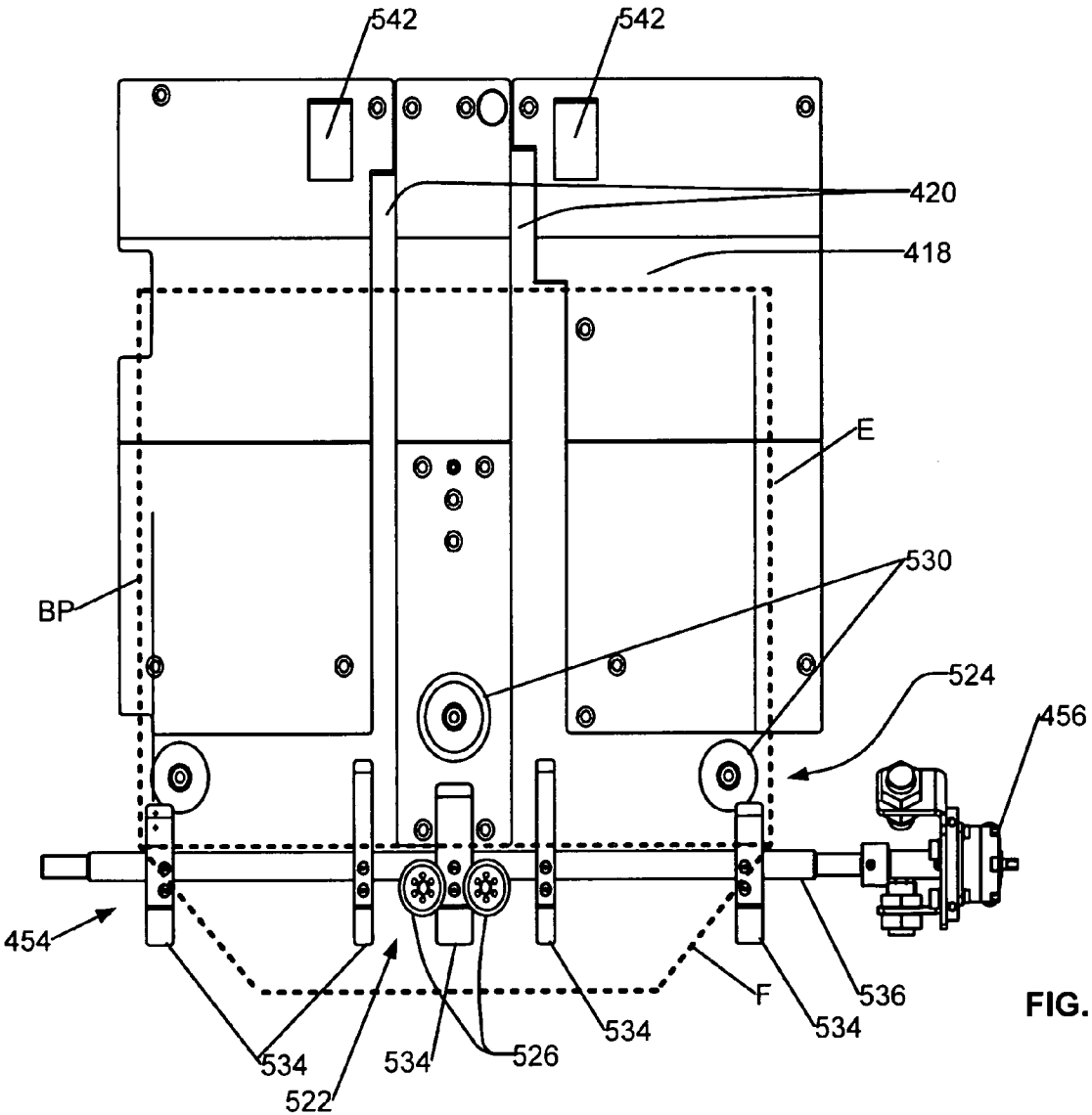
FIG. 17 illustrates a top plan view of the portion of the variable envelope opener apparatus according to FIG. 16.

As can be seen in FIGS. 16 and 17, the suction cups of 526 of the first holding device 522 and the suction cups 530 of the second holding device 524 can hold an envelope E, shown in phantom, in conveying path 418. While first holding device 522 and second holding device 524 are holding envelope E, feeding guide 454 can insert fingers 534 into mouth M of envelope E. Feeding guide 454 can include a rotary actuator 456, secured to a positioning rod 536 on which extending arms 538 that support fingers 534 can be attached. Rotary actuator 456 can rotate positioning bar 536 to move extending arms 538 and fingers 534 from a retracted position to an engaged position. Once fingers 534 are inserted into mouth M of envelope E, suction cups 530 of second holding device 524 can release body portion BP of envelope E so that lip L of envelope E resides against and beneath fingers 534. At this point, insert material can be pushed along conveying path 418 by the insertion pusher members over fingers 534 and into mouth M of envelope E. The insertion pusher members can travel down along the elongated slot 420 that extends from the deck 410 (see FIG. 3) into insertion deck 540. The insertion deck 540 can further define apertures 542 therein to allow transport rollers to catch the envelope and transport it further down stream into left-angle-turn apparatus 310 shown in FIG. 2.

Figure 18:
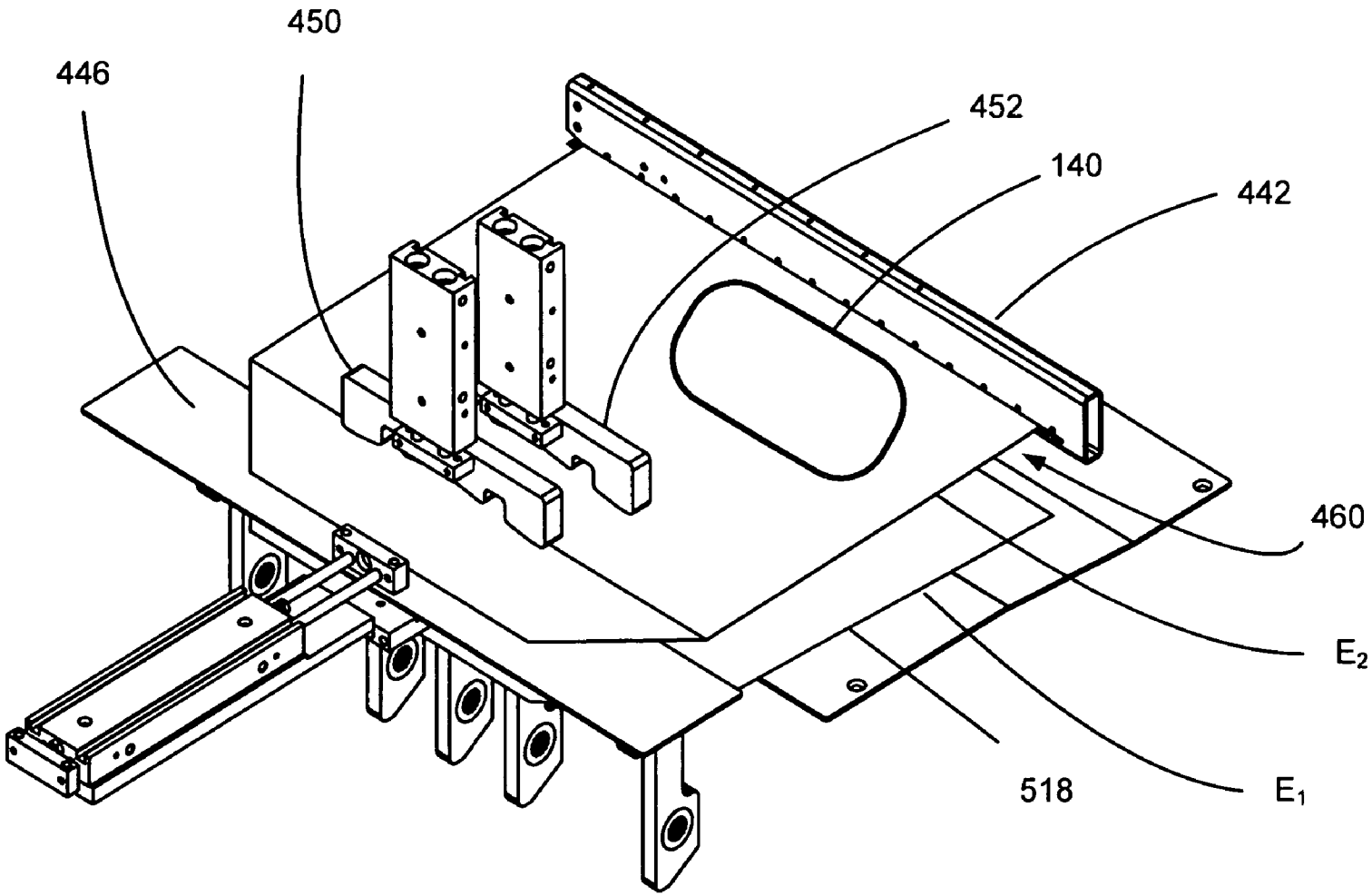
FIG. 18 illustrates a perspective view of the portion of the variable envelope opener apparatus according to FIG. 16.

During a time that the envelope is in a first envelope holding location, which can be insertion position 518, another envelope can be fed a second envelope holding location that can be staging position 460 proximate to and above the envelope in insertion position 518 as illustrated in FIG. 18. The first envelope holding location provides the insertion position 518 for opening the envelope for insertion of the one or more sheet articles. Once a first envelope $E_1$ enters insertion position 518, a second envelope $E_2$ can be fed into the second envelope holding location and registered within housing 442 of the registration apparatus 440 while envelope $E_1$ receives insert material. The second envelope holding location receives a second envelope for insertion of sheet articles into the second envelope by providing a staging position 460 for orienting and registering the second envelope. The second envelope holding location provides flap orientation for the first envelope by, for example, the crease roller apparatus and the flap plate. In this manner, the next envelope to receive insert material is positioned and ready, thereby reducing the amount to time to prepare the envelope for receipt of insert material. While first envelope $E_1$ is being processed, housing 442 and flat plate 446 hold second envelope $E_2$ registered and ready to be pushed by first drop bar 450 and second drop bar 452 into insertion position 518. Once first envelope $E_1$ has received insert material and is being moved downstream for further processing, second envelope $E_2$ can be pushed into insertion position 518.

Figure 19:
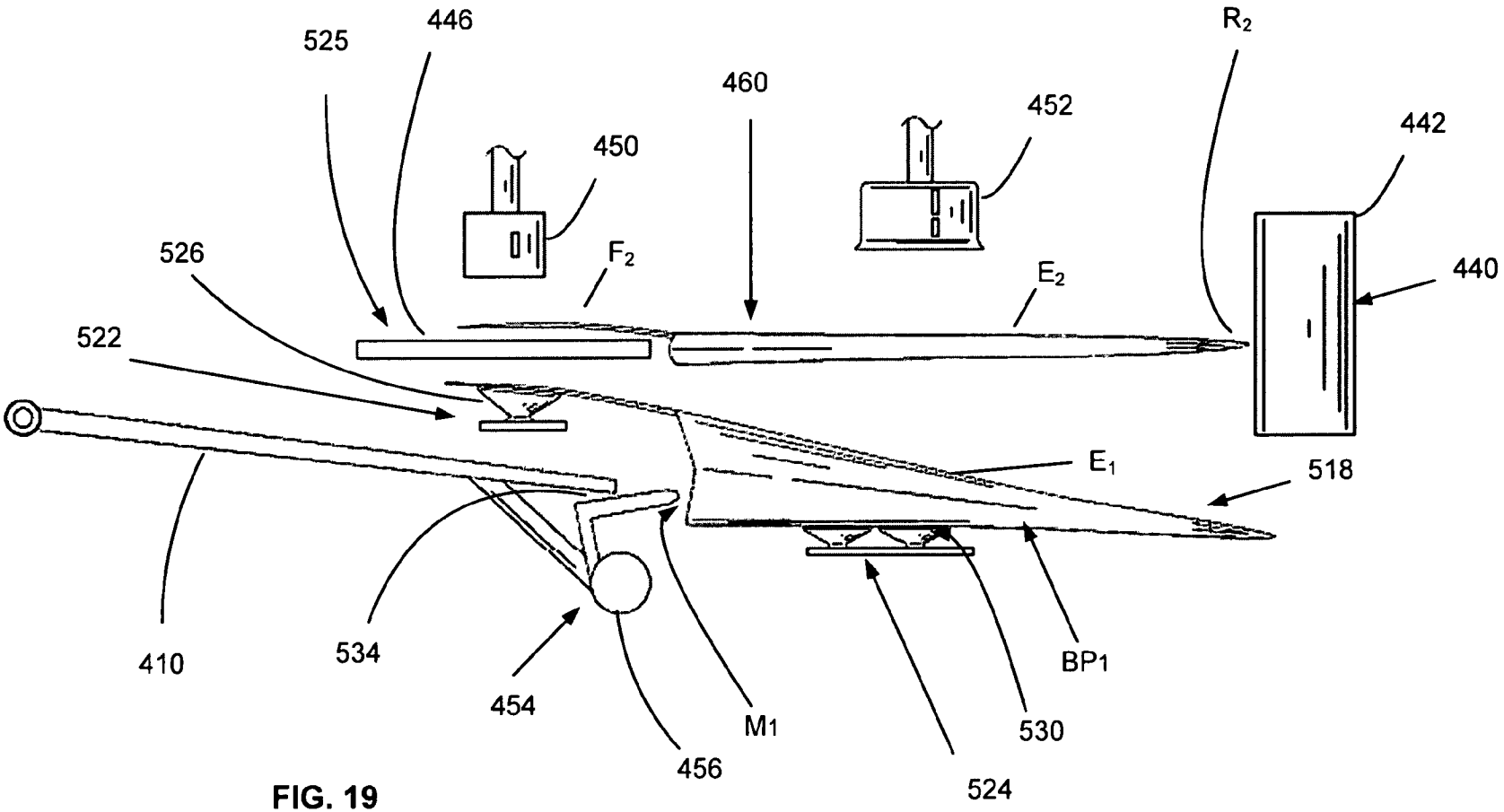
FIG. 19 illustrates a schematic side view of a variable envelope opener apparatus with envelopes being processed according to the present subject matter.
Figure 20:
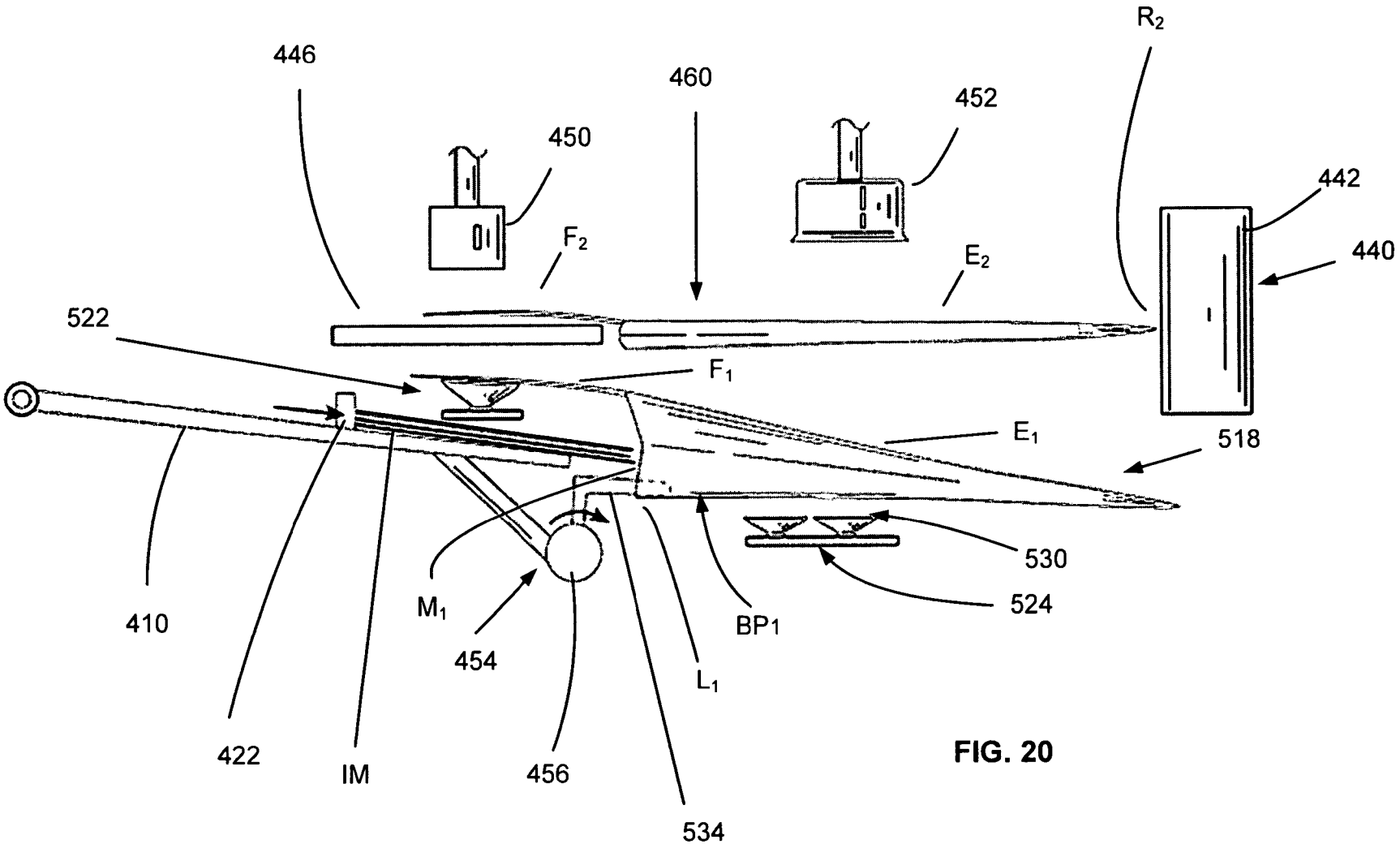
FIG. 20 illustrates a schematic side view of a variable envelope opener apparatus with envelopes being processed according to the present subject matter.
Figure 21:
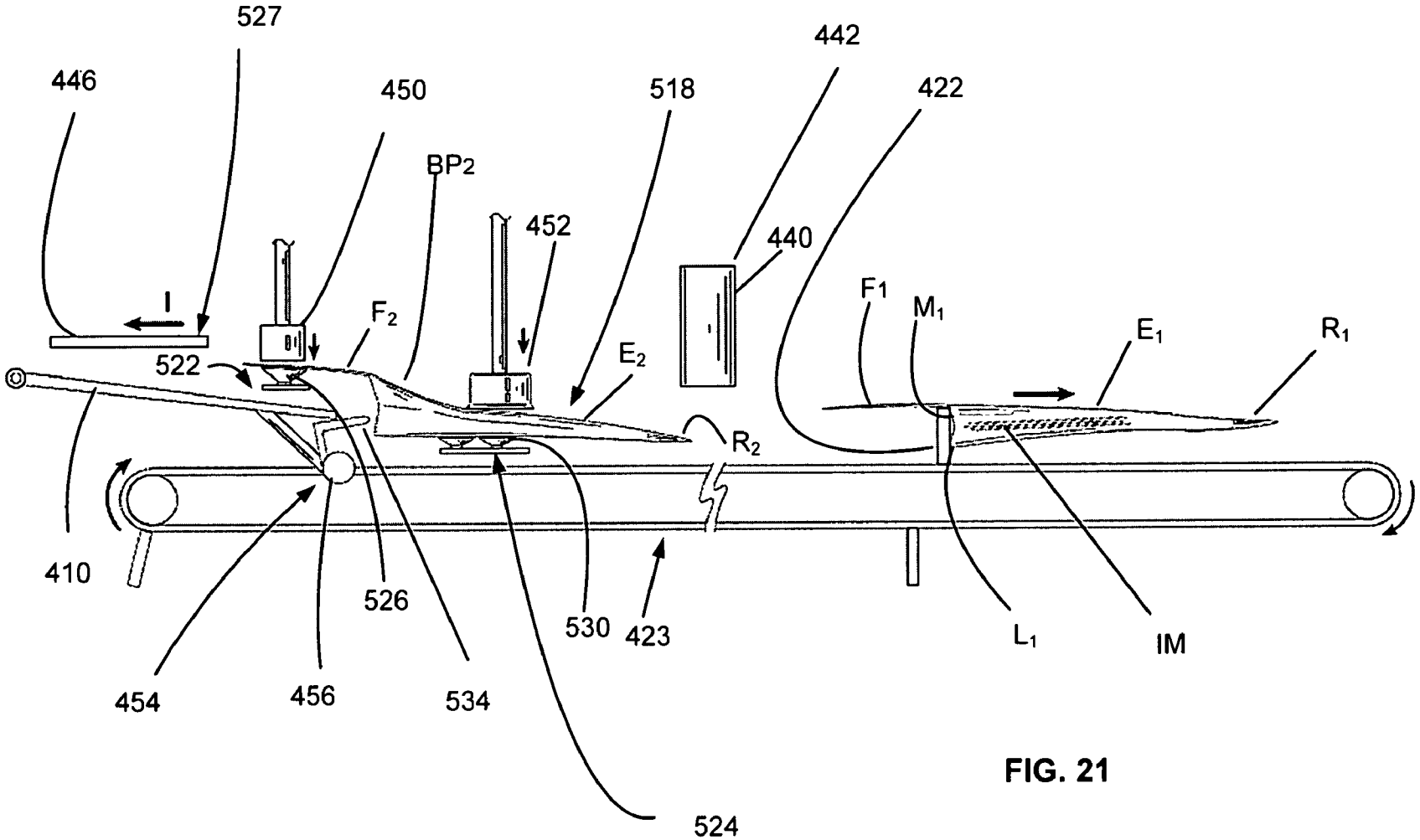
FIG. 21 illustrates a schematic side view of a variable envelope opener apparatus with envelopes being processed according to the present subject matter.

FIGS. 19-21 illustrate a schematic view of the processing of envelopes for insertion within variable envelope opener apparatus 400. Once envelope $E_1$ has entered insertion position 518, first holding device 522 holds flap $F_1$ with one or more suction cups 526 and second holding device 524 holds the back side of body portion $BP_1$ with suction cups 530 so that a mouth $M_1$ of envelope $E_1$ is held open in a wide stance for insertion of fingers 534 of a feeding guide 454. A second envelope $E_2$ is then fed into registration apparatus 440 such that a rear end $R_2$ resides in housing 442 of registration apparatus 440, while a flap $F_2$ of an envelope $E_2$ resides on a flat plate 446 in staging position 460.

As shown in FIG. 20, rotary actuator 456 of feeding guide 454 rotates fingers 534 into mouth $M_1$ of envelope $E_1$, and suction cups 530 of second holding device 524 release the back side of body portion $BP_1$, while first holding device 522 still retains flap $F_1$, of envelope $E_1$. Once fingers 534 are rotated into mouth $M_1$ of envelope $E_1$ and the second holding device releases body portion $BP_1$, lip $L_1$ a resides underneath and against fingers 534 of feeding guide 454. In this manner, mouth $M_1$ of envelope $E_1$ is held open in a wide enough stance to allow insertion pusher members 422 to push insert material IM into the mouth $M_1$ of envelope $E_1$ as the insertion material travels over deck 410 and fingers 534 into envelope $E_1$.

The distance that first holding device 522 and fingers 534 hold mouth $M_1$ of envelope $E_1$ open allows insertion of the material and, at the same time, prevents a contraction of the sides of envelope $E_1$ that might interfere with such an insertion. This distance at which the mouths of envelopes can be held open can be changed by variable envelope opener apparatus by rotating deck 410 and feeding guide 454 to which it is attached between different locations. As will be described in greater detail below, depending on the characteristics of the insert material (e.g., the amount of material to be inserted, the corresponding collective thickness of the material to be inserted, etc.), deck 410 and feeding guide 454 can be moved between different locations, thereby changing the distance the mouth of the envelope is held open.

As shown in FIG. 21, insertion push members 422 can catch envelope $E_1$ at lip $L_1$ and underneath flap $F_1$, and push envelope $E_1$ to a point where rollers grab a rear end $R_1$ and transport envelope $E_1$ downstream for furthering processing. The pairs of insertion push members 422 are secured to a conveyor system, generally designated as 423, that rotates the pairs of insertion pusher members 423. The timing of the feeding of the envelopes and the speed of the different conveyor systems, like conveyor system 423, in inserting system IS can be coordinated by controller 600 (shown in FIG. 2). As the insertion pusher members 422 push insert material IM into envelope $E_1$ and catches lip $L_1$ of envelope $E_1$, first holding device 522 releases flap $F_1$. Rotary actuator 456 of feeding guide 454 rotates feeding guide 454 from the engaged position back to the retracted position before envelope $E_2$ is pushed from staging position 460 into insertion position 518. At this point, flap plate 446 can be moved from its holding location 525 as seen in FIG. 19 in a direction I out of a holding location into an entry location 527. First drop bar 450 and second drop bar 452 can then push second envelope $E_2$ out of staging position 460 and into insertion position 518. Flap $F_2$ can be pushed in contact with suction cups 526 of first holding device 522 by first drop bar 450. The back side of body portion $BP_2$ of second envelope $E_2$ can be pushed into contact with suction cups 530 of second holding device 524 by second drop bar 452. At this point, drop bars 450, 452 are raised and another envelope is fed into staging position 460, while envelope $E_2$ is prepared for receiving the insert material.

Figure 22:
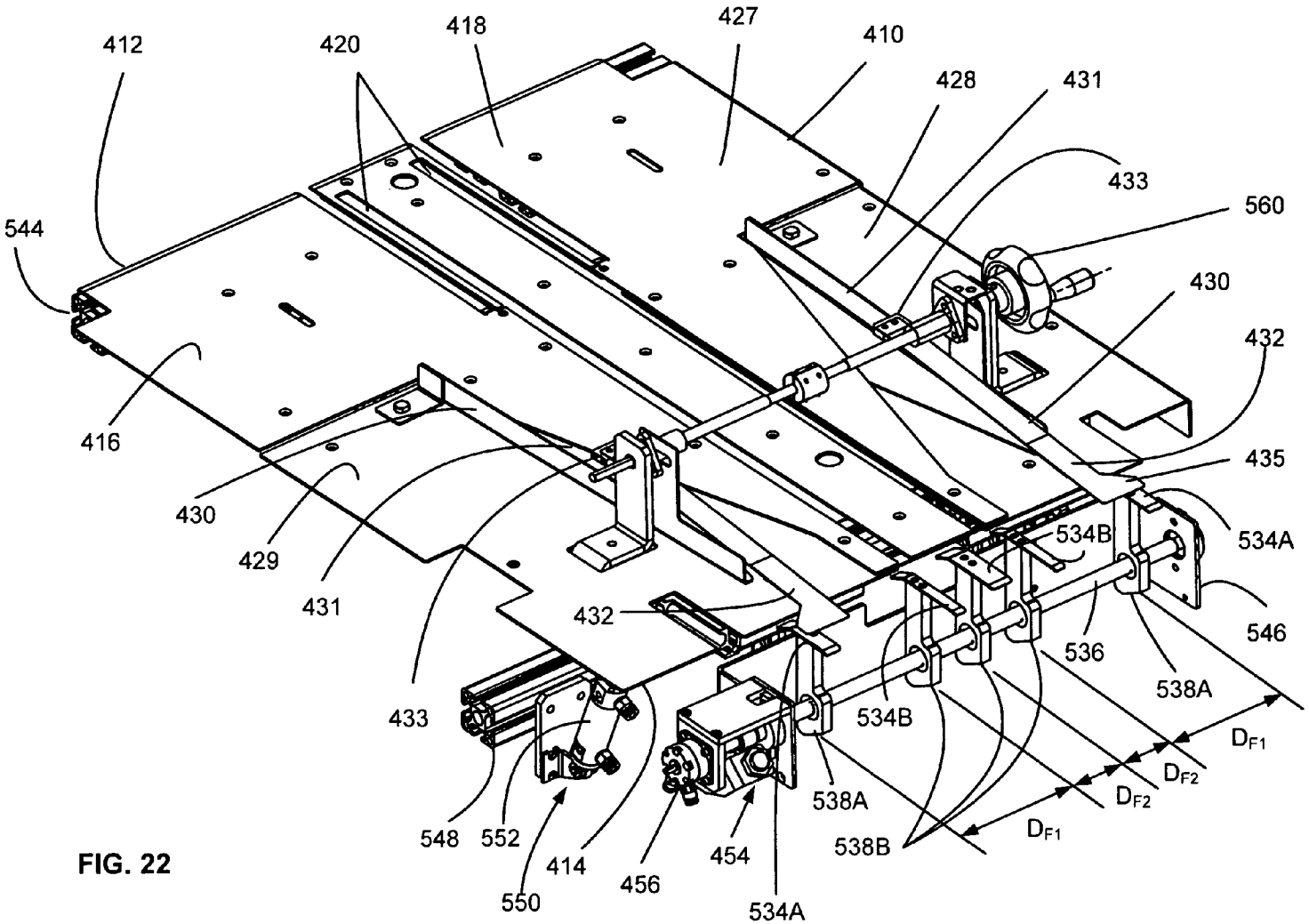
FIG. 22 illustrates a perspective view of an embodiment of a deck of the variable envelope opener apparatus according to FIG. 3.

As seen in FIG. 22, insert guides 430 as well as the positioning of fingers 534 in feeding guide 454 can be changed depending on the size of the inserts and envelopes being used. Insert guides 430 can be moved from an outer stance for larger or longer insert material to a narrower stance through the use of an adjuster device 560. Insert guides 430 can move in along platform 429 and platform 428, respectively, up to a position where they abut platform 427 of deck 410 to accommodate different size insert material to be used. At the same time, as the size of the insert material changes, so can the size of the envelopes. Therefore, the distance between extending arms 538 holding fingers 534 of feeding guide 454 can be changed. The outer extending arms 538A can be adjusted along positioning rod 536 of feeding guide 454 to adjust for different sized envelopes. Inner extending arms 538B can be fixed in a position along positioning rod 536 at distances $D_{F2}$ to permit smaller envelopes to be processed, while at the same time allowing insertion pusher members to pass between fingers 534B and not interfere with the insertion process. For the larger envelopes, outer extending arms 538 can be moved to the distance $D_{F1}$ to properly hold open a larger envelope such as a flats envelope. For the smaller envelopes, outer extending arms 538B can be moved in such that fingers 534A abut against fingers 534B of outer extending arms 538B.

To further facilitate insertion of insert material into the envelope, extending tabs 432 can be placed on the inside of both insert guides 430 such that the tabs 432 extend pass second end 414 of deck 410 to a point where tabs 432 would reside under the flap portion of the envelope in the insertion position without extending into the mouth or under the back side of the body portion of the envelope. Tabs 432 on upstream end 433 can be secured on a top end 431 of the insert guides 430 such that tabs 432 extend above top 416 of deck 410 and parallel slots 420 where the insert materials pass along conveying path 418. Thus, the insert material passes under tabs 432 as it travels down the path 418. Since the downstream end 435 of tabs 432 extend under the flap of the envelopes, the tabs 432 help further prevent the insert material from catching the flap of the envelope as the insert material is inserted into the envelope.

As mentioned above, to help increase the efficiency of the filling of envelopes with insert material, deck 410 and feeding guide 454 are adjustable between different locations within variable envelope opener apparatus 400. This adjustability allows the envelope to be held open in varying amounts depending on the characteristics of the insert material, such as the amount of material to be inserted into the envelope. Referring back to FIG. 3, variable envelope apparatus 400 includes deck 410 to which feeding guide 454 is attached. This deck 410 is adjustable to regulate the amount the mouth of an envelope is held open when in the insertion position. The mouth of an envelope can be held open in a wider stance when a greater amount of insert material is to be received in the envelope. Conversely, the mouth of an envelope can be held open in a narrower stance when the amount of insert material to be inserted in the envelope is smaller than the specified amount.

As a further consideration, the extent to which the mouth of the envelope is opened can vary based on the amount of clearance between the interior side walls or folds of the body portion BP of an envelope E relative to the respective width of the insert materials. This is due to the increased contraction of sides of the envelope as the mouth is widened. As a result, the envelope becomes less flat, forcing the interior walls or folds of the envelope E to encroach upon the sides of the insert material within, and ultimately contract the insert materials as opposed to keeping them in a generally planar position. When contraction of the insert materials or corresponding envelope E occurs, this can result in jams during processing.

Consider, for example, a scenario wherein a first set of insert materials have physical characteristics that enable 0.5 inches of interior side-to-side clearance (e.g., 0.25 inches per side) upon insertion into the envelope E, while a second set of insert materials to be placed within the same sized envelope E enables a clearance of 1 inch (e.g., 0.50 inches per side). Given the limited clearance space, the mouth for the envelope accommodating the first set of materials cannot be opened as wide as the envelope E for the second set while still maintaining a generally planar position. The relative distance available before encroachment of the interior side walls or folds of the envelope E upon the sides of the insert material impact how wide the mouth may be opened.

Clearance distances may be manually specified in advance of processing of the sheet articles through the inserting system IS. This information may then be relayed to controller 600 for controlling the positioning of deck 410 and feeding guide 454 for enabling variation in the amount of opening of the mouth of the envelope E. Alternatively, the available interior side clearance may be detected during processing of an envelope via the usage of one or more proximity or distance sensors, which may be embedded within the extending arms 538 and fingers 534 of feeding guide 454 for providing feedback information to the controller 600 for deck 410 and feeding guide 454. Those skilled in the art will recognize that various other means for determining available clearance information due to insertion may be applied.

FIG. 22 shows the perspective view of deck 410 along with feeding guide 454 attached thereto. As pointed out above, deck 410 has top side 416 that provides conveying path 418 on which insert material travels toward the envelope in which it shall be inserted as described above. Deck 410 includes first end 412 and second end 414. First end 412 is positioned in an upstream position in the inserting station. Deck 410 can pivot about first end 412. For example, a hinge 544 can be secured to first end 412 of deck 410 to permit deck 410 to pivot about hinge 544. Feeding guide 454 is attached to deck 410 underneath second end 414. Feeding guide 454 resides in a feeding guide frame 546. Feeding guide frame 546 is secured to an underside portion of deck 410 such that fingers 534 of feeding guide 454 are proximal to second end 414 of deck 410.

An adjustment mechanism, generally designated as 550, can be secured to the underside of deck 410 and also to a portion of frame 548 of insertion system IS. Adjustment mechanism 550 can be a deck actuator 552 that can be pneumatically controlled to pivot deck 410 about hinge 544. As deck 410 pivots about a pivot point of hinge 544, conveying path 418 and feeding guide 454 raise and lower. In this manner, the placement of fingers 534, in relation to first holding device 522 as well as second holding device 524 can be changed depending on how deck 410 is pivoted about hinge 544.

Figure 23:
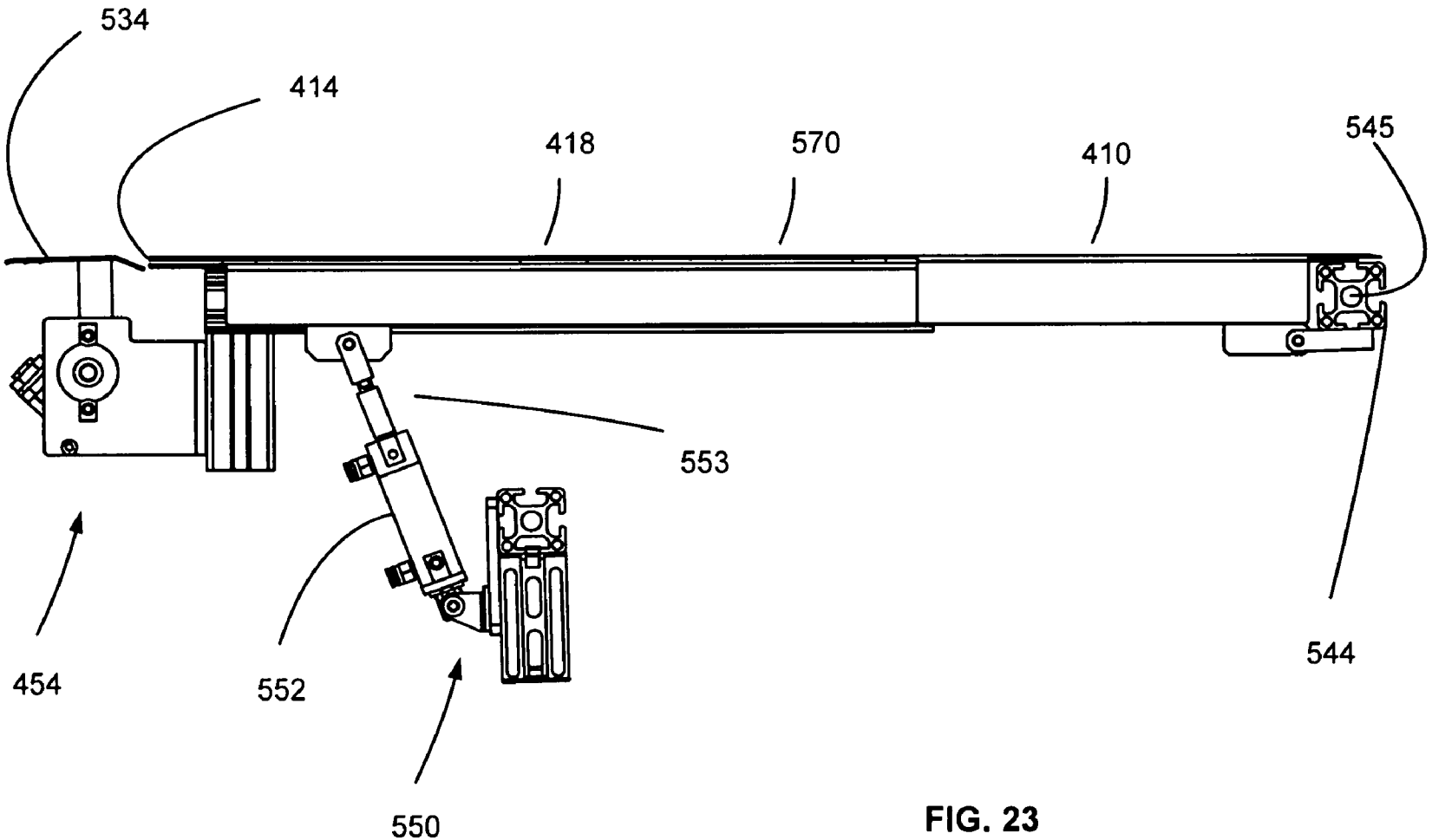
FIG. 23 illustrates a side view of the deck of the variable envelope opener apparatus according to FIG. 3 in a lower location.
Figure 24:
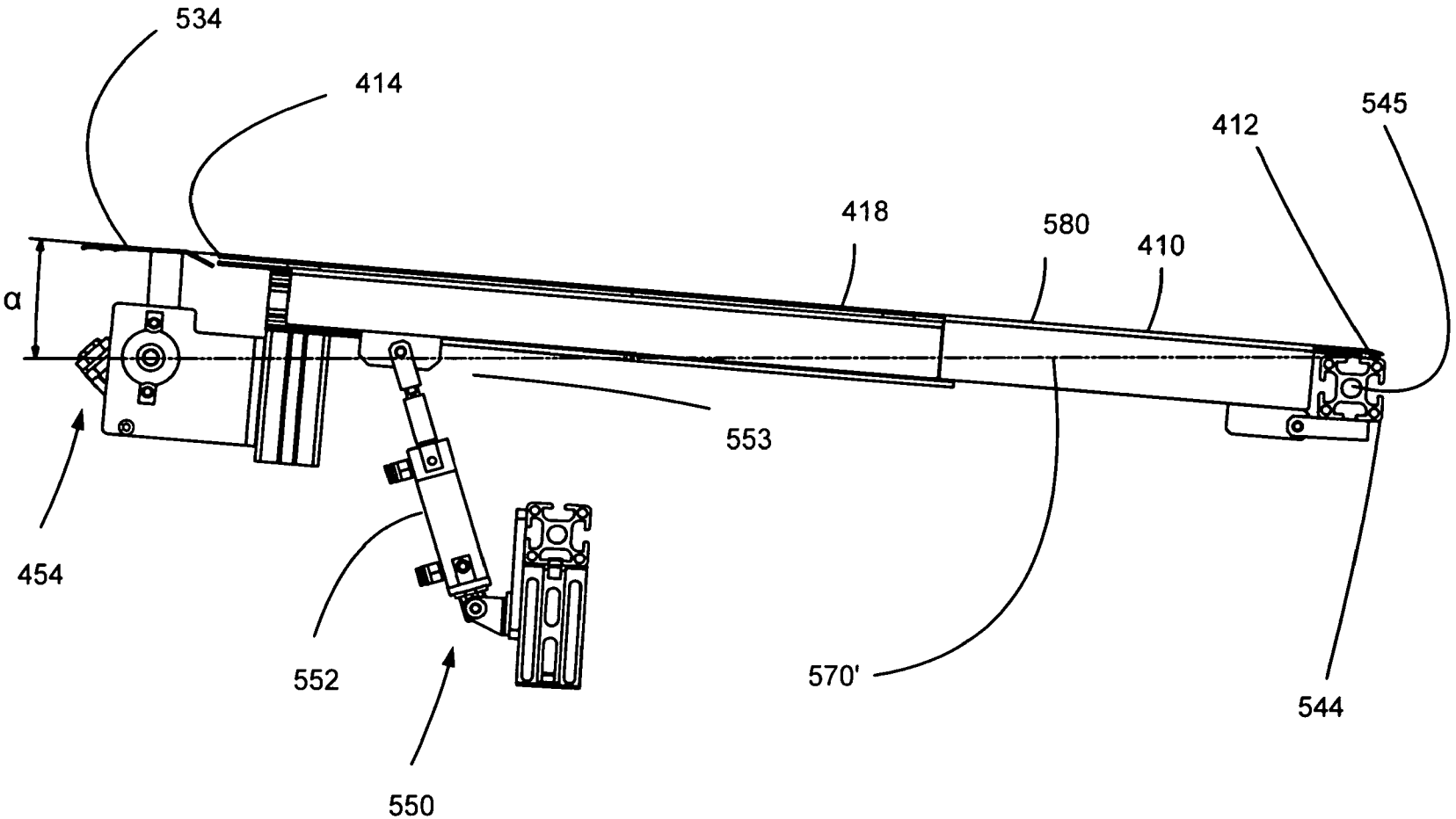
FIG. 24 illustrates a side view of the deck of the variable envelope opener apparatus according to FIG. 3 in an upper location.

As it can be seen in FIGS. 23 and 24, deck 410 can be moved on at least one end between one of at least two locations. For example, in FIG. 23, deck 410 can be in a lower location 570 to accommodate insertion of a greater amount of material into an envelope. The positioning of the lower location 570 is determined based on the size of the envelope in which the material is to be inserted and the characteristics of the material to be inserted into the envelope. In the lower location 570, deck 410 is positioned so that fingers 534 hold the mouth of the envelope in a stance that maximizes the success rate of insertion of the material into the envelope. Each location of the deck 410 permits fingers 534 to open the envelopes wide enough for insert material to be safely inserted into the envelope, while, at the same time, preventing the envelope to be open so wide that it causes the side walls of the envelope to overly contract thereby possibly limiting the ability of the insert material to be inserted into the envelope. The rotation of deck 410 about pivot point 545 of hinge 544 can vary depending on the amount of material to be inserted and the envelope being filled. Normally, deck 410 can rotate approximately about 1.5 degrees. The shorter the deck 410, the larger the angle is that it can pivot.

Deck 410 can be raised to an upper location 580 as shown in FIG. 24, when smaller envelopes are used and/or a lesser amount of insert material is to be inserted in the envelope. To change the location of the deck, the actuator 552 can extend an arm 553, thereby rotating deck 410 upward about pivot point 545 of hinge 544 at the first end 412 by an angle a causing the second end 414 to extend upward from the plane 570' in which deck 410 resided in its lower location 570 shown in FIG. 23. As the second end 414 is moved upward, feeding guide 454 also moves. Thus, when deck 410 and feeding guide 454 are in the upper location 580, the mouth of the envelope will be held open in a narrower stance than when deck 410 and feeding guide 454 are in the lower location 570.

Figure 25:
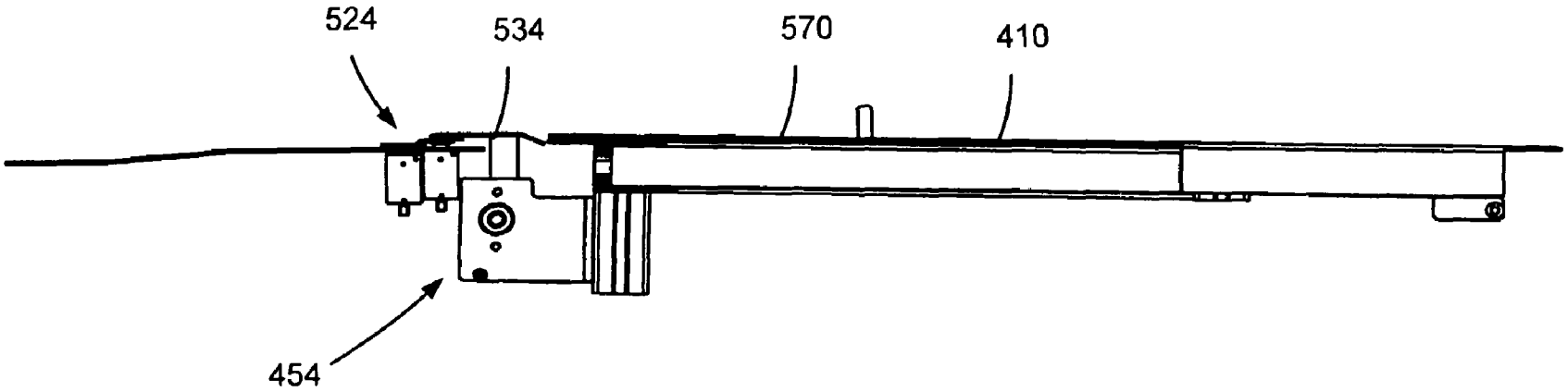
FIG. 25 illustrates a side view of the deck of the variable envelope opener apparatus according to FIG. 3 in a lower location.
Figure 26:
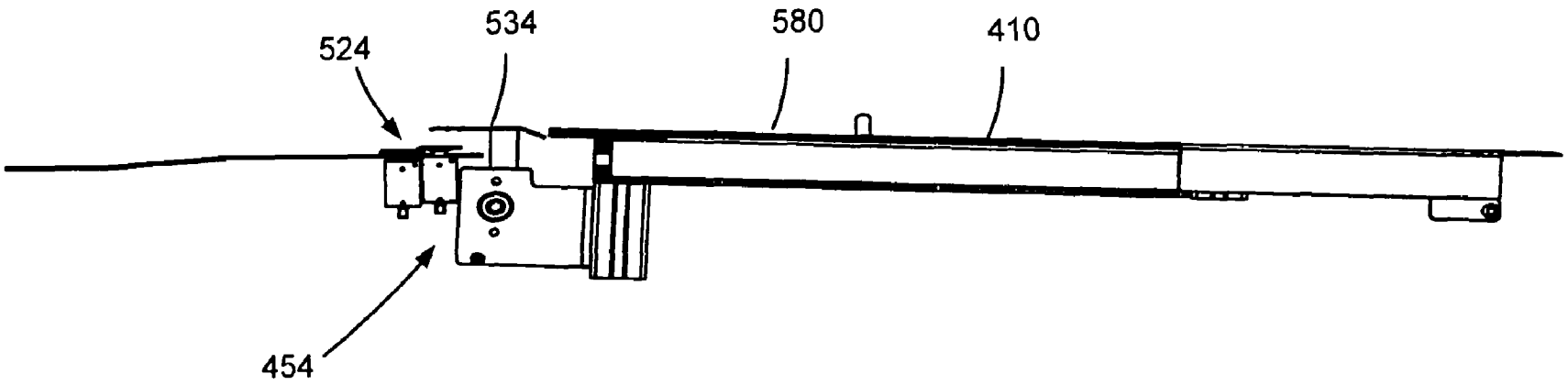
FIG. 26 illustrates a side view of the deck of the variable envelope opener apparatus according to FIG. 3 in an upper location.

FIGS. 25 and 26 show deck 410 and feeding guide 454 in the lower location 570 and upper location 580 in relation to second holding device 524 of holding system 520. In FIG. 25, deck 410 is in lower location 570 and feeding guide 454 is rotated into its engaged position. Fingers 534 are close to second holding device 524 and farther away from the first holding device (not shown in FIG. 25). Thus, once second holding device 524 releases the envelope, fingers 534 and the first holding device will hold the device open in a wide stance. In FIG. 26, deck 410 is in upper location 580 and feeding guide 454 is rotated into its engaged position. Fingers 534 are farther away from second holding device 524 and closer to the first holding device (not shown in FIG. 26) than when deck 410 and feeding guide 454 are in lower location 570. Thus, once second holding device 524 releases the envelope, fingers 534 and the first holding device will hold the envelope open in a narrower stance.

The information to determine the placement of deck 410 can be provided by controller 600, which is used to control the inserting station as well as other modules within the inserting system. This information may relate to the characteristics of the insert material. For example, this information may include, but is not limited to, size and weight information relating to the insert material. The controller 600 can decide how wide that the mouth of each envelope should be held open to insert the material to be received based on the amount of material to be inserted. Controller 600 can shift deck 410 and feeding guide 454 into different locations based on information it has received or based on calculations the controller 600 has made. For example, controller 600 can receive measurement information from sensors within the inserting system about size and weight information relating to the insert material.

Controller 600 can receive the information from program job information that is loaded into the controller either by an operator or through some information transfer mechanism. Such program job information contains information about each set of mailings to be sent out. A mailing can comprise anywhere from one to hundreds of thousands of filled envelopes. The program job information that is used to determine the positioning of deck 410 can include such information as a number of sheets in a set or information regarding the weight of a single sheet within a set or the number of sets to be inserted in each envelope to be included in an envelope. Further, the program job information can include the types of sheet articles or mail articles to be inserted.

Such information used by the controller can be associated with specific addressees. For example, the amount of material can be tied to the specific address to which the materials are to be sent. For instance, bar codes on sheets of the document sets being collated within a collector upstream can be read by a reader R (as shown in FIG. 1) to determine how that document set and other insert material will be accumulated for insertion. Such information can be used by the controller to determine the positioning of the deck 410 and feeding guide 454. Further, bar code information read off the envelope coming into the insertion station can help to determine the positioning of deck 410.

Operators can also determine the positioning of the deck such that the changing of deck 410 can be done based on a single set of jobs where deck 410 stays in one position for the whole series of mailings or, can change variably within a single job based on the information provided by an operator or by information entered or collected as program job information and/or bar code information about grouping of insert material. For example, the controller 600 can be programmed to allow deck 410 to be raised or lower based on a set number of envelopes to be filled as programmed by the operator.

Alternatively, when a reader R scans the bar code of a sheet or an envelope it can determine what inserts are needed for that envelope and adjust deck 410 accordingly when the insert material that is collected is ready to be inserted into that designated envelope. In this way, the width at which the mouth of the envelope is held open is variable. The width at which an envelope is held open can thus be maximized to increase the efficiency of the inserting system. The controller used to control the adjustment of deck 410 between the different locations can be a localized controller in communication with controller 600 or can be a manually activated.

Controller 600 can be a programmable device or devices such as one or more computers or mini-computers and it can run specific software programs or be hard wired to specifically perform the functions of the inserting station including the raising and lowering of deck 410 and feeding guide 454 to optimize the width at which the mouth of the envelope is held open for insertion of the insert material.

For example, for a job set, the deck 410 can assume the position as shown in FIGS. 23 and 25 where a larger amount of insert material will be inserted into an envelope. At this point, actuator 552 of the adjustment mechanism 550 pulls deck 410 into a lower location 570 such that deck 410 pivots downward around pivot point 545 about hinge 544. At this location, the feeding guides 534 can be in closer relationship to second holding device 524 and farther away from the first holding device (not shown in FIGS. 23 and 25), thereby holding the envelope mouth open in a wider stance to allow insertion of the larger amount of material.

If the next set of jobs is for a smaller envelope or contains less insert material to be inserted, then actuator 552 can extend to pivot deck 410 and feeding guide 454 upward about pivot point 545 in hinge 544 such that deck 410 rises at the second end 414 as shown in FIGS. 24 and 26 to a upper location 580. At this location 580, feeding guides 534 can be farther away from second holding device 524 and closer to the first holding device (not shown in FIGS. 24 and 26) thereby holding the envelope mouth open in a narrower stance to allow insertion of the smaller amount of material. As discussed above, the amount which the second end 414 can move varies depending on the length of deck 410, the size and type of the envelopes being processed, the characteristics of the material being inserted, or the like. For example, the changing of the location of the fingers 534 can be from about 1 mm up to about 30 mm or more depending on the characteristics of the insert material to be inserted and the size and/or type of the envelopes being processed.

Since the amount that deck 410 is rotated about hinge 544 can be partly determined by the size of the envelopes and the amount of insert material to be inserted into the specified envelopes, deck actuator 552 can be capable of rotating deck 410 into multiple different locations to accommodate for different size envelopes, different amounts of material, or the like.

Figure 27:
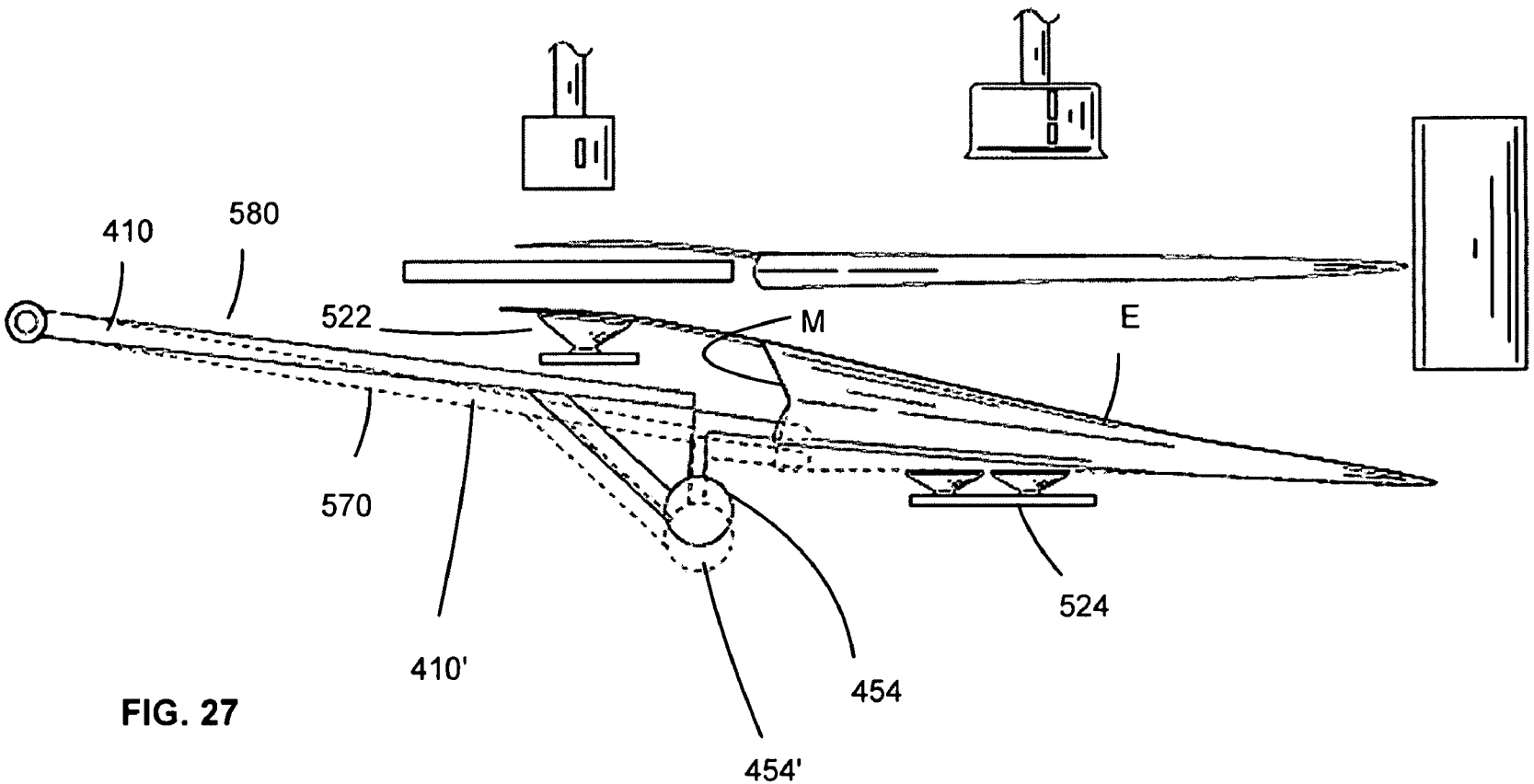
FIG. 27 illustrates a schematic side view of a variable envelope opener apparatus with envelopes being processed according to the present subject matter.

FIG. 27 shows a schematic view of variable envelope opener apparatus 400 with a deck 410 and feeding guide 454 in an upper location 580. The fingers 534 of feeding guide 454 hold mouth M of an envelope E open in a narrower stance. Further, FIG. 27 shows a phantom view of deck 410 and feeding guide 454 being in a lower location 570 with fingers 534 holding the envelope in a wider position.

Figure 28A:
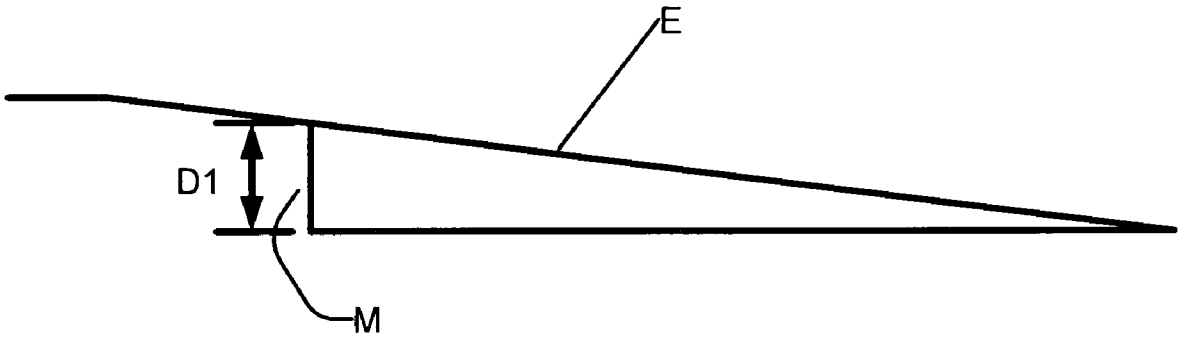
FIGS. 28A and 28B illustrate schematic side views of an envelope being held open at different widths by the variable envelope opener apparatus according to FIG. 27.

For inserting a lesser amount of material into an envelope, deck 410 can be moved to upper location 580 closer to first holding device 522 such that fingers 534 of feeding guide 454 secured to deck 410 hold mouth M of envelope E in a narrower stance as shown in FIG. 28A. In this manner, mouth M of envelope E is held open at a distance $D_1$ that does not cause much contraction of the sides of the envelope, while still permitting a large enough distance for the intended insert material to be inserted easily into the envelope. Thus, neither the width that the envelope is opened nor the contraction of the sides will interfere with the insertion process. Thereby, the success rate for the insertion of the material into the envelope can be increased.

Figure 28B:
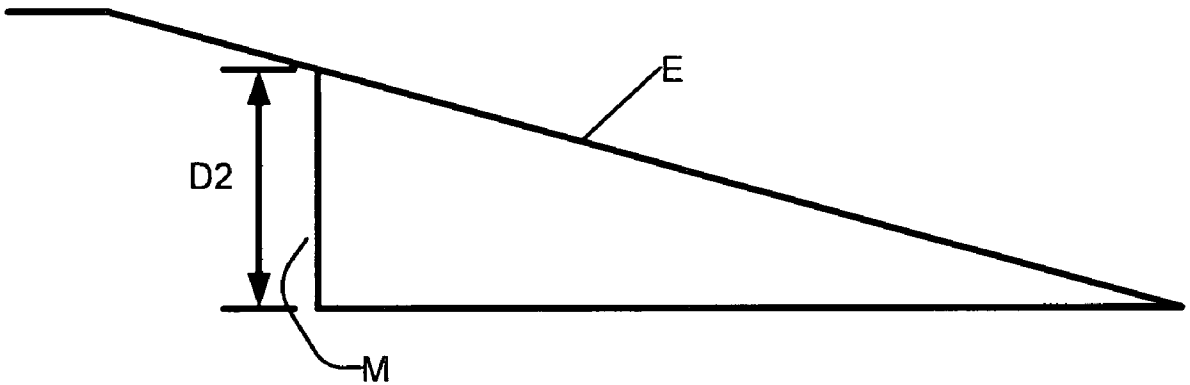

If it is determined that a larger amount of material is to be inserted into an envelope, the deck 410 can be shifted to lower location 570 shown in phantom in FIG. 27 such that deck 410 and feeding guide 454 assume location 410' and 454', respectively. Such a location 570 is further away from first holding device 522. Thus, the envelope will be held in a wider stance as shown in FIG. 28B where mouth M of envelope E is held open at a greater distance. By holding the envelope at a greater distance $D_2$ due to the shifting of the deck 410 to the lower location 570, the sides of envelope E will contract more than if envelope E is held at a distance $D_1$. However, the success rate of insertion can be increased due to the increased width at which the mouth of the envelope is held open, since a larger amount of insertion material is being inserted into the envelope. In this manner, the versatility of inserting station 300 and inserting system IS can be increased by allowing a variable change of position of the envelope opener apparatus depending on the amount of material to be inserted.

Figure 29:
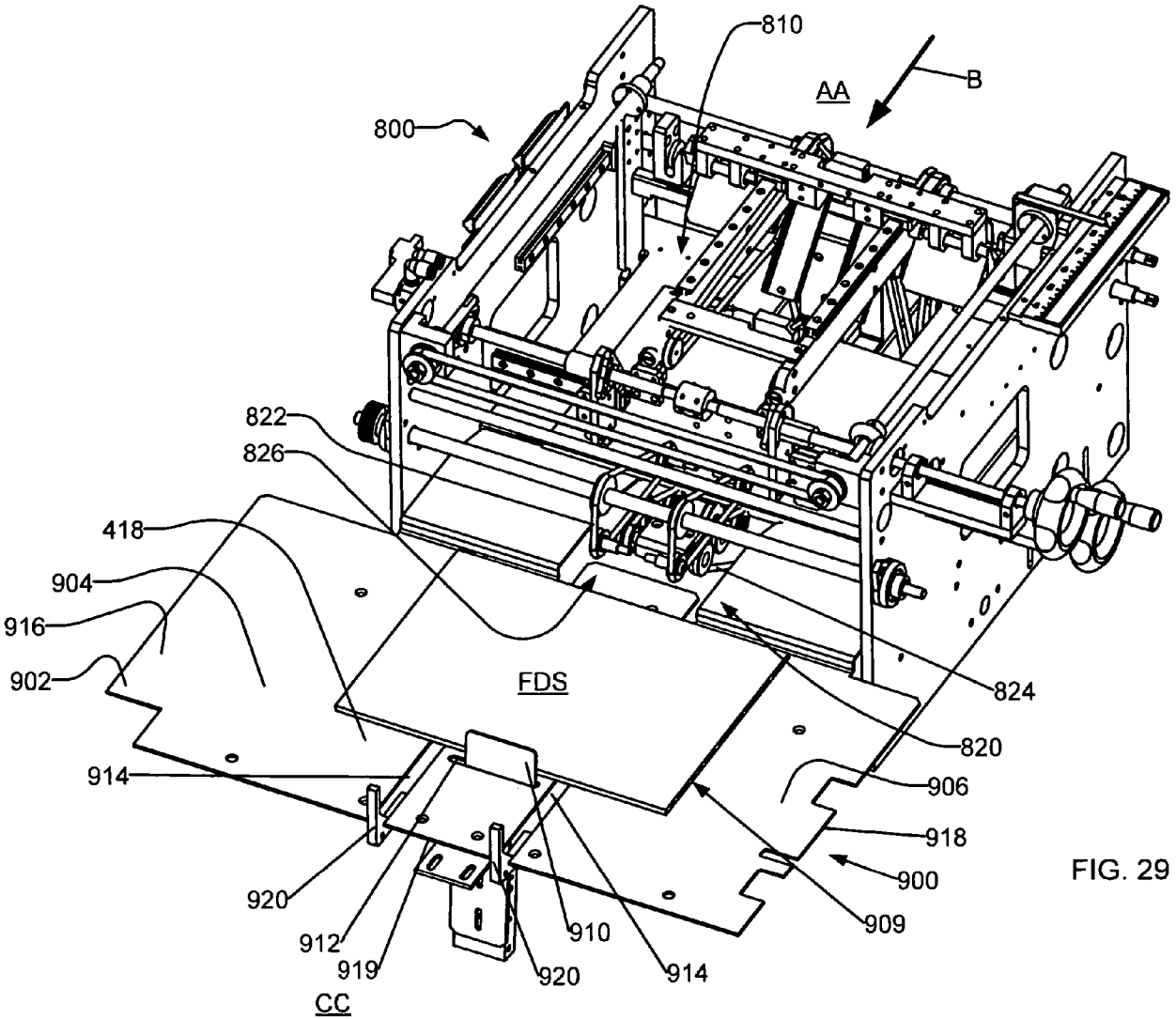
FIG. 29 illustrates a perspective view of an embodiment of a staging station according to the present subject matter.

FIG. 29 illustrates a perspective view of an assembly station 800 followed by a staging station, generally designated as 900. Sheet articles and/or mail articles flow from upstream within the sheet processing machine, such as an inserting system IS, in direction B into assembly station 800. The sheet articles being fed into assembly station 800 can be folded or unfolded depending on upstream processes as well as possibly some types of mail articles to be collected together to be inserted in envelopes downstream. Assembly station 800 can accumulate multiple sheet articles and/or mail articles to form first document sets. Assembly station 800 can include an accumulation deck, generally designated as 810, for accumulating multiple first document sets to be transferred out assembly station 800 downstream for later processing. Each document set of the multiple first document sets accumulated on the accumulation deck 810 can be fed out of the assembly station 800 individually. A document feeder 820 can grab each first document set within the assembly station 800 and feed that first document set onto a staging station, generally designated as 900.

As shown in FIG. 29, a first document set FDS can reside on staging station 900. The staging station can have a deck 902 defined therein or formed thereon or attached thereto. Staging deck 902 and accumulation deck 810 can help to form an upper surface 904 of elongated raceway conveyor 906. The staging deck 902 can define a staging area for first document sets FDS fed to the staging station 900 by the assembly station 800. Elongated raceway conveyor 906 is configured to advance a plurality of document sets consecutively along a substantially horizontal conveying path 418 from an upstream position AA to a downstream position CC.

As stated above, accumulation deck 810 of assembly station 800 can accumulate multiple sets of first document sets FDS. Document feeder 820 can feed each individual first document set FDS from accumulation deck 810 onto staging station 900 and conveying path 418. Document feeder 820 can include one or more top belts 822 and one or more bottom belts 824 that can propel each first document set FDS down the conveying path 418 at a feeding location 826. A stop gate 910 can be extended through an opening 912 in the staging deck 902 to stop the first document set FDS at a stop location 909 in the conveyor path 418. After first document set FDS is stopped at stop location 909, stop gate 910 can be lowered to allow first document set FDS to pass downstream. In some embodiments, friction between upper surface 904 of elongated raceway conveyor 906 and first document sets FDS may stop first document sets FDS in stop location 909.

Staging deck 902 can also include elongated slots 914 that run along the direction B of the flow of documents sets on conveyor 906. Staging deck 902 can be made of a first outer platform 916 and a second outer platform 918 with a middle platform 919 disposed therebetween. The first, second and middle platforms 916, 918, 919 can be spaced apart to form a pair of the elongated slots 914 within staging deck 902. Elongated slots 914 can run substantially parallel to each other. These elongated slots 914 can continue through the sheet processing machine to permit a plurality of first pusher members 920 and a plurality of movable pusher members to extend through the elongated slot 914 to push document sets along conveying path 418.

Figure 30:
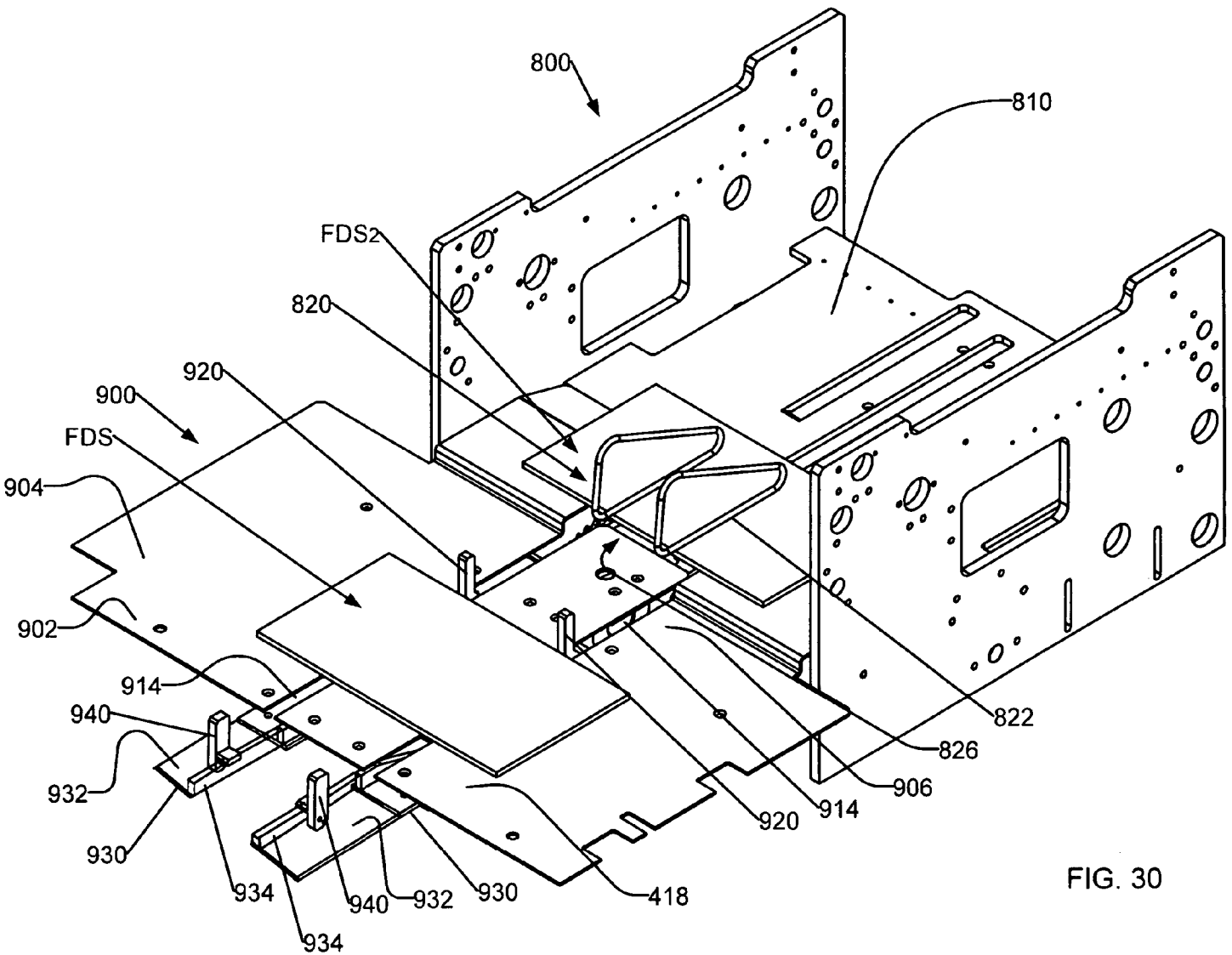
FIG. 30 illustrates a perspective view of the staging station according to FIG. 29.

FIG. 30 shows selective portions of assembly station 800 and staging station 900 to better illustrate steps in the staging process. After stop gate 910 has been lowered, first document set FDS can be pushed along conveying path 418 by a pair of first pusher members 920 that travel along conveying path 418 and ride along pusher member tracks 930. As first document set FDS is being transported along the conveying path 418 by first pusher members 920, another first document set $FDS_2$ can be in the process of being prepared to be fed by document feeder 820 onto conveying path 418. Once first pusher members 920 pass a specified point along conveying path 418, the document feeder 820 can feed the other first document set $FDS_2$ onto the staging deck 902 as discussed in more detail below.

In FIG. 30, the upper surface 904 of conveyor 906 past staging deck 902 is not shown to permit viewing of a portion of pusher member tracks 930. The first pusher members 920 can extend through elongated slots 914 within staging deck 902. A pair of movable pusher members 940 can travel along raceway conveyor 906 and extend through elongated slots 914 in front of the pair of first pusher members 920. Movable pusher members 940 can be used to advance a second document set which is accumulated downstream. For example, movable pusher members 940 can be used to advance enclosures fed from enclosure feeders in front of movable pusher members 940. First pusher members 920 and movable pusher members 940 can be movably mounted to a portion of the conveyor 906 as will be explained in more detail below. First pusher members 920 may be different heights than movable pusher members 940. For example, first pusher members 920 may be taller than movable pusher members 940.

Each pusher member track 930 can include a first section 932 and a second section 934. First pusher members 920 ride along first section 932 of each pusher member track 930 causing first pusher members 920 to extend through elongated slots 914 into conveying path 418. Second section 934 of each pusher member track 930 can be used to extend movable pusher members 940 through elongated slot 914 and into conveying path 418. The process of extending both first pusher members 920 and movable pusher members 940 is discussed in more detail below.

Figure 31:
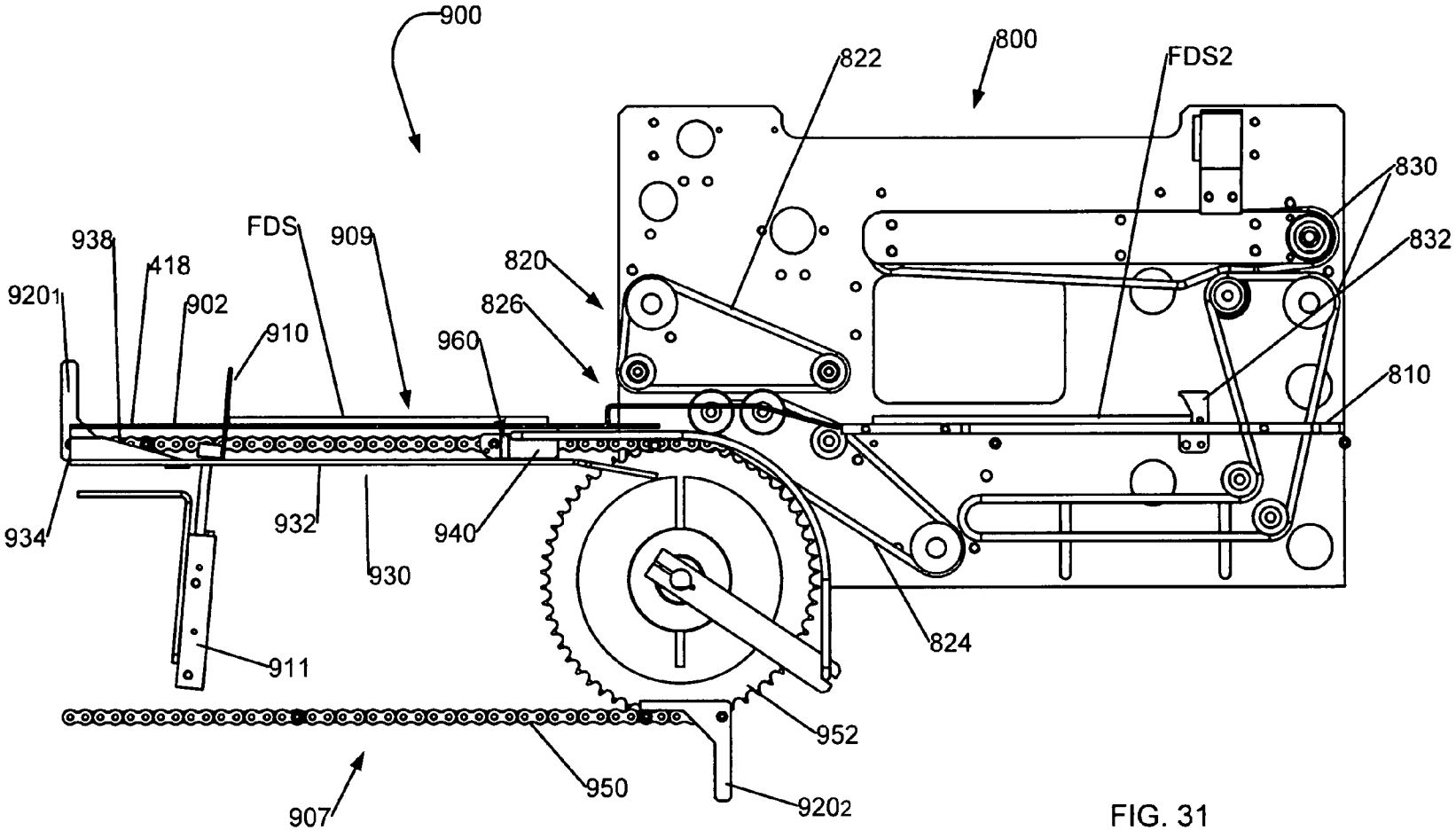
FIG. 31 illustrates a cross-sectional side view of portions of embodiments of a staging station and an assembly station during processing of sheet articles according to the present subject matter.
Figure 32:
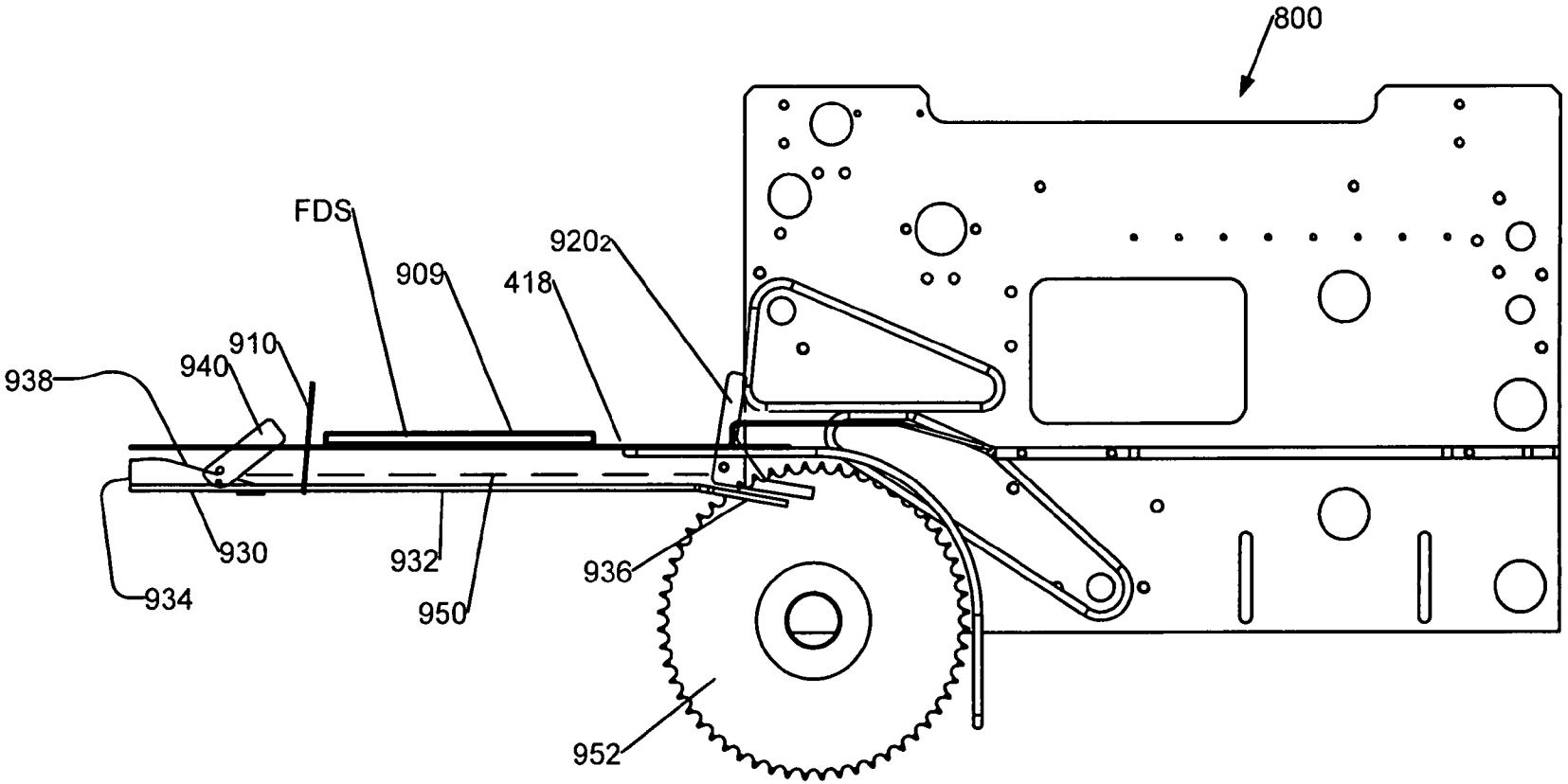
FIG. 32 illustrates a cross-sectional side view of portions of embodiments of a staging station and an assembly station during processing of sheet articles according to the present subject matter.
Figure 33:
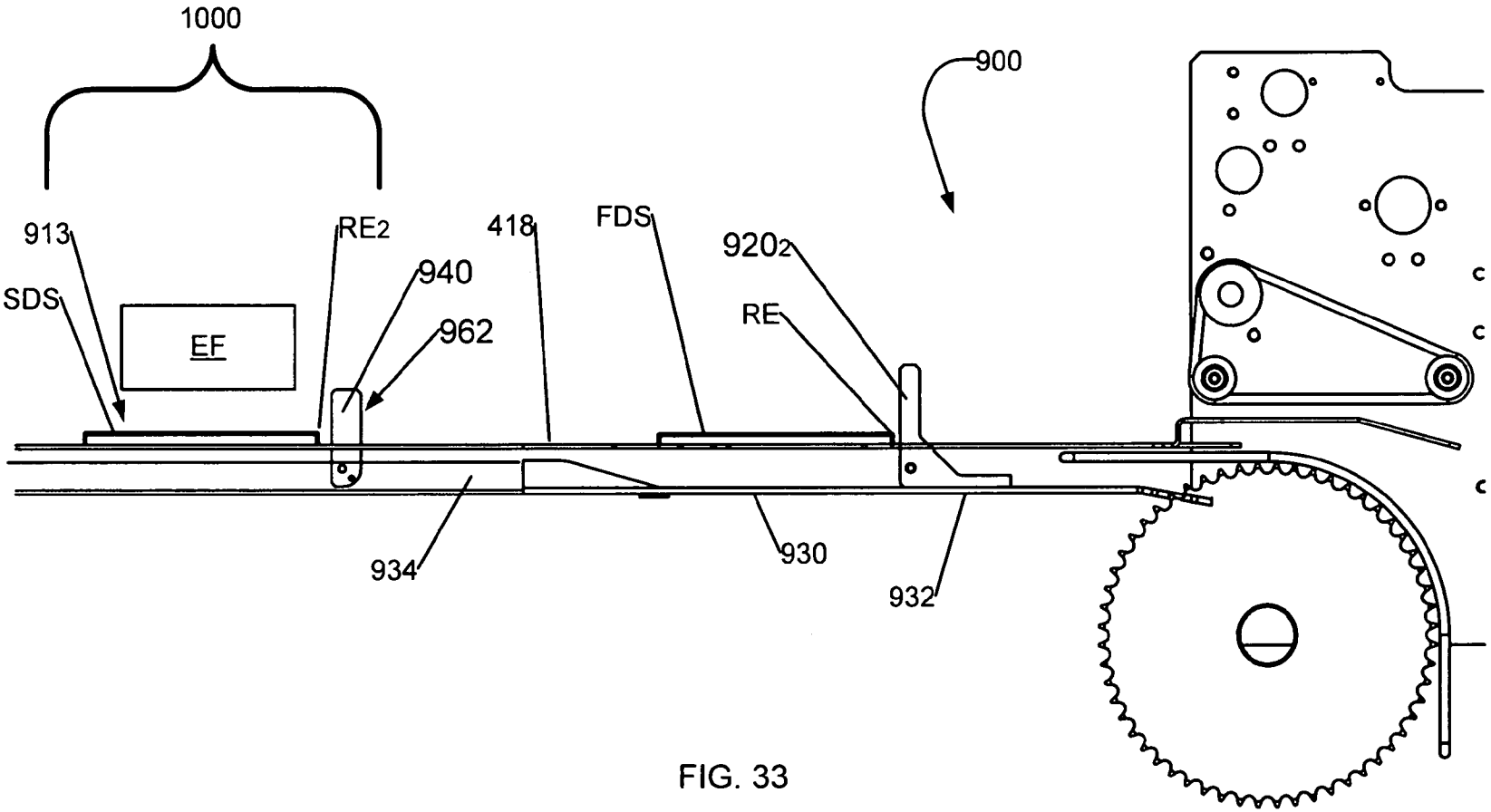
FIG. 33 illustrates a cross-sectional side view of portions of embodiments of a staging station and assembly station during processing of sheet articles according to the present subject matter.

FIGS. 31, 32 and 33 illustrate cross-sectional side views of portions of staging station 900 and assembly station 800 as different first document sets are being staged within staging station 900 and being transported out of staging station 900 for further processing downstream. Only one pusher member track and associated chain and pusher members are shown and described. It is understood that other pusher member tracks and their associated conveyor parts can be present. For example, for FIGS. 31, 32 and 33, a parallel pusher member track and associated chain and pusher members that can run in parallel to the described chain and pusher members to aid in transporting first and second document sets.

As shown in FIG. 31, raceway conveyor 906 can include at least one movable conveyor device, generally designated as 907, such as a belt, a chain or the like. For example, the conveyor device may be chain 950 to which first pusher members 920 and movable pusher members 940 can be attached. For example, in the embodiments shown in the Figures, two chains 950 can be used to rotate first pusher members 920 and movable pusher members 940 in pairs to push the document sets along conveying path 418. As seen in FIG. 31, chain 950 can be driven by a motor (not shown) and ride around a sprocket 952 beneath staging station 900 and assembly station 800. First pusher members 920 and movable pusher members 940 alternate along chain 950 so that each first document set is followed by a second document or vice versa. As chain 950 travels around sprocket 952, first section 932 of the respective pusher member track 930 extends each first pusher member 920 into conveying path 418 before feeding location 826 of document feeder 822. First pusher members 920 can be considered fixed-positioned pusher members. Movable pusher members 940 can be pivotable and remain in a lowered position beneath conveying path 418 until encountering second section 934 of the respective pusher member track 930, which will extend the movable pusher members 940 into the conveying path 418. In this manner, movable pusher members 940 that are to push second document sets do not interfere with the feeding of the first document sets into the conveying path.

As seen in FIG. 31, first pusher member $920_1$ can be advancing one first document set (not shown), while first document set FDS is fed on staging deck 902 of staging station 900 and stopped on conveying path 418 by stop gate 910 at stop location 909. While first document set FDS is being fed and stopped on conveying path 418, movable pusher member 940 passes beneath first document set FDS in a lowered position. Stop gate 910 can be extended into and retracted out of the conveying path 418 by an actuator 911. First document set FDS stays at stop location 909 on staging deck 902 until first pusher member 9202 rotates around sprocket 952 and is extended into conveying path 418 by first section 932 to push first document set FDS along conveying path 418. First document set $FDS_2$ is fed into the assembly station 800 by feeding belts 830 and resides on accumulation deck 810 ready to be pushed top belts 822 and bottom belts 824 of document feeder 820 by eject pin 832.

First section 932 of each pusher member track 930 can have a chamfered lead end 936 that aids in extending first pusher members 920 into conveying path 418 as chain 950 rides around sprocket 952. As seen in FIG. 32, first pusher member $\mathbf{920}_2$ extends into conveying path upstream of first document set FDS, while movable pusher member 940 can be extended into conveying path 418 downstream of stop location 909 of first document set FDS and stop gate 910 by second section 934 of pusher member track 930. A portion of movable pusher member 940 can contact ramp 938 of second section 934 to begin raising movable pusher member 940 into conveying path 418.

As seen in FIG. 33, stop gate 910 is lowered beneath conveying path 418 and first pusher member $\mathbf{920}_2$, which rides along first section 932 of pusher member track 930, begins pushing first document set FDS along conveying path 418 in staging station 900. First pusher member $\mathbf{920}_2$ also registers the sheet articles within first document set FDS on a rear end RE of first document set FDS. At this time, movable pusher member 940 rides along second section 934 of pusher member track 930 in conveying path 418 ready to pick up second document set SDS. Second document set SDS can comprise one or more sheet articles and/or one or more mail articles fed onto the conveying path 418 by one or more enclosure feeders EF (see FIG. 1) at a second document feed location 913 in front of movable pusher member 940. Movable pusher members 940 can also register second document set SDS at a rear end $RE_2$. The first document set pushed along conveying path 418 by first pusher member $\mathbf{920}_2$ and second document set pushed along conveying path 418 by movable pusher member 940 can be collated together downstream in collating apparatus module 2000 shown in the schematic in FIG. 1 and described in U.S. patent application Ser. No. 11/240,604.

Once first pusher member $\mathbf{920}_2$ advances first document set FDS past stop gate 910, eject pin 832 can push first document set $FDS_2$ as seen in FIG. 31 into document feeder 820 to feed first document set $FDS_2$ onto staging deck 902. Stop gate 910 can then extend to stop first document set $FDS_2$ at stop location 909 on staging deck 902 for another first pusher member 920 to engage first document set $FDS_2$.

Figure 34:
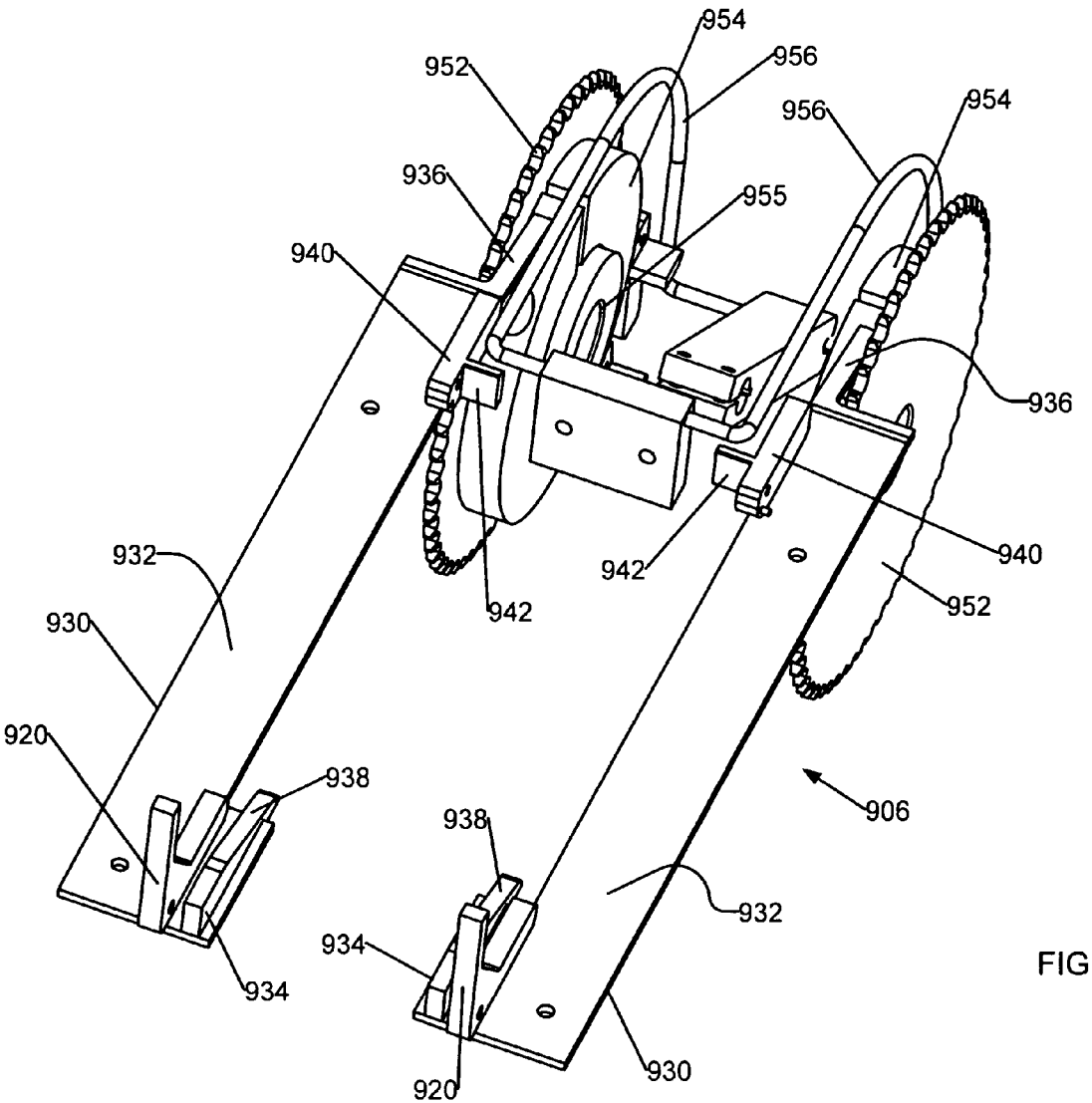
FIG. 34 illustrates a perspective view of a portion of an embodiment of a raceway conveyor according to FIG. 29.
Figure 35:
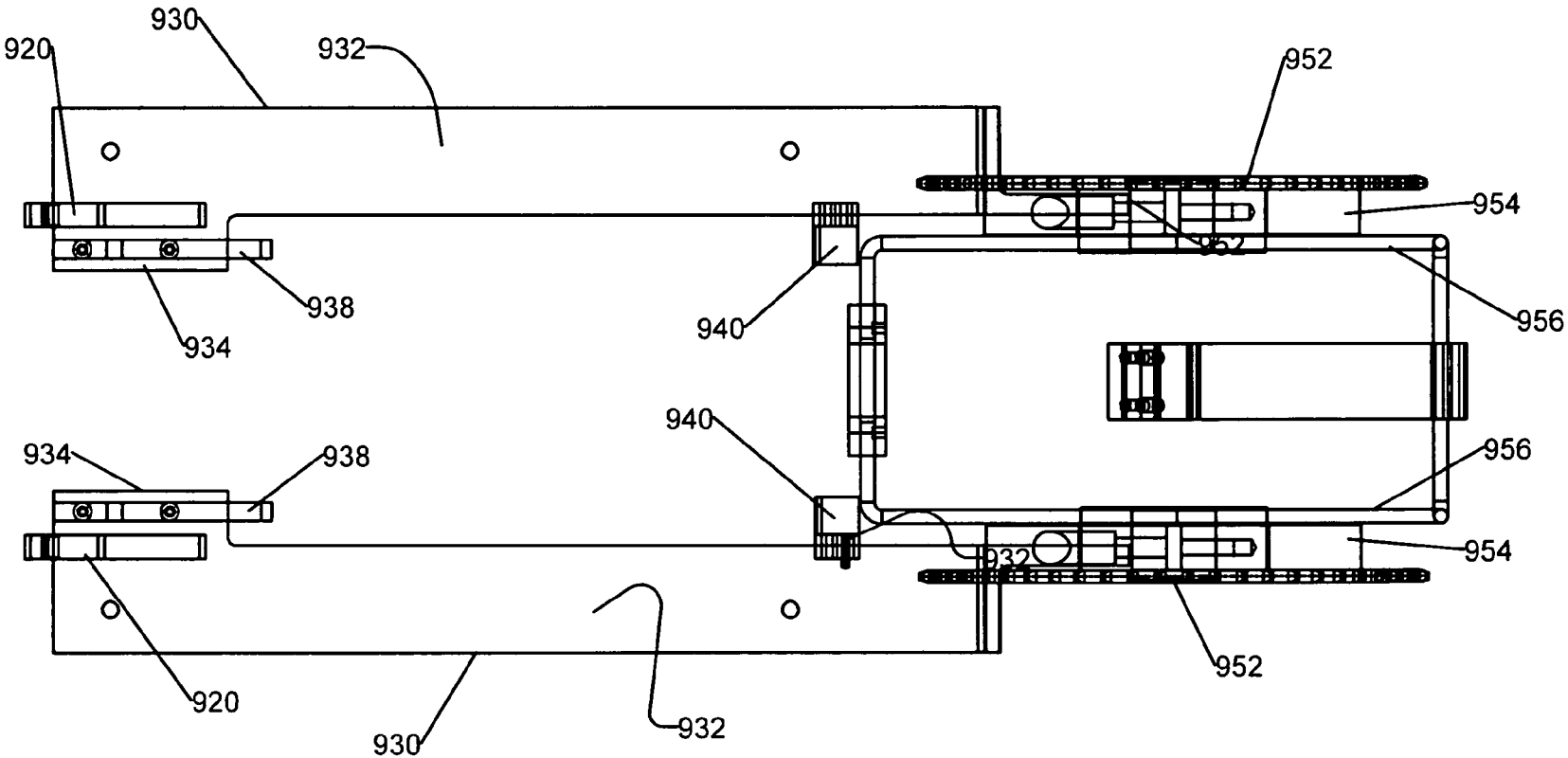
FIG. 35 illustrates top plan view of a portion of the raceway conveyor according to FIG. 34.

FIGS. 34 and 35 show portions of raceway conveyor 906 that can be used in extending first pusher members and movable pusher members into the conveying path. Two parallel pusher member tracks 930 can be aligned underneath two parallel elongated slots 914 within conveying path 418 (shown in FIGS. 29 and 30). Two sprockets 952 used to rotate chains (not shown for the sake of clarity) of raceway conveyor 906 are aligned with pusher member tracks 930. A shelf 954 is secured around a hub 955 of each sprocket 952. Shelves 954 provide a surface on which first pusher members 920 ride as first pusher members 920 and movable pusher members 940 rotate around sprockets 952. A wire guide 956 can be placed in close proximity of each sprocket 952 to keep movable pusher members 940 in a lowered position as they rotate with chain 950 around sprocket 952. The wire guides 956 can be a single unit or can be separate wire guides that are individually placed around each shelf 954 of sprockets 952.

Pusher member tracks 930 each can have first section 932 and second section 934. First sections 932 each can have a chamfered lead end 936 that can extend in close proximity of a corresponding shelf 954. As first pusher members 920 and movable pusher members 940 ride around shelves 954 and wire guide 956, respectively, they are guided onto pusher member tracks 930 by lead ends 936 of first sections 932. As first pusher members 920 ride around on shelves 954 onto lead ends 936 of first sections 932 of pusher member tracks 930, first pusher members 920 will extend in conveying path 418 shown in FIG. 33. As movable pusher members 940 ride against wire guides 956, wire guides 956 can direct movable pusher members 940 into a lowered position as they are passed onto first sections 932 of pusher member tracks 930. Movable pusher members 940 reside in their lowered position until arms 942 of movable pusher members 940 contact ramps 938 of second sections 934 of pusher member tracks 930. Ramps 938 raise movable pusher members 940 into an upright position so that they extend into path 418 shown in FIG. 33.

Figure 36A:
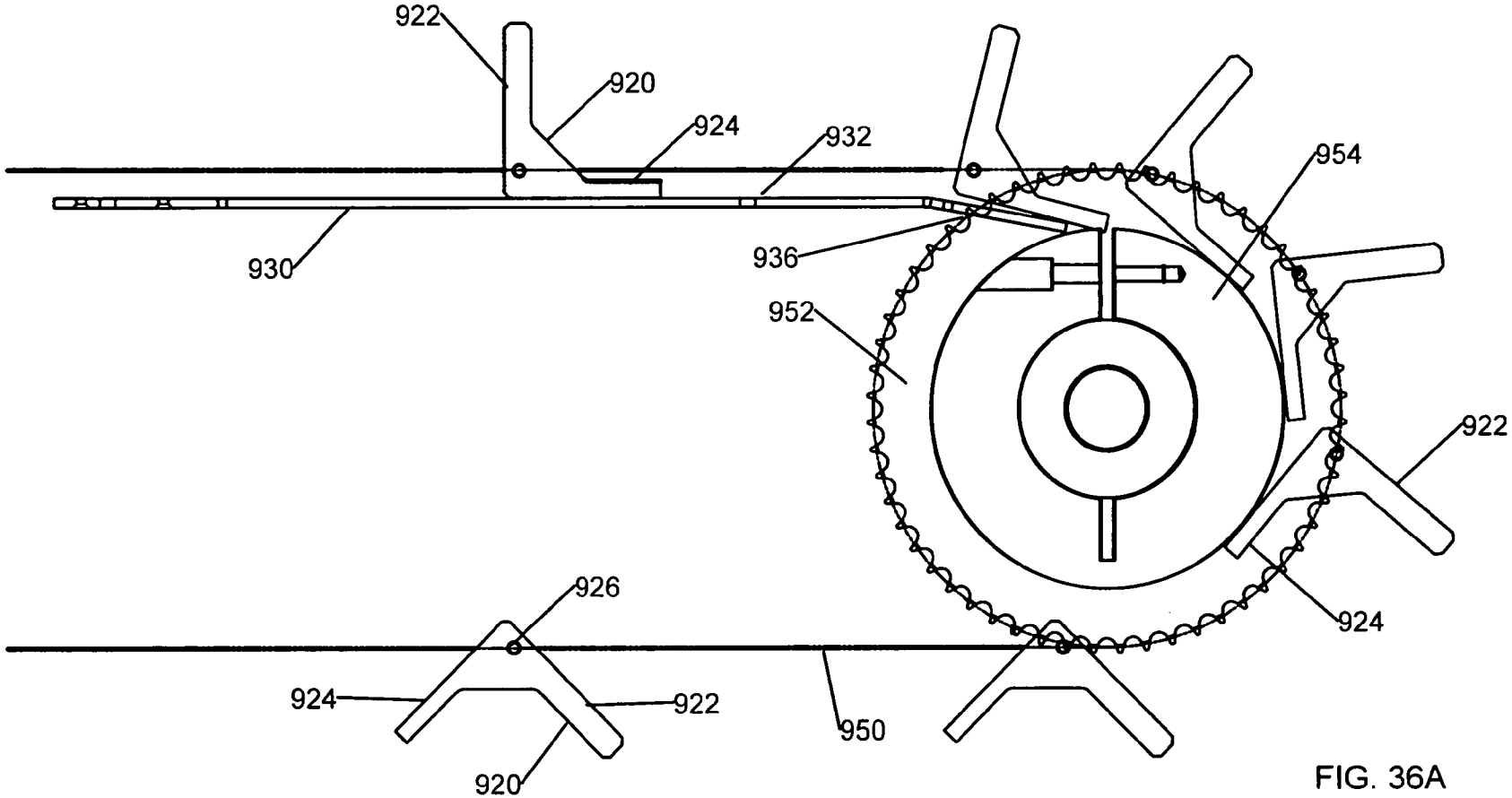
FIG. 36A illustrates a schematic side view of a progression of a first pusher member according to the present subject matter.

FIG. 36A shows a progression of a single first pusher member 920 as chain 950 to which it is attached (represented by a single line) transports first pusher member 920 around sprocket 952 and pusher member track 930. First pusher member 920 includes guide post 922 and a base 924. Guide post 922 can extend about perpendicular to base 924. First pusher member 920 can be attached to chain 950 by an attachment pin 926 positioned proximal to the convergence of guide post 922 and base 924. First pusher member 920 can be attached to chain 950 to allow first pusher member 920 to rotate about attachment pin 926. The weight distribution of first pusher member 920 can be such that base 924 at least partially faces an interior of chain 950 that engages sprocket 952.

As chain 950 rotates about sprocket 952, base 924 of first pusher member 920 contacts shelf 954 of sprocket 952. Base 924 of first pusher member 920 rides on shelf 954 as the chain rotates about sprocket 952 holding guide post 922 of first pusher member 920 in an extended position outward from chain 950. Shelf 954 guides base 924 onto chamfered lead end 936 of first section 932 of pusher member track 930. Lead end 936 guides first pusher member 920 onto first section 932 of pusher member track 930. With base 924 residing firmly against first section 932, guide post 922 of first pusher member 920 extends into the conveying path to push a document set along the conveying path.

Figure 36B:
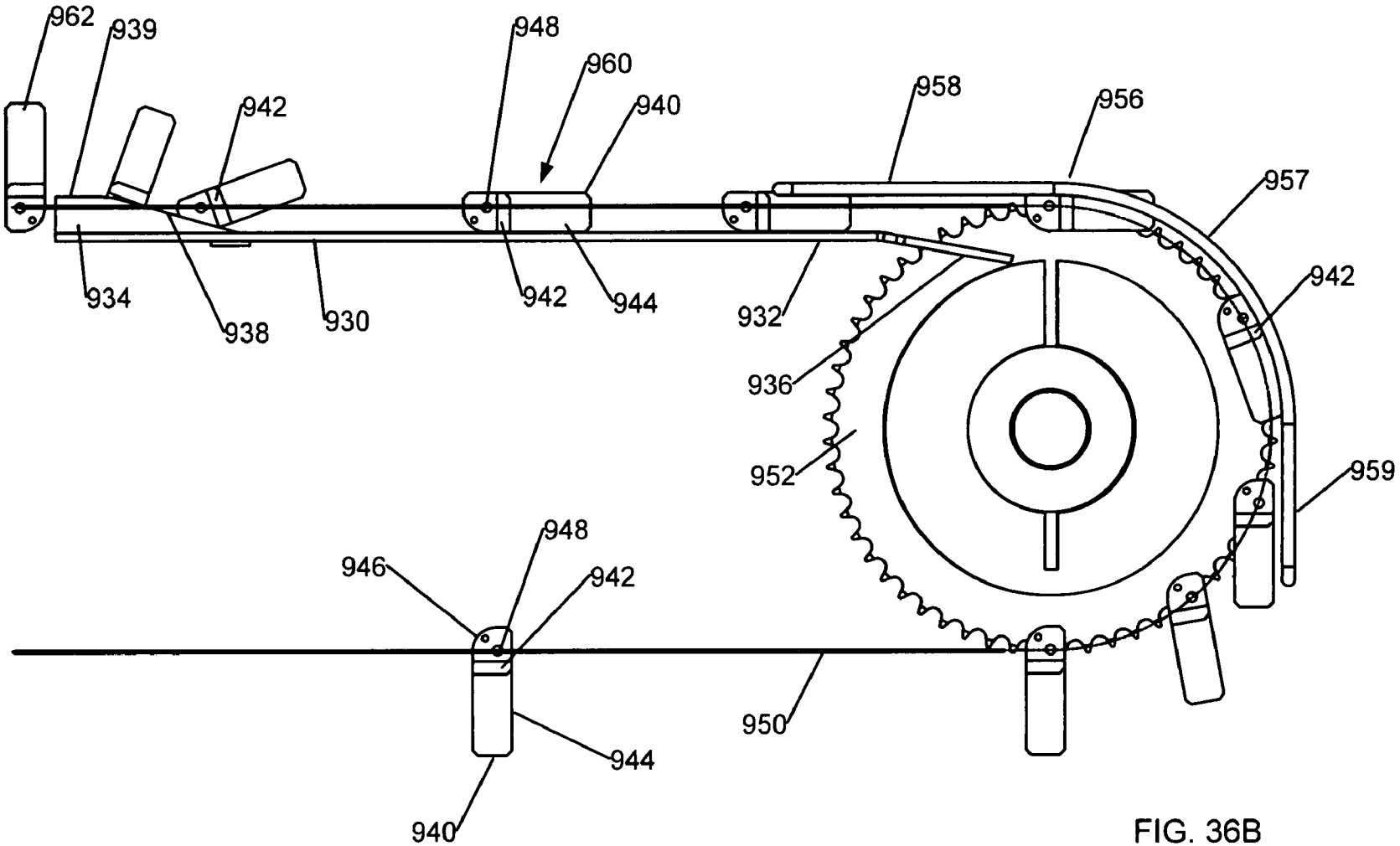
FIG. 36B illustrates a schematic side view of a progression of a second pusher member according to the present subject matter.

Similarly, FIG. 36B shows a progression of a single movable pusher member 940 as chain 950 to which it is attached (represented by a single line) transports movable pusher member 940 around sprocket 952 and pusher member track 930. Movable pusher member 940 can include an elongated post body 944 with an arm 942 that extends perpendicularly outward from post body 944 and chain 950. Movable pusher member 940 can also include a rounded foot 946. Movable pusher member 940 can be attached to chain 950 by an attachment pin 948 between rounded foot 946 and arm 942. Movable pusher member 940 can be attached to chain 950 to allow movable pusher member 940 to rotate about attachment pin 948.

Wire guide 956 can extend around sprocket 952 in proximity to sprocket 952. Wire guide 956 has a curved section 957 that has a curvature that is similar to the radius of curvature of sprocket 952. A first straight section 958 of wire guide 956 can extend generally tangentially from curved section 957 above a portion of first section 932 of pusher member track 930 near lead end 936. Further, a second straight section 959 of wire guide 956 can extend generally tangentially from curved section 957 on its other end. As chain 950 rotates around sprocket 952, arm 942 of movable pusher member 940 can contact second straight section 959 of wire guide 956 as sprocket 952 guides the arm 942 of movable pusher member 940 into curved section 957. Wire guide 956 prevents post body 944 from assuming an upright position that extends outward from chain 950. By contacting arm 942, wire guide 956 holds movable pusher member 940 in a lowered position relative to chain 950. As chain 950 rotates about sprocket 952, straight section 958 of wire guide 956 guides movable pusher member 940 onto first section 932 of pusher member track 930 with movable pusher member 940 in a lowered position, generally designated as 960. With movable pusher member 940 in lowered position 960, post body 944 rides along first section 932 of pusher member track 930 with arm 942 extending outward from post body 944 and perpendicular to first section 932 of pusher member track 930.

Second section 934 of pusher member track 930 extends into the path of arm 942 as movable pusher member 940 and chain 950 travel forward. As chain 950 is rotated forward, arm 942 contacts ramp 938 of second section 934 causing movable pusher member 940 to rotate upward about attachment pin 948. Once ramp 938 levels off and arm 942 of movable pusher member 940 rides along top surface 939 of second section 934 of pusher member track 930, movable pusher member 940 assumes an upright position, generally designated as 962, with post body 944 of movable pusher member 940 extending into the conveying path of the sheet processing machine. When movable pusher member 940 is in upright position 962, movable pusher member 940 is ready to push a second document set along the conveying path.

Figure 37A:
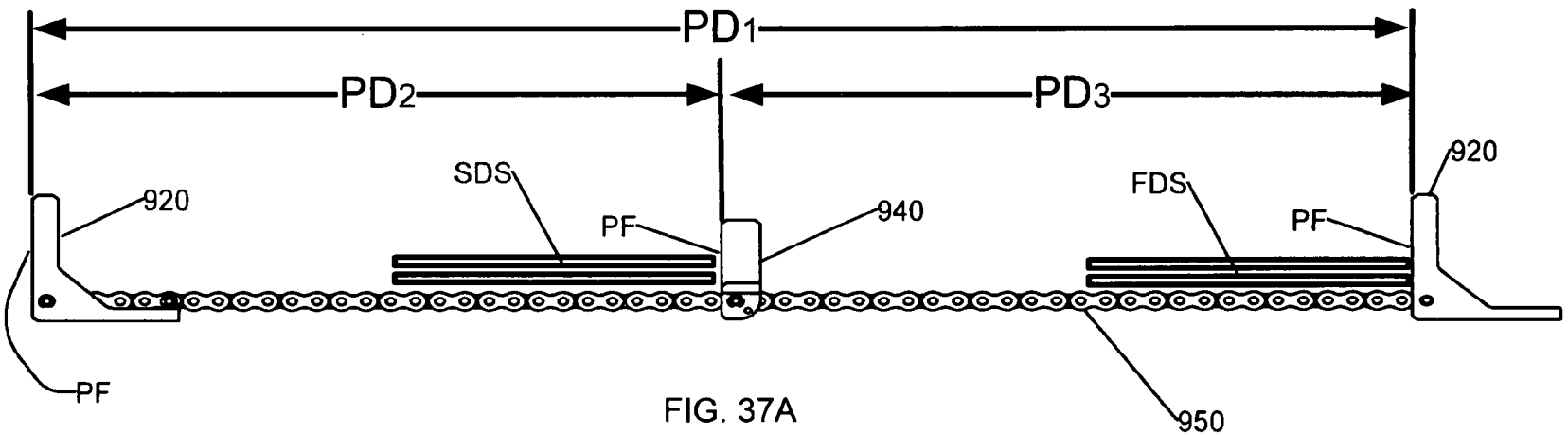
FIG. 37A illustrates a side view of an embodiment of the spacing of first pusher members and movable pusher members on a portion of a conveyor according to the present subject matter.
Figure 37B:
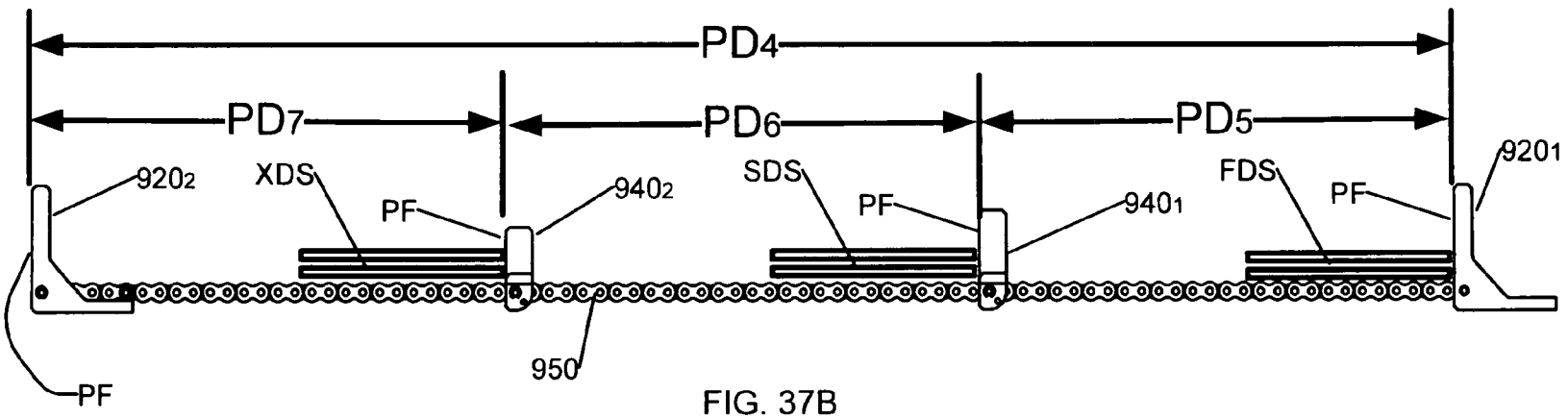
FIG. 37B illustrates a side view of an embodiment of the spacing of first pusher members and movable pusher members on a portion of a conveyor according to the present subject matter.

It can be understood that the feature of an extended dump window can result from the combined operation of assembly station 800 and staging station 900 as shown in FIGS. 31, 33 and 37A. By having movable pusher members 940 assuming a lowered position 960 in staging station 900 as seen in FIG. 31, the distance between pusher members extending into conveying path 418 within staging station 900 is increased. As described above, first pusher members 920 and movable pusher members 940 can alternate such that between any pair of first pusher members 920, a movable pusher member 940 can reside, as seen in FIG. 37A. Further, in other embodiments, multiple movable pusher members 940 can reside between any two consecutive first pusher members 920 as shown in FIG. 37B. FIG. 37A illustrates the spacing of first pusher members 920 and movable pusher members 940 on one embodiment of chain 950 in which first pusher members 920 and movable pusher members 940 alternate. First pusher members 920 and movable pusher members 940 can be spaced equally apart from each other along chain 950 at distances PD2 and PD3 as measured from a pushing face PF of each pusher member 920, 940. However, the distances PD2 and PD3 are not required to be equal. First pusher members 920 are spaced along chain 950 at a distance PD1. Since alternating first pusher members 920 and movable pusher members 940 are spaced equally along chain 950, the distance PD1 between first pusher members 920 is equal to twice the distance PD2 between first pusher members 920 and movable pusher members 940. As a result of the movable pusher member, the effective pitch of the pusher members on the conveying path can be changed by having the movable pusher member in either the up or lower position.

The extended dump window can result from first document set FDS being dumped from the assembly station 800 to the staging station 900 between two consecutive first pusher members without interference from a movable pusher member disposed therebetween. Small documents can be ready to dump from the assembly station 800 using document feeder 820, as soon as the first pusher member 920 passes a minimal staging area, which is approximately equal to the document set width. A major throughput gain for a sheet processing machine can occur when the next document set is large and additional assembly time is required. The extended dump window provides the needed time for the larger document to be assembled and dumped without missing a cycle of pusher members. Optionally, stop gate 910 may be used to control the dumping of large documents. Note that the movable pusher member 940 is in the lowered position 960 (see FIG. 31), allowing the document set FDS to rest above the movable pusher member 940. If movable pusher member 940 was fixed in the upright position at the feeding location 826 (see FIG. 29) and there was a delay in feeding first document set FDS, first document set FDS would land on top of movable pusher member 940, resulting in a jam.

By having movable pusher members 940 pivotable from the lowered position 960 to the upright position 962, the dump window is increased (see FIGS. 31 and 33). Without the feature of movable pusher members being movable out of the conveying path, the first document sets would have to be dumped upstream of the movable push members which would have the effect of reducing the dump window by the distance between the movable pusher members and the first pusher members directly upstream of the pusher members. As seen in FIGS. 31 and 33, when the chain 950 is advanced, the first pusher member $\mathbf{920}_2$ will advance to contact the document set FDS and the movable pusher member 940 will advance to the ramp 938 and be set to the upright position 962. Once movable pusher member 940 is in upright position 962, enclosure feeders 1000 can be used to add the second document set SDS to the conveying path 418.

In the embodiment shown in FIG. 37A, the distance into which to feed the first document sets onto the staging area, i.e., the stop location, of the conveying path from the document feeder is distance D1 between the consecutive first pusher members $\mathbf{920}_1$, $\mathbf{920}_2$, instead of merely the distance D3 between the first pusher member $\mathbf{920}_1$, and the leading movable pusher member 940. The distance in which to feed first document sets on conveying path 418 is increased by the distance $D_2$ by holding movable pusher members 940 in a lowered position beneath the conveying path until after the stop location for first document sets. The effective distance in which to feed first document sets is then equal to the distance PD1 between pusher members $\mathbf{920}_1$, $\mathbf{920}_2$, extending into the conveying path of a sheet processing machine. If both first pusher members and movable pusher members were raised before the stop location of the first document set on staging deck 902, then the distance in which to feed first document sets would only be distance PD3. Thereby, the timing for feeding first document sets would need to be more accurate and the window of time in which to feed first document sets would be shortened when running at comparable speeds.

Since movable pusher members 940 are not extended into the conveying path until after the stop location where first document sets come to reside on conveying path 418 after being fed onto staging deck 902 by document feeder 820, the distance and therefore the timing into which to feed the first document sets are increased. This increased window can thus increase efficiency of the sheet processing machine by increases the flexibility of the timing for feeding first document sets into the conveying path.

As illustrated in FIG. 37B, multiple movable pusher members 940 may be positioned along chain 950 between consecutive first pusher members 920. In the embodiment shown, consecutive first pusher members $\mathbf{920}_1$, $\mathbf{920}_2$, can be spaced along chain 950 at a distance PD4 as measured from a pushing face PF of each pusher member $\mathbf{920}_1$, $\mathbf{920}_2$. A first movable pusher member 940, can be spaced from the first pusher member $\mathbf{920}_1$ at a distance PD5 as measured from pushing face PF of each pusher member $\mathbf{920}_1$, $\mathbf{940}_1$. A second movable pusher member $\mathbf{940}_2$ can be spaced from the first movable pusher member 940, at a distance PD6 as measured from a pushing face PF of each pusher member $\mathbf{940}_1$, $\mathbf{940}_2$. Further, second movable pusher member 9402 is spaced from the second first pusher member $\mathbf{920}_2$ at a distance PD7 as measured from pushing face PF of each pusher member $\mathbf{940}_2$, $\mathbf{920}_2$. The additional pusher members allow additional document sets XDS to be added to the conveying path for later assembly into insert material. By having the first movable pusher member $940_1$ being pivotable, the distance into which to feed the first document set FDS is increased from distance PD5 to distance PD5 plus distance PD6. If both the first and second movable pusher members $940_1$, $940_2$ are pivotable, the distance into which to feed the first document set FDS is increased from the distance PD5 to the distance PD4. Thereby, the dump window can be greatly increased.

Figure 38:
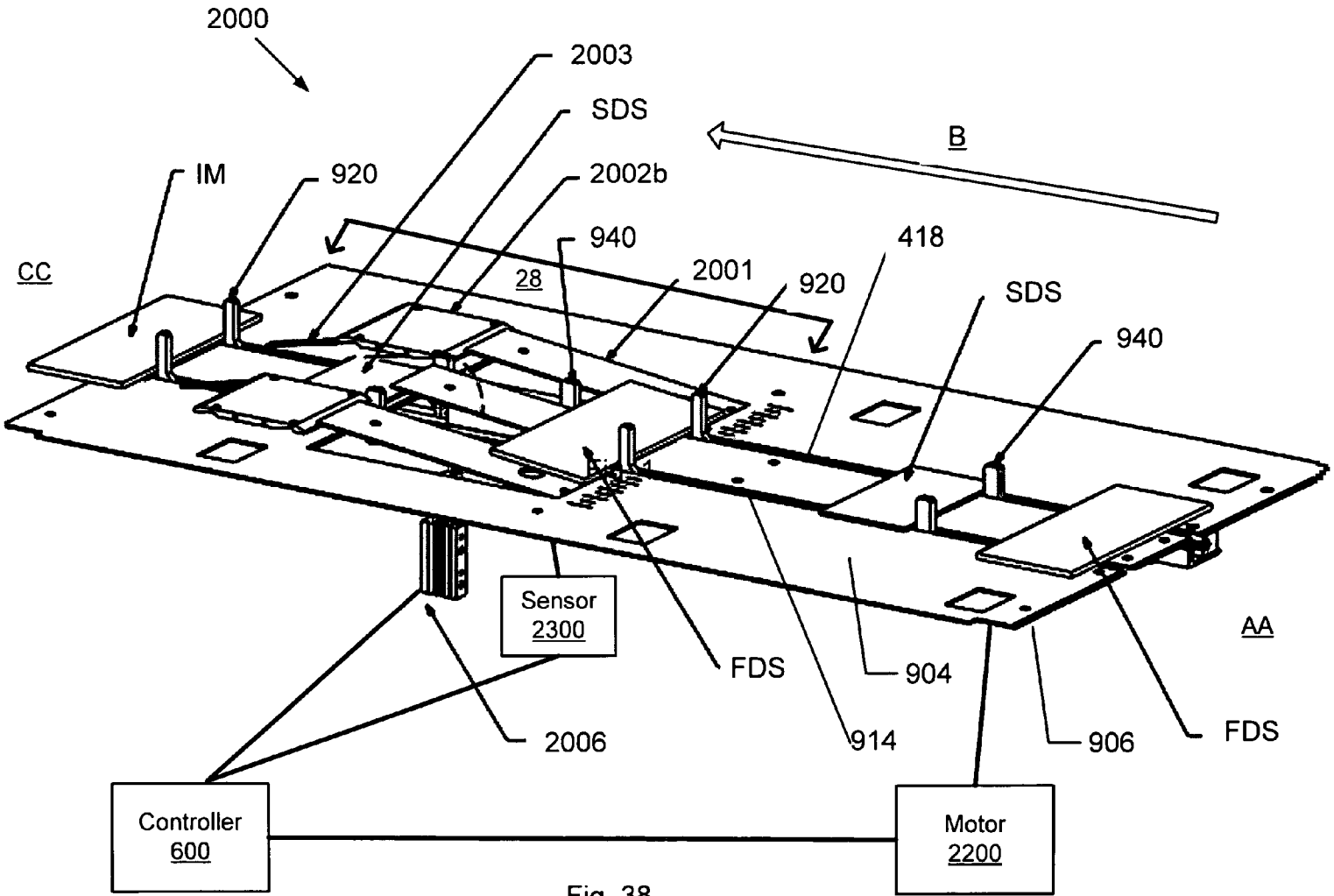
FIG. 38 illustrates an elevated perspective view of an embodiment of a collating apparatus according to the present subject matter.

The present collating apparatus is configured to function with a conventional in-line mail processing. As exemplified in FIG. 1, collating apparatus 2000 is situated between the inserting station 300 and the enclosure feeders $EF_1$, $EF_2$ within the inserting system IS. Documents travel along the inserting system IS in direction B. Collating apparatus 2000 is adapted to advance sequentially delivered document sets, one or more of which may be previously collated, and assemble the document sets into a single collated packet of insert material for mailing. Each document set includes one or more sheet articles and/or mail articles. This is accomplished by incorporating two or more paths into a single collation device as shown in FIG. 38. As discussed above for example, second pusher members 940 that advance lead second document set SDS, disappear below the upper surface 904 and the lead second document set SDS is left deposited at a collating station, being trail edge registered. A set of first pusher members 920 advances the trailing first document set FDS into trail edge registration with the previously deposited lead second document set SDS. The second set of first pusher members 920 removes and assembles both document sets FDS and SDS into a single trail edge registered combined stack of insert material IM. The single trail edge registered combination stack of insert material IM is then advanced by the set of first pusher members 920 for further processing at inserting station 300 (see FIGS. 1 and 2). As discussed above, inserting station 300 is adapted for receiving, supporting, and sequentially feeding envelopes, one at a time, into the document feed path at an area adjacent the downstream portion of the conveyor. Inserting station 300 is constructed for positioning envelopes, one at a time, for receiving therein a collated set of documents. After each envelope is sequentially stuffed by having a collated set of inset material IM inserted into the fixed envelope, the stuffed envelope is conveyed to the downstream end of the raceway conveyor for additional handling.

Figure 39:
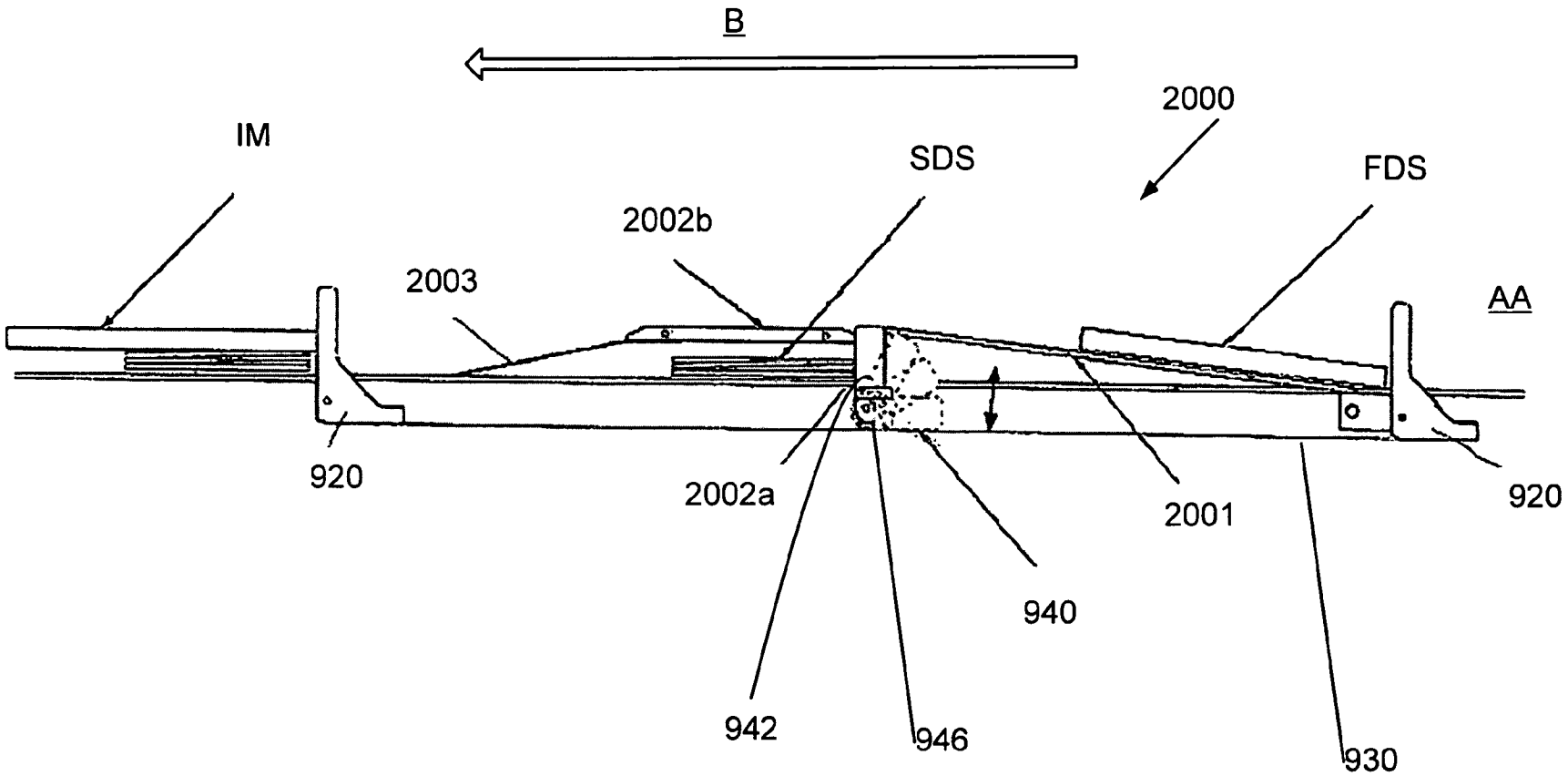
FIG. 39 illustrates a side plan view of the collating apparatus according to FIG. 38.
Figure 40:
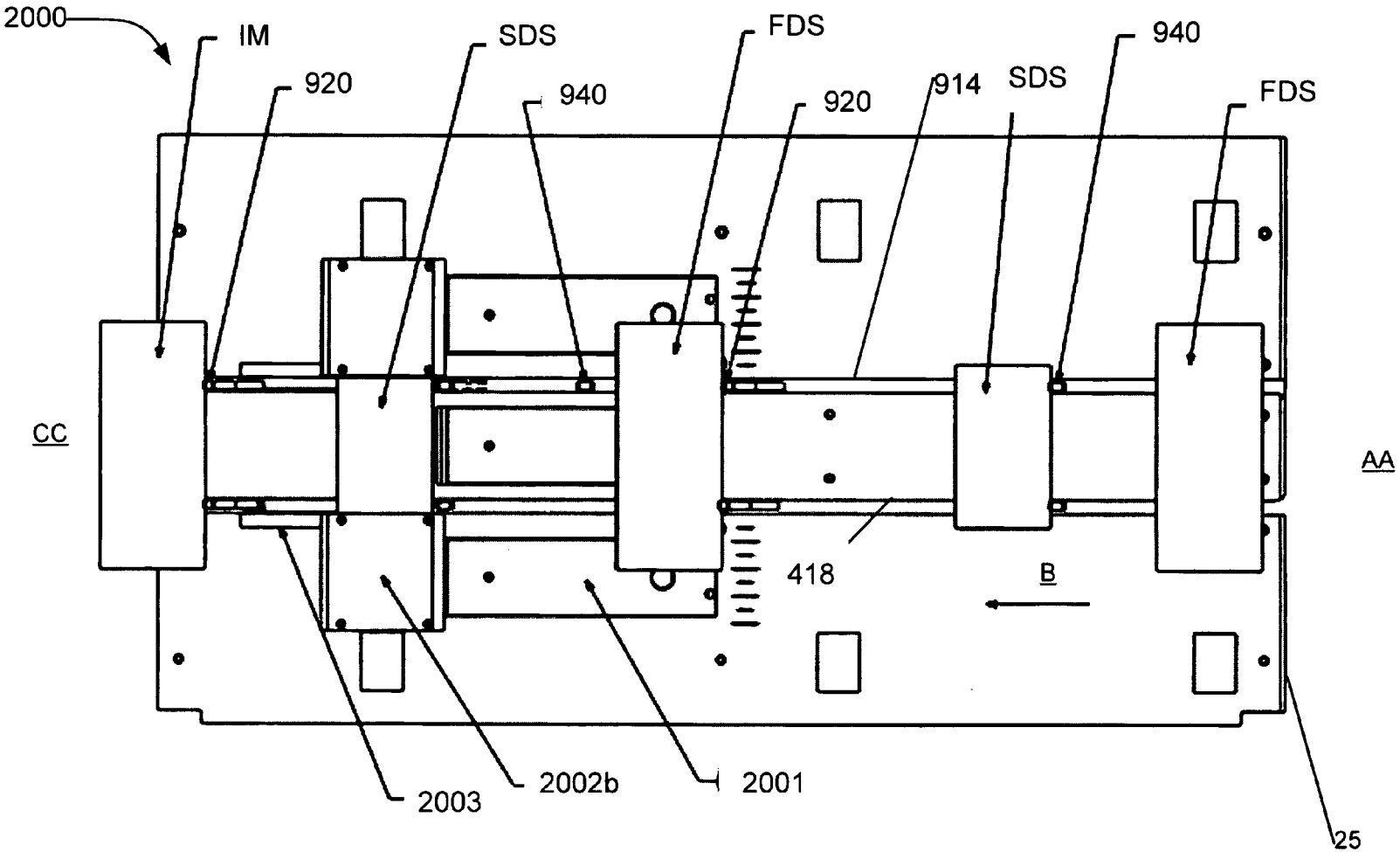
FIG. 40 illustrates a top plan view of the collating apparatus according to FIG. 38.

An embodiment of the collating apparatus 2000 is depicted in FIGS. 38 to 40. Collating apparatus 2000 includes substantially elongated synchronous raceway conveyor 906 with upper surface 904. Raceway conveyor 906 is configured to advance a plurality of document sets consecutively along a substantially horizontal conveying path 418 from an initial upstream position AA to a downstream position CC in the direction B. The plurality of document sets is merged into the combined stack of insert material IM before being inserted into an envelope at inserting station 300 as described above. Each document set may include one or more sheet articles and/or mailing articles intended for mail delivery.

The components of the combined stack of insert material IM to be assembled are transported along the conveying path 418 of collating apparatus 2000 as a series of sequential document sets which can be selectively combined in a predetermined order at a collation station. During normal operation of collating apparatus 2000, two different document sets are shown in FIG. 38. A first document set FDS and a second document set SDS are depicted in FIG. 38. In this example, first document set FDS is the address bearing document. Second document set SDS can include one or more sheet articles and/or mail articles that were previously assembled in a conventional fashion as first and second pusher members 920 and 940 pass under upstream enclosure feeders $EF_1$, $EF_2$ (depicted in FIG. 1 and FIG. 33).

Figure 41:
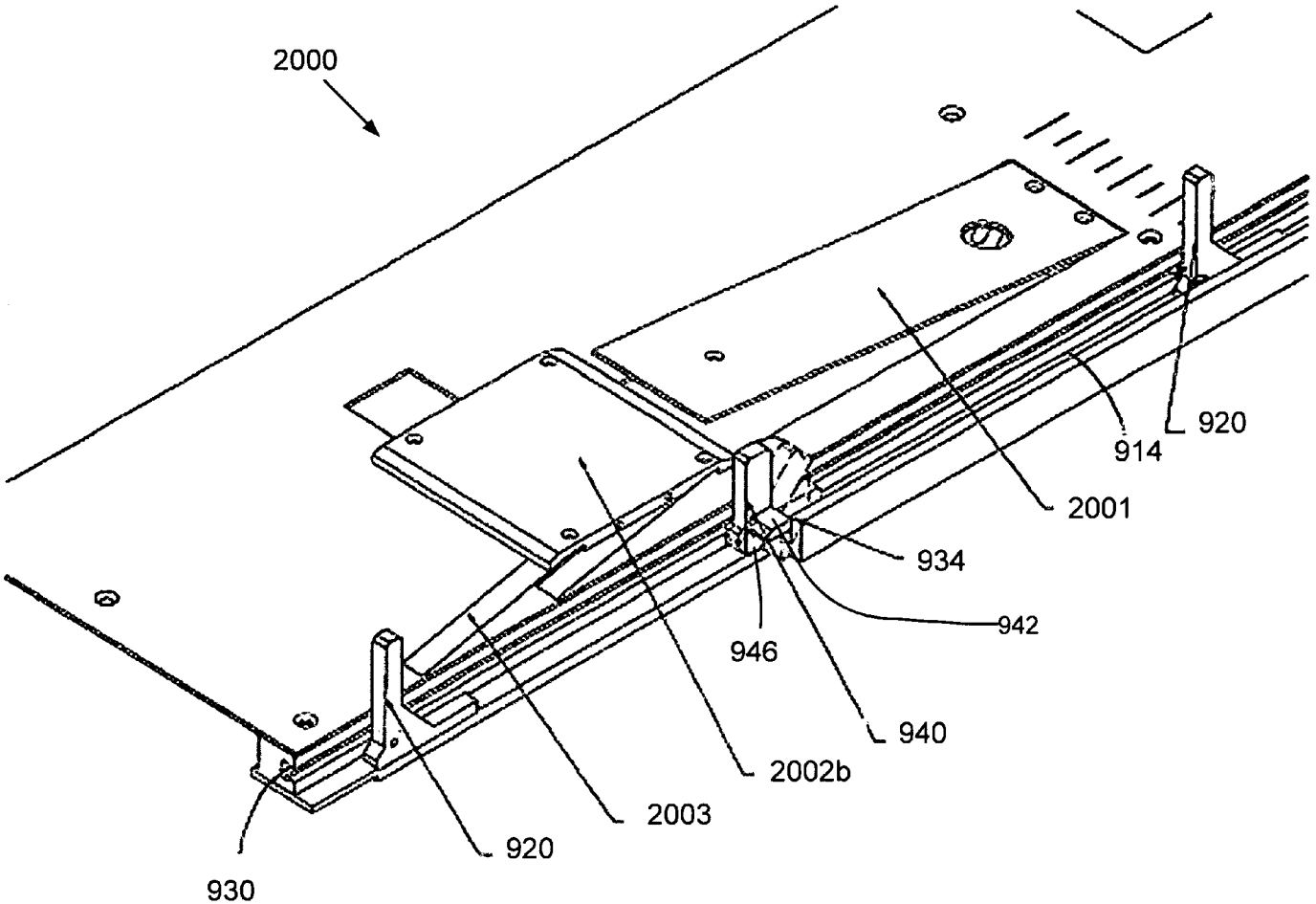
FIG. 41 illustrates a perspective view of a portion of another embodiment of a collating apparatus according to the present subject matter.

A plurality of pusher members 920, 940 positioned within the conveying path 418, deliver document sets SDS, FDS along synchronous raceway conveyor 906. FIG. 41 depicts the conveying path 418 as formed with a pair of parallel, spaced part, longitudinally extending slots 914 through which first pusher members 920 and second pusher members 940 extend. As shown in FIG. 41, pusher members 920, 940 can move along pusher member track 930 positioned below the longitudinally extending slots 914 and can be advanced with a chain (not shown) as discussed above. First pusher members 920 can be fastened to a chain by way of pins and clips, such as E-clips as described above. Alternatively, an anti-rotation pin may be used with first pusher members 920 as well such that the position of first pusher members 920 are maintained or fixed. Second pusher members 940 can be secured to the chain by way of a mounting pin, such as one or more mounting pins. Pusher members 920, 940 are adapted to intercept, contact, push and advance the document sets FDS, SDS downstream along the conveying path 418.

Document sets FDS, SDS are delivered to the synchronous raceway conveyor 906 by conventional mail processing methods from upstream enclosure feeders $EF_1$, $EF_2$ (See FIG. 1). In FIG. 38, each second document set SDS is conveyed by second pusher members 940. Second pusher members 940 are designed to drop away at the precise moment that a second document set SDS is transported downstream to collation station 2002*a*, as shown in FIG. 39. For second document set SDS, an actuating deck plate 2001 is in the horizontal or down position, so the collation point for second document set SDS is at the raceway conveyor 906 level. The advancement of second document set SDS is halted at the point when the second pusher members 940 pivot downward from an upright drive position down to a position below the synchronous raceway conveyor 906 and out of contact with second document set SDS. The mechanism is designed such that once support is removed from the rounded foot 946 of the second pusher member 940, the weight of the foot 946 causes second pusher member 940 to pivot backwards (rotate clockwise) by way of gravity. In other words, the weight of the foot 946 causes second pusher member 940 to rotate clockwise to a position below the synchronous raceway conveyor 906. This mechanism can be augmented by a torsion spring for faster rotation of second pusher member 940. As a result of second pusher member 940 rotating below the synchronous raceway conveyor 906, and out of contact with second document set SDS, second document set SDS is deposited at collation station 2002*a*.

In FIG. 41, the backward pivoting action of second pusher members 940 is illustrated. Second pusher members 940 are designed to rotate backwards at the precise moment that second document set SDS is delivered downstream to collation station 2002*a*. Second pusher members 940 can rotate backwards once the arms 942 of second pusher members 940 clear second section 934 of pusher member track 930 of the raceway conveyor 906, as illustrated in FIG. 41. As described above, second pusher members 940 can be spaced from each other along the chain(s) of the conveying path 418. Similarly, first pusher members 920 can be longitudinally spaced from each other along the chain(s) of the conveying path 418 and positioned intermediate second pusher members 940. Meanwhile, first document set FDS can immediately trail second document set SDS and can be advanced by the first pusher members 920. First pusher members 920 can be fixed or maintained in an upright position where they do not drop away below the synchronous raceway conveyor 906. As first document set FDS approaches actuating deck plate 2001, deck plate 2001 can be raised to an upwardly angled position such that first document set FDS is advanced across the top surface of the raised actuating deck plate 2001 to a second conveying path 418*b* (FIG. 38) elevated above conveying path 418. The region defined by the elevated second conveying path 418*b* begins at approximately the point at which first document set FDS begins to cross over raised actuating deck plate 2001 and ends at the point when first document set FDS and second document set SDS are merged together on conveying path 418.

When first pusher members 920 reach the collation point 2002*a*, they will come into contact with the stationary second document set SDS. At that point of contact at collation point 2002*a*, first pusher members 920 simultaneously advance both document sets FDS and SDS. First document set FDS is next transported down the fixed ramp 2003 and merged, trailing end registered, with second document set SDS. When the document sets FDS and SDS arrive at the collation point 2002*a*, first document set FDS can be selectively (as determined by operator selection or by the design implementation) positioned either on top of second document set SDS or, alternatively, underneath second document set SDS. The selectivity can be fixed, such that the document set being pushed by second pusher members is always deposited on the bottom of the assembled stack of insert material. Alternatively, the selection can be specified by the operator as part of the normal "job" configuration that is necessary for a typical inserting system. The now assembled combined stack of insert material IM can be next transported along the conveying path 418 for additional processing at envelope inserting station 300 positioned downstream as described above.

Actuating deck plate 2001 can be controlled by a two-state actuator such as a solenoid, a pneumatically operated cylinder or the like. Actuating deck plate 2001, as depicted in FIG. 38, can comprise three platforms that can be connected by a common mechanical linkage such that all of the deck plates are positioned by a common actuator. In FIG. 38, a solenoid 2006 is depicted which is adapted to raise one end of the actuating deck plate 2001 to substantially the same height as platform 2002*b*. Platform 2002*b* is an elevated platform mounted on the upper surface of the raceway conveyor downstream from actuating deck plate 2001. In FIG. 39, first document set FDS is advanced with first pusher members 920 across the top surface of the elevated actuating plate 2001, such that second document set SDS will continue to advance on and across the surface of platform 2002*b*.

In another embodiment, the collating apparatus 2000 can comprise a conveying path that is formed with a single, spaced part, longitudinally extending slot through which the first pusher members and second pusher members extend. A single column of alternating first and second pusher members can extend through the longitudinally extending slot of the conveying path. The actuating deck plate can comprise two deck platforms with the conveying path running between the two deck platforms. The actuating deck plate can be raised and lowered with a two-state actuator. First and second document sets are advanced in a similar manner as previously discussed. As the first pusher member reaches the collation point, it will come into contact with the document set already deposited at the collation point via the second pusher member. At the point of contact at the collation point, the first pusher member simultaneously advances both document sets. The second document set is transported down a fixed ramp from the platform and merged with the first document set. The platform is positioned above the conveying path and over the collation point and is separated with a gap through its middle section to permit the first pusher members to pass through the platform.

Figure 42:
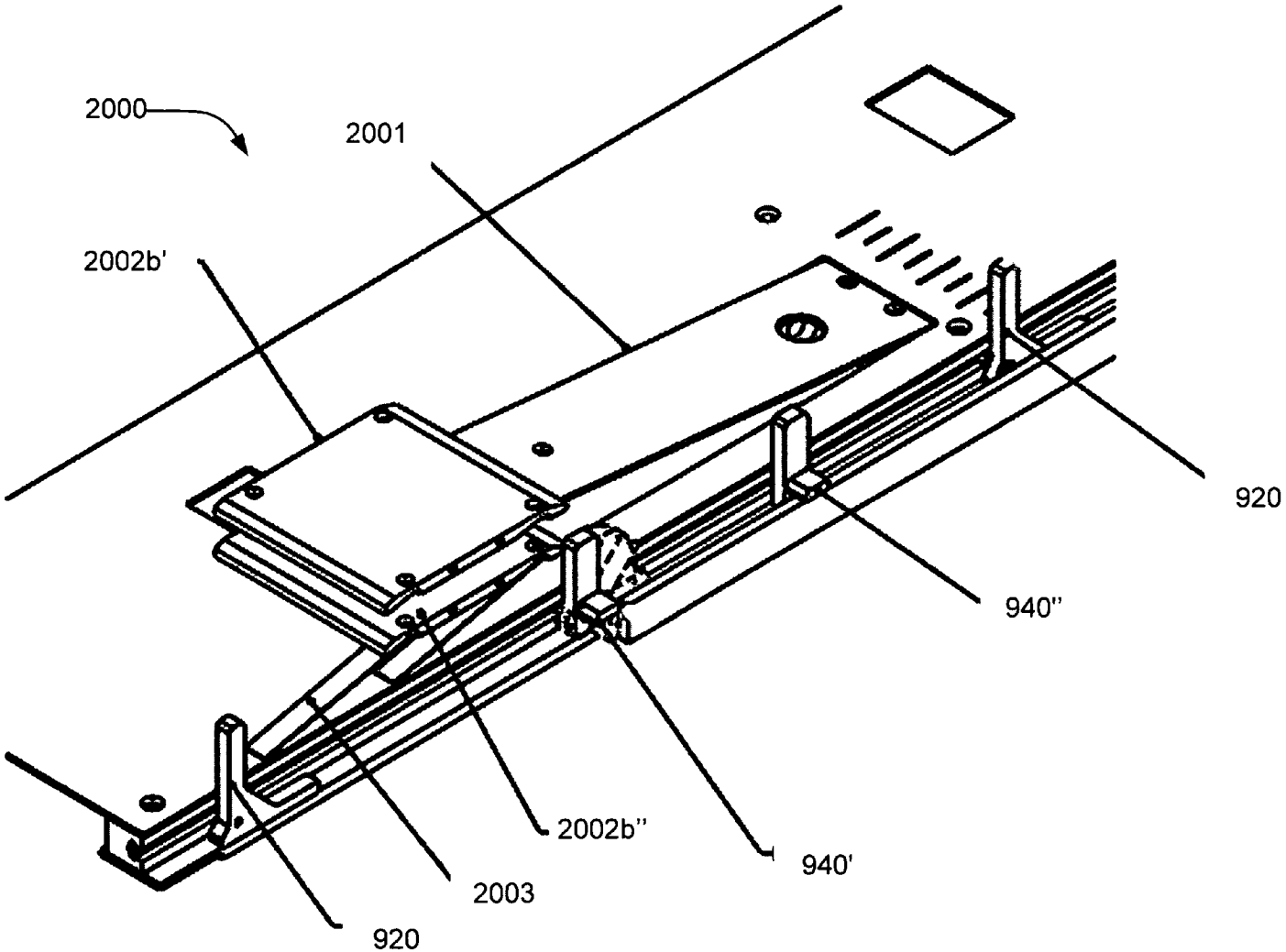
FIG. 42 illustrates a perspective view of a portion of a further embodiment of a collating apparatus according to the present subject matter.

In another example, the collating apparatus 2000 can accommodate multiple second document sets SDS. As shown in FIG. 42, a first second document set SDS' (not shown) can be advanced with second pusher members 940' and another second document set SDS" (not shown) advanced with second pusher members 940". The number of consecutive second pusher members can correspond with the number of levels of platform (2002*b*', 2002*b*", etc.) above the raceway level. An actuator with finer resolution, such as a stepper motor and drive linkage can be used to accommodate multiple document sets in this example. As an example, a document set that is being advanced by a set of second pusher members 940 is capable of being deposited on any platform (2002*b*', 2002*b*", etc.). Each platform level can accept one document set delivered by a second pusher member. The actuator is designed to insure that the actuating deck plate is raised to a proper position at each level of the platform. The association of a document set to a specific platform level can be fixed or selective by a configuration "job".

The operation of the present collating apparatus 2000 can be controlled by means of controller 600 which may adjust the speed of a variable speed motor 2200 in accordance with a desired program. Motor 2200, as seen in FIG. 38, is operable to drive the chains that move the first pusher members 920 and second pusher members 940. Controller 600 is adapted to operate other components of the collating apparatus 2000, including the two-state actuator, in accordance with the speed chosen for operating the motor 2200.

One or more sensing devices 2300, including conventional photocell, infrared-type or other conventional sensing devices, that are capable of detecting preset conditions including limit errors, read errors, integrity errors and handling errors can be included with the collating apparatus 2000. Sensing device(s) 2300 are linked through wiring to controller 600.

Figure 43:
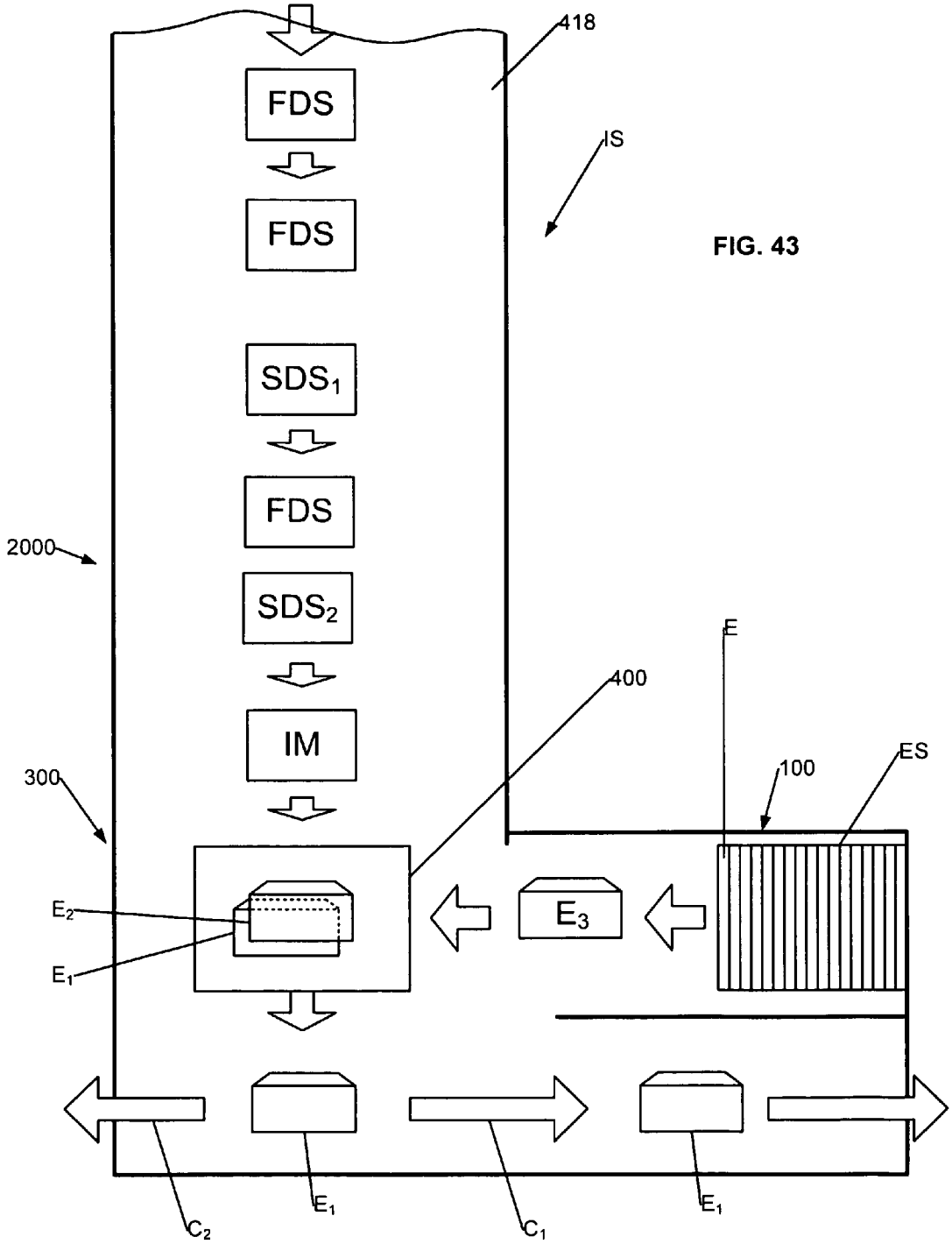
FIG. 43 illustrates a schematic view of an embodiment of an inserting system according to the present subject matter.

FIG. 43 illustrates a schematic view of an embodiment of inserting system IS as document sets are combined into a stack of insert material that is inserted into an envelope to be sealed and mailed. Through the use of sheet feeders, enclosure feeders, different sets of pusher members, and the collating apparatus, a plethora of configurations and arrangements of a multitude of document sets are available to be combined to form insert material within the inserting system IS. For example, a first document set FDS can travel downstream on conveying path 418 to be inserted into an envelope after first document set FDS is fed onto conveying path 418 by, for instance, an assembly station 800 (see FIG. 29). As first document set FDS travels downstream through the aid of first pusher members, a second document set $SDS_1$ can be fed onto conveying path 418 in front of first document set FDS by an enclosure feeder or set of enclosure feeders as described above.

Second document set $SDS_1$ can be fed into conveying path 418 in front of second pusher members that travel ahead of the first pusher members and first document set FDS. The second pusher members can contact and push second document set SDS, down conveying path 418 in front of first document set FDS. Another second document set $SDS_2$ can be fed on top of the first second document set $SDS_1$ by a second enclosure feeder or set of enclosure feeders as the first second document set $SDS_1$ travels down the conveying path 418. In this manner, the same set of second pusher members can push and register the second document sets $SDS_1$ and $SDS_2$ together. The second document sets $SDS_1$ and $SDS_2$ and first document set FDS can be combined into a combined stack of insert material IM in collating apparatus 2000 as described above to be inserted into an envelope downstream.

As discussed above, the positioning of the first and second document sets as well as the number of second document sets may vary greatly depending on the setup of the inserting system. Multiple second document sets, which can be pushed by one or more sets of second pusher members, can be combined with a first document set. The collating apparatus can control how the different document sets are then combined. Further, enclosure feeders can feed enclosures directly onto the first document set. Thus, the inserting system IS provides many options concerning the configuration and arrangement of insert material.

Insert material IM can then be transported to inserting station 300. As mentioned previously, at the same time, envelopes E from an envelope stack ES in an envelope feeder 100 can be fed toward a variable envelope opener apparatus 400 within the inserting station 300 as described above. Inserting system IS can have a dual envelope capacity such that a first envelope such as first envelope $E_1$ can be in a first envelope holding location that is the insertion position where envelope $E_1$ is ready to receive newly formed insert material IM. Simultaneously, a second envelope such as second envelope $E_2$ can proximately reside in a second envelope holding location that can be a staging position in a vertical orientation that can be proximate to and above first envelope $E_1$. Once insert material IM is inserted into envelope $E_1$, envelope $E_1$ can be advanced out of inserting system IS, such as in direction $C_2$ or it can be transported in direction $C_1$ to be sealed and prepared for mailing. Envelope $E_2$ can then enter the insertion position to receive the next set of insert material, while a third envelope $E_3$ can then enter the staging position above the insertion position.

A versatile sheet article processing machine needs to be able to run all of the jobs associated with the set of customers that the may operate the machine. The insert material characteristics is one factor, but the characteristics of the envelope that the sheet articles will be inserted into can ultimately dictate the flexibility that must be incorporated in the machine. Envelopes can come in two basic standards defined by postal authorities.

For the United States Postal Service (USPS) the standards are as follows:

TABLE 1

| | |
|---|---|
| Letters | Not less than 5 inches long, 3½ inches high.<br>Not more than 11½ inches long or more than 6⅛ inches high. |
| Flats | More than 11½ inches long or more than 6⅛ inches high.<br>Not more than 15 inches long or more than 12 inches high. |

Referring back to the overall system as shown for example in FIG. 1, and staying within the physical constraints of letter and flat mail, there are other envelope configurations that inserting system IS can handle by utilizing built in adjustments for different envelope sizes and sheet article sizes. Further flexibility can result from the unique combination of the envelope feeder 100, the roller apparatus 200 (shown for example in FIGS. 3, 4A, 4B and 5) to control the envelope flap, the envelope registration apparatus 440, the variable envelope opening apparatus 400, the collating apparatus 2000 for assembly of document sets into a single collated packet, the staging apparatus 900 for increased processing, which can have variable pitch pusher members for desired collation abilities.

For envelope types that are within the acceptable physical dimensions for the postal authority, there are four common orientations.

TABLE 2

| | |
|---|---|
| Closed face | No window; address printed on the front side; flap closes on the backside |
| Normal window | Window for address on front side; address on enclosure and visible through the window; flap closes on the back side |
| Billboard closed face | No window; address printed on the front side; flap closes on the front side |
| Billboard windowed | Window for address on front side; address on enclosure and visible through the window; flap closes on the front side |

Figure 45:
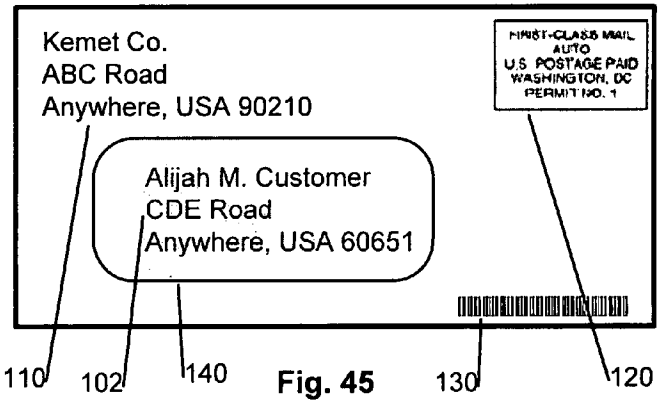
FIGS. 44-47 illustrate various aspects of envelopes according to the present subject matter.
Figure 44:
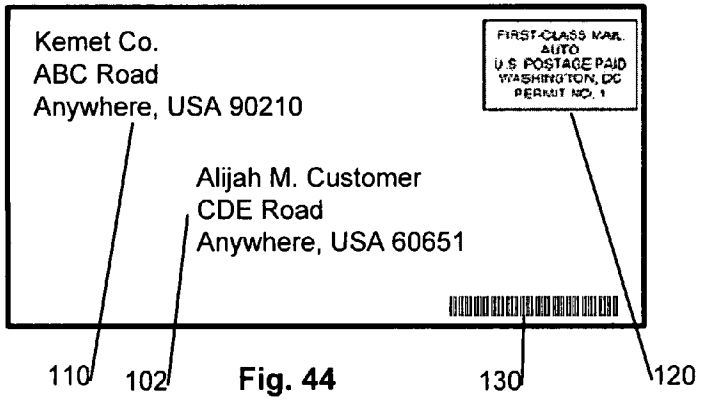
Figure 47:
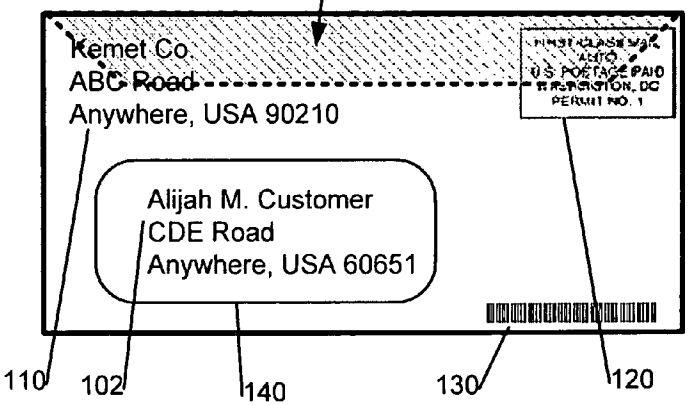
Figure 46:
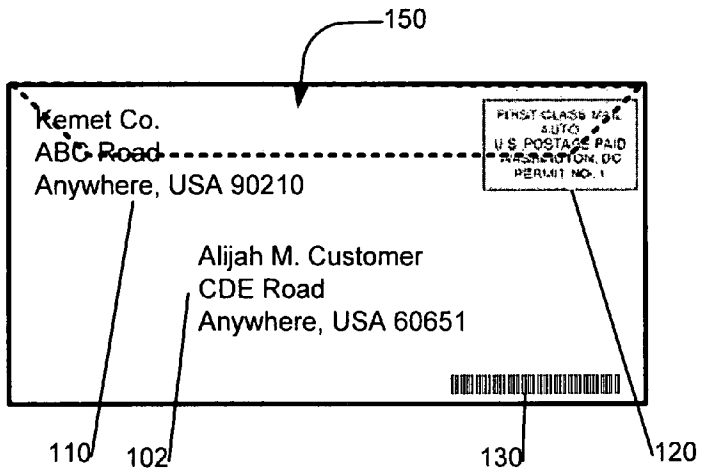

As seen in FIG. 44, a closed face envelope can have a blank face without a window and the flap (not shown) folded on to the opposite side. Printed on the face is typically a return address 110, a delivery address 100, a delivery point barcode 130 and indicia 120. Numerous other features may be printed on the face as required by the postal authority or by the mailer. FIG. 45 is representative of a normal windowed envelope. In this case at least the delivery address 100 is printed on a sheet article enclosed in the envelope and visible through a window 140. FIG. 46 illustrates a closed face envelope where the address data 100 and other items will be printed on the closed flap side of the envelope 150. FIG. 47 is representative of a windowed envelope except that the window 140 is on the closed flat side 150 of the envelope. At least the delivery address 100 is printed on a sheet article enclosed in the envelope and visible through a window 140. Each of these envelope types can be processed with the envelope feeder, the roller apparatus to control the envelope flat, the envelope registration apparatus and the variable envelope opening apparatus as described in detail previously. Numerous other features and nomenclatures for envelope types may be known in the art. For example, additional windows can be added, different address orientations (portrait or landscape) can be used, and a large amount of variation in printed material may exist on the face of the envelope.

Figure 48A:
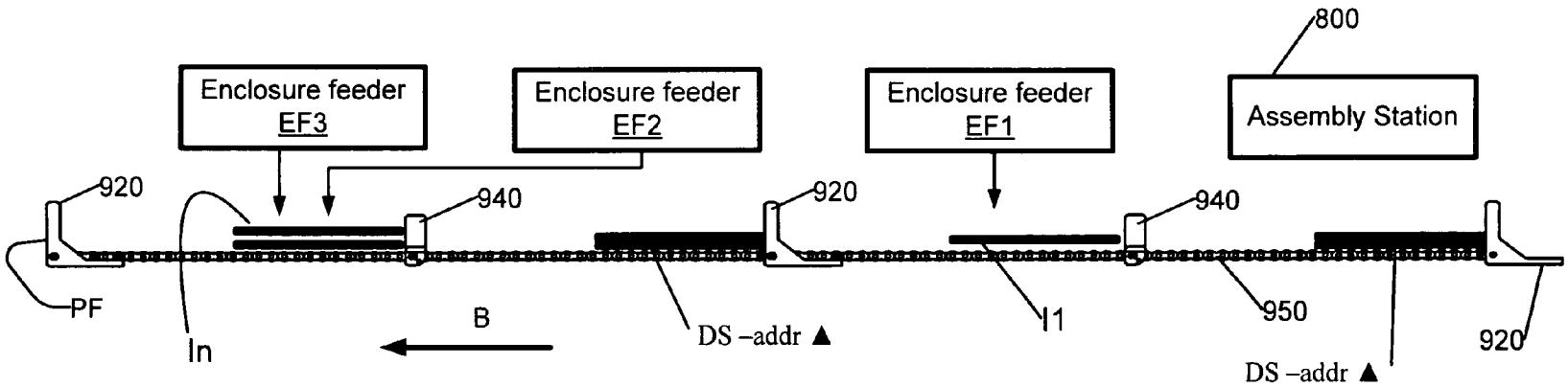
FIGS. 48A and 48B illustrate examples of sheet article processing possible according to the present subject matter.
Figure 48B:
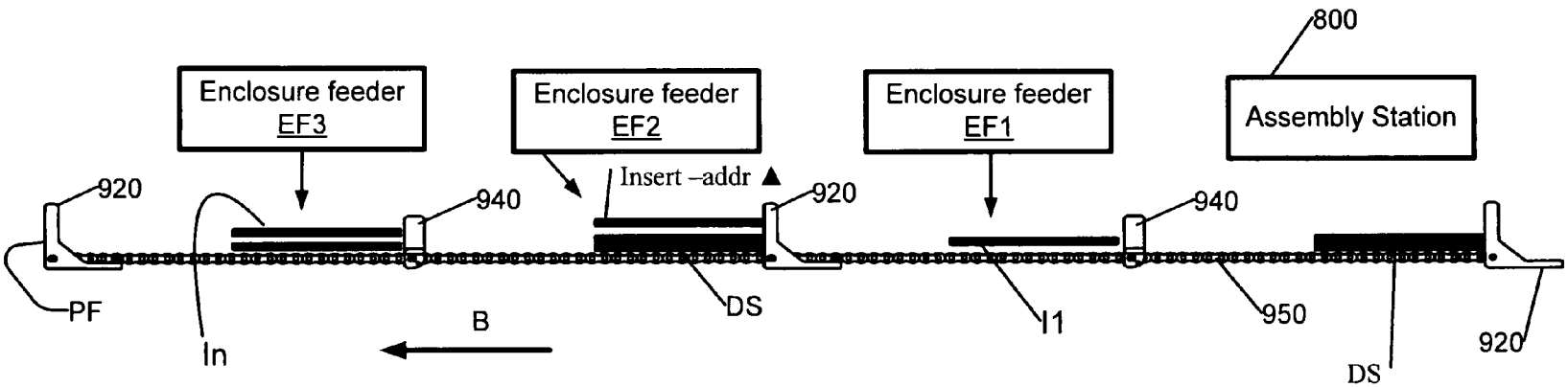
Figure 49A:
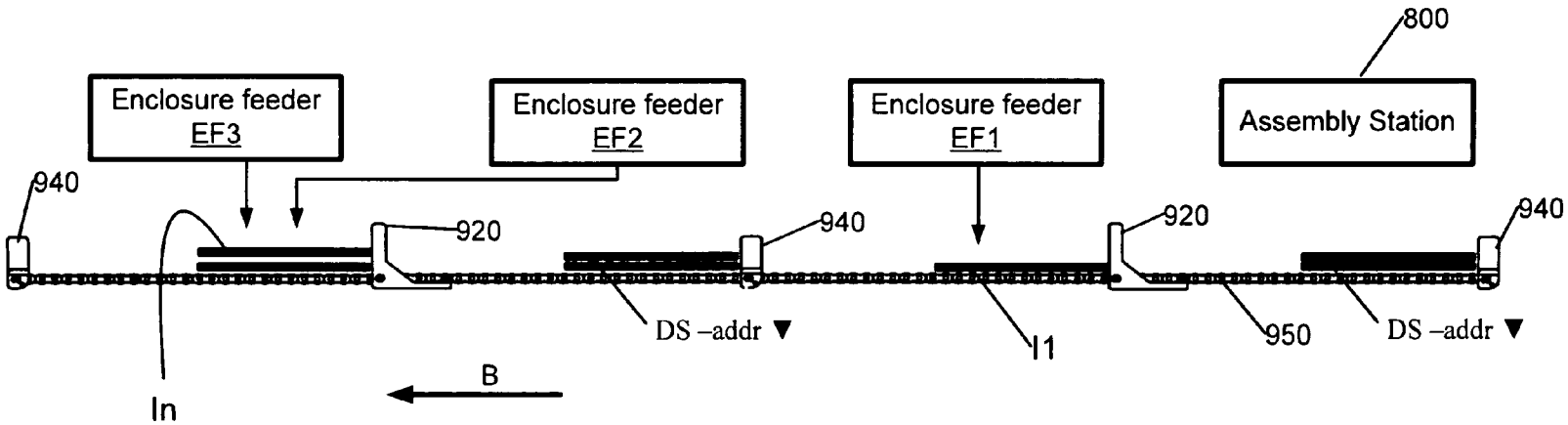
FIGS. 49A and 49B illustrate additional examples of sheet article processing possible according to the present subject matter.
Figure 49B:
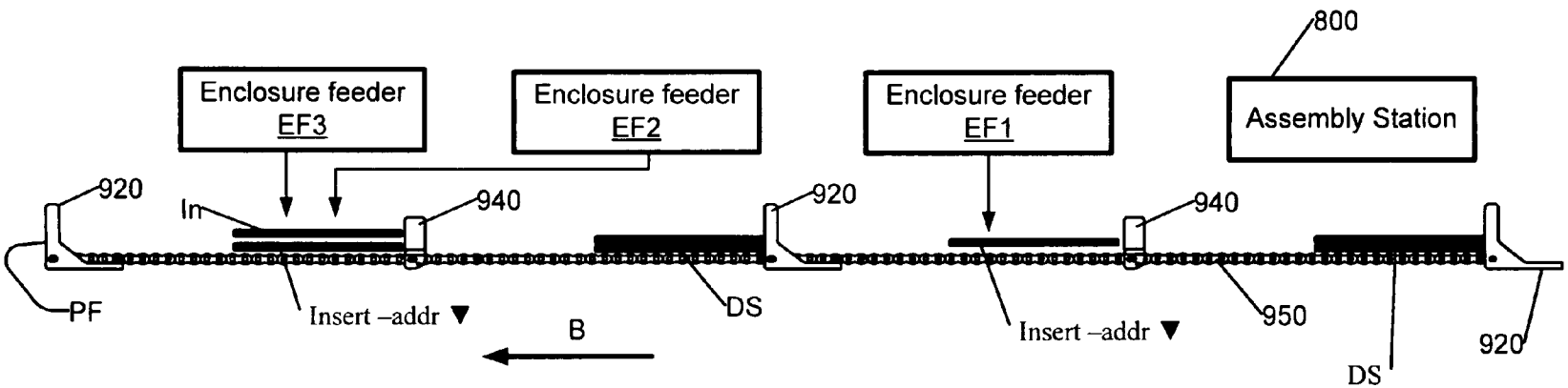

The envelope type as well as mailer preference can dictate the order and orientation of the inserts in the envelope. For the closed face styles, the order can be dictated by the mailer since no address data needs to be visible through a window. For processing normal window envelopes on the sheet article processing machine,. the window 140 can be facing up since the open flap $F_2$ is on the top as shown in FIG. 18. Hence the address bearing enclosure can be on top and facing up. FIGS. 48A and 48B show two of the numerous originations of sheet articles on the collation track for the upward facing window. For processing billboard windowed envelopes on the sheet article processing machine, the window of the envelope can be facing down since open flap $F_2$ is on the top and given window 140 as noted with respect to FIG. 18 and described above. Hence the address bearing enclosure can be on bottom and facing down. FIGS. 49A and 49B show two of the numerous originations of sheet articles on the collation track for the downward facing window.

To accommodate these envelope and enclosure variations, inserting system IS can only require mechanical adjustments and changes in the controller 600. As indicated in FIG. 1, commands that are dictated by the job set up requirements are generated in the controller 600. These commands determine what sheet articles are deposited on to the collation track by the assembly station 800 and enclosure feeders EF and control the timing of these actions. For this example, there can be three types of enclosures: document sets such as billing statements; inserts that are advertising (feed by the enclosure feeders EF); and inserts that contain the delivery address (feed by the enclosure feeders EF). Those skilled in the art may utilize other configurations and material types for enclosures to be inserted into and envelope.

Figure 50:
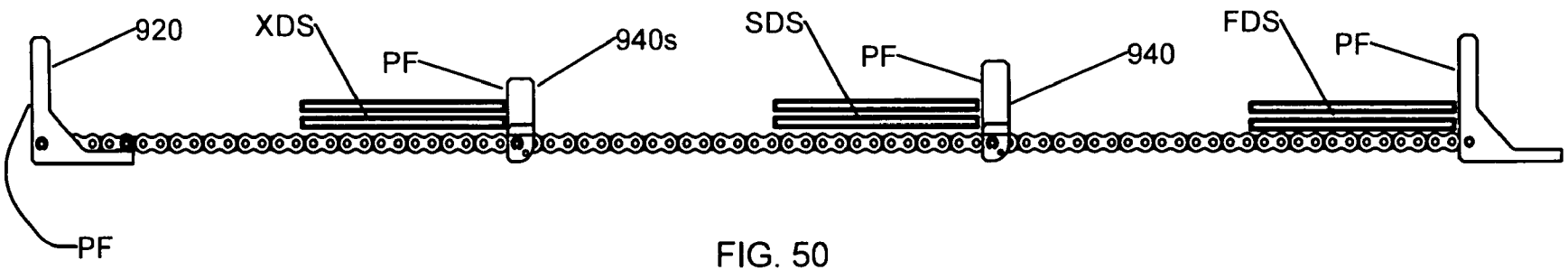
FIG. 50 illustrates an example of processing of sheet articles in document sets according to the present subject matter.

Inserting system IS can process many sheet article configurations using the control and adjustments mentioned above. Additional flexibility can be achieved by adding additional levels to collating apparatus 2000 which makes it possible to add more unique groups of sheet articles on to the collation track such as but not limited to color and black and white document sets. Changes in the collation track pusher members such as shown in FIG. 50 also can accompany changes to the collating apparatus. For the example shown in FIG. 50, FDS can be a color document set, SDS can be a black and white document set, and XDS can be a set of inserts. An additional movable pusher member 940*s* has been added to the chain where pusher member 940S can be shorter than the following pusher member 940 to account for a third level that can be added to collating apparatus 2000.

For purposes of illustration, Table 3 identifies three configurations for a two level collating apparatus 2000 for the normal window envelopes. Table 4 identifies three configurations for a two level collating apparatus 2000 for the billboard windowed envelopes. These illustrations in no way limit the alternate configurations that those skilled in the art may choose to implement. Two examples are further illustrated by showing the configurations on the collation track and accompanying chain. The figure references are included in the respective tables. Referring to Table 3, DS-addr ▲ refers to a document set with the address facing up; Insert-addr ▲ refers to an insert with the address facing up, and insert refers to material fed from an enclosure feeder.

TABLE 3

| | Top of enclosure stack | |
|---|---|---|
| DS -addr ▲ | Insert -addr ▲ | Insert -addr ▲ |
| Insert(s) | DS | Insert(s) |
| | Insert(s) | DS |
| FIG. 48A | FIG. 48B | |

Referring to Table 4, DS-addr ▼ refers to a document set with the address facing down; Insert-addr ▼ refers to an insert with the address facing down and insert refers to material fed from an enclosure feeder.

TABLE 4

| | Top of enclosure stack | |
|---|---|---|
| Insert(s) | Insert(s) | DS |
| DS -addr ▼ | DS | Insert(s) |
| | Insert -addr ▼ | Insert -addr ▼ |
| FIG. 49A | | FIG. 49B |

FIG. 48A represents one of the most common configurations for a normal window envelope. Assembly station 800 can dump a document set DS-addr ▲ onto the raceway conveyor or collation track (only chain 950 is shown for purposes of illustration). The address is printed on document set DS-addr ▲ and is facing upward in front of a pusher member 920. When the track advances to the first enclosure feeder EF1, one or more enclosures, which can be for example any sheet material to be inserted into an envelope such as insert I1, can be fed to the collation track in front of a movable pusher member 940. As the collation track advances further in direction B, one or more additional inserts $I_n$ can be fed in front of the movable pusher pin 940 by enclosure feeder EF2 and/or enclosure feeder EF3.

FIG. 48B represents a configuration for a normal window envelope where the address bearing sheet article is an insert. Assembly station 800 can dump a document set onto the collation track (only chain 950 is shown for purposes of illustration) in front of a pusher member 920. The address can be printed on the insert Insert-addr ▲ and is facing upward. When the track advances to the first enclosure feeder EF1, one or more inserts such as insert I1 can be fed to the collation track in front of a movable pusher member 940. As the collation track advances further in direction B, the address bearing insert can be fed on top of the document set. This can be accomplished by utilizing enclosure feeder EF2. Those skilled in the art will recognize that any of the enclosure feeders could be utilized based on job set up in the controller 600. One or more additional inserts such as inserts $I_n$ can be fed in front of the movable pusher member 940 by enclosure feeder EF3.

FIG. 49A represents a configuration for a billboard window envelope. The assembly station 800 can dump a document set onto the collation track (only chain 950 is shown for purposes of illustration). The address can be printed on the document set DS-addr ▼ and is facing downward in front of a movable pusher member 940. When the track advances to the first enclosure feeder EF1, one or more inserts such as insert I1 can be fed to the collation track in front of a pusher member 920. As the collation track advances further in direction B, one or more additional inserts $I_n$ can be fed in front of the pusher member 920 by enclosure feeder EF2 and/or enclosure feeder EF3. No additional inserts are added on top of the document set, but this would be a clear option in this example since the address viability is not affected.

FIG. 49B represents a configuration for a billboard window envelope where the address bearing sheet article is an insert. Assembly station 800 can dump a document set onto the collation track (only chain 950 is shown for purposes of illustration) in front of a pusher member 920. The address can be printed on the insert Insert-addr ▼ and is facing downward. When the track advances to the first enclosure feeder EF1, an insert with address Insert-addr ▼ can be fed by first enclosure feeder EF1 to the collation track in front of a movable pusher member 940. As the collation track advances further in direction B, additional inserts In can be fed in front of the pusher member 940 by enclosure feeder EF2 and/or enclosure feeder EF3. No additional inserts are added on top of the document set, but this would be a clear option since the address viability is not affected.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter. It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

The invention claimed is:

1. An inserting system comprising:

(a) a sheet processor having at least a first location and a second location along a conveying path for respectively advancing at least a first document set and a second document set separately along the conveying path toward an insertion station;

(b) at least one first input for advancing sheet articles to the first location, and at least one second input for advancing sheet articles to the second location;

(c) a plurality of pusher members for advancing sheet articles along the conveying path, the pusher members including at least one pusher member configured to be extended and maintained in a fixed position during movement along the conveying path which the plurality of pusher members travel and at least one pusher member being movable from the conveying path at one or more areas along the conveying path; and (d) a collating area for combining the separately advanced first and second document sets into a stack of insert material;

(e) the stack of insert material being insertable into an envelope at the inserting station.

2. The inserting system of claim 1 wherein the second sheet input comprises an enclosure feeder.

3. The inserting system of claim 1 comprising an envelope path for advancing one or more envelopes to the inserting station.

4. The inserting system of claim 1 comprising a plurality of enclosure feeders for advancing additional document sets to the conveying path.

5. The inserting system of claim 1 wherein the collating area comprises a movable ramp.

6. The inserting system of claim 5 wherein the ramp is selectively movable for stacking the insert material such that the first document set is on top of the second document set.

7. The inserting system of claim 5 wherein the ramp is selectively movable for stacking the insert material such that the second document set is on top of the first document set.

8. The inserting system of claim 1 further comprising:

(e) an adjustable envelope opener for selectively and variably opening an envelope in the inserting station;

(f) wherein the stack of insert material can be inserted into an envelope at the inserting station.

9. The inserting system of claim 1 wherein at least one of the first or second document sets includes an address thereon and the collating area is configured to combine the separately advanced first document set and second document set into a stack of insert material to permit the address to be on either a bottom or a top of the stack of insert material.

10. The inserting system of claim 9 wherein the first input is configured to feed the first document set with the address thereon face down.

11. The inserting system of claim 9 wherein the first input is configured to feed the first document set with the address thereon face up.

12. The inserting system of claim 9 wherein the second input is configured to feed the second document set with the address thereon face down.

13. The inserting system of claim 9 wherein the second input is configured to feed the second document set with the address thereon face up.

14. The inserting system of claim 9 wherein the collating area comprises a movable ramp.

15. The inserting system of claim 14 wherein the ramp is selectively movable for stacking the insert material such that the first document set is on top of the second document set.

16. The inserting system of claim 15 wherein the first input is configured to feed the first document set with the address thereon face up.

17. The inserting system of claim 15 wherein the second input is configured to feed the second document set with the address thereon face down.

18. The inserting system of claim 14 wherein the ramp is selectively movable for stacking the insert material such that the second document set is on top of the first document set.

19. The inserting system of claim 18 wherein the first input is configured to feed the first document set with the address thereon face down.

20. The inserting system of claim 18 wherein the second input is configured to feed the second document set with the address thereon face up.

21. The inserting system of claim 9 further comprising an envelope path for advancing one or more envelopes to the inserting station.

22. The inserting system of claim 9 further comprising a plurality of pusher members for advancing sheet articles along the conveying path.

23. The inserting system of claim 22 further comprising fixed and pivotable pusher members.

24. The inserting system of claim 23 further comprising a staging station wherein the pivotable pusher members reside in a lowered position beneath the conveying path when passing through the staging station.

25. The inserting system of claim 24 wherein the first input feeds the first document set into the staging station.

26. The inserting system of claim 9 further comprising an adjustable envelope opener for selectively and variably opening an envelope in the inserting station.

27. The inserting system of claim 26 wherein the envelope includes a window and the envelope opener is configured to orient the envelope so that the address on at least one of the first document set or the second document set is viewable through the window.

28. An inserting method comprising:

(a) advancing a first document set having one or more sheet articles from a first input to a first location along a conveying path;

(b) advancing a second document set having one or more sheet articles from a second input to a second location along the conveying path;

(c) separately advancing along the conveying path the first document set with a fixed position pusher member and the second document set with a pivotable pusher member toward a collating area of an inserting station wherein the fixed position pusher member is configured to be extended and maintained in a fixed position through the first location, the second location and the collating area along the conveying path, and the pivotable pusher member is movable from the conveying path at the first location and the collating area along the conveying path; and (d) combining the separately advanced first document set and second document set into a stack of insert material at the collating area for insertion into an envelope at the inserting station.

29. The method of claim 28 comprising advancing one or more envelopes to the inserting station.

30. The method of claim 28 comprising inserting the stack of insert material into an envelope at the inserting station.

31. The method of claim 28 comprising advancing the first document set from a sheet input source to the conveying path.

32. The method of claim 28 comprising advancing the second document set from an enclosure feeder to the conveying path.

33. The method of claim 28 comprising advancing one or more additional document sets to the conveying path.

34. The method of claim 33 wherein the one or more additional document sets are advanced to the conveying path on top of the second document set.

35. The method of claim 33 wherein the one or more additional document sets are advanced to the conveying path downstream from the second document set.

36. The method of claim 33 wherein the one or more additional document sets are advanced to the conveying path upstream from the second document set.

* * * * *

UNITED STATES PATENT AND TRADEMARK OFFICE

CERTIFICATE OF CORRECTION

PATENT NO. : 7,637,490 B2
APPLICATION NO. : 11/546535
DATED : December 29, 2009
INVENTOR(S) : Kapturowski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 484 days.

Signed and Sealed this

Ninth Day of November, 2010

David J. Kappos

David J. Kappos
*Director of the United States Patent and Trademark Office*